US008666270B2

(12) United States Patent
Kubota et al.

(10) Patent No.: US 8,666,270 B2
(45) Date of Patent: Mar. 4, 2014

(54) IMAGE FORMING APPARATUS

(75) Inventors: Keisuke Kubota, Kanagawa (JP); Toshiharu Hachisuka, Kanagawa (JP); Atsushi Nagata, Kanagawa (JP); Takashi Kagami, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 193 days.

(21) Appl. No.: 13/164,384

(22) Filed: Jun. 20, 2011

(65) Prior Publication Data

US 2011/0311249 A1 Dec. 22, 2011

(30) Foreign Application Priority Data

Jun. 21, 2010 (JP) ..... 2010-140189
Jun. 30, 2010 (JP) ..... 2010-148661
Jul. 1, 2010 (JP) ..... 2010-151075

(51) Int. Cl.
*G03G 15/20* (2006.01)

(52) U.S. Cl.
USPC ..... 399/44; 399/67; 399/68

(58) Field of Classification Search
USPC ..... 399/67, 68, 44
See application file for complete search history.

(56) References Cited

U.S. PATENT DOCUMENTS 6,308,021 B1 * 10/2001 Isogai et al. ..... 399/67
6,397,021 B2 * 5/2002 Hayashi et al. ..... 399/69
6,577,840 B2 6/2003 Hachisuka et al.
6,865,363 B2 3/2005 Hachisuka et al.
7,127,204 B2 10/2006 Satoh et al.
7,313,353 B2 12/2007 Satoh et al.
7,548,718 B2 6/2009 Kubota et al.
7,567,766 B2 * 7/2009 Miyata et al. ..... 399/69
7,590,366 B2 * 9/2009 Nakayama ..... 399/67
7,672,630 B2 3/2010 Hachisuka
7,856,201 B2 12/2010 Takagaki et al.
7,869,729 B2 1/2011 Hachisuka (Continued)

FOREIGN PATENT DOCUMENTS

JP 8-185078 7/1996
JP 2002-162853 6/2002

(Continued)

OTHER PUBLICATIONS

Office Action issued in corresponding Japanese Patent Application No. 2010-140189 on Dec. 10, 2013.

(Continued)

*Primary Examiner* — Clayton E Laballe
*Assistant Examiner* — Michael Harrison
(74) *Attorney, Agent, or Firm* — Oblon, Spivak, McClelland, Maier & Neustadt, L.L.P.

(57) ABSTRACT

An image forming apparatus includes an imaging unit, a fixing unit, a first thermometer, and a controller. The imaging unit forms a toner image on a recording medium conveyed along a media conveyance path. The fixing device is disposed downstream from the imaging unit along the media conveyance path to fix the toner image in place on the recording medium. The fixing device includes a fuser roller, a heat roller, an endless, fuser belt, and a pressure roller. The fuser roller has a cylindrical core of metal. The pressure roller presses against the fuser roller via the fuser belt to form a fixing nip therebetween. The first thermometer detects a first temperature at the cylindrical core of the fuser roller. The controller controls conveyance of the recording medium through the fixing nip according to the first temperature.

20 Claims, 21 Drawing Sheets

(56) References Cited

U.S. PATENT DOCUMENTS

| | | | | |
|---|---|---|---|---|
| 7,869,752 | B2 | 1/2011 | Kayahara et al. | |
| 7,912,392 | B2 | 3/2011 | Yoshinaga et al. | |
| 7,945,198 | B2 | 5/2011 | Mitsuya et al. | |
| 2008/0170896 | A1 | 7/2008 | Kubota et al. | |
| 2009/0016786 | A1 | 1/2009 | Suzuki et al. | |
| 2009/0169232 | A1 | 7/2009 | Kunii et al. | |
| 2009/0174888 | A1* | 7/2009 | Ko | 358/1.9 |
| 2009/0274477 | A1 | 11/2009 | Okamoto et al. | |
| 2009/0274494 | A1 | 11/2009 | Okamoto et al. | |
| 2009/0274495 | A1 | 11/2009 | Okamoto et al. | |
| 2009/0274496 | A1 | 11/2009 | Okamoto et al. | |
| 2009/0274497 | A1 | 11/2009 | Okamoto et al. | |
| 2009/0274498 | A1 | 11/2009 | Okamoto et al. | |
| 2010/0014897 | A1 | 1/2010 | Seto et al. | |
| 2010/0014903 | A1 | 1/2010 | Seto et al. | |
| 2010/0046973 | A1 | 2/2010 | Hachisuka | |
| 2010/0104298 | A1 | 4/2010 | Hachisuka | |
| 2010/0232844 | A1 | 9/2010 | Saito et al. | |
| 2010/0239292 | A1 | 9/2010 | Fujita et al. | |

FOREIGN PATENT DOCUMENTS

| | | |
|---|---|---|
| JP | 2004-020689 | 1/2004 |
| JP | 2007-72289 | 3/2007 |
| JP | 2007-298720 | 11/2007 |
| JP | 2009-163038 | 7/2009 |

OTHER PUBLICATIONS

Office Action issued in corresponding Japanese Patent Application No. 2010-148664 on Dec. 17, 2013.

* cited by examiner

IMAGE FORMING APPARATUS

CROSS-REFERENCE TO RELATED APPLICATIONS

The present patent application claims priority pursuant to 35 U.S.C. §119 from Japanese Patent Application Nos. 2010-140189, 2010-148661, 2010-151075, filed on Jun. 21, 2010, Jun. 30, 2010, and Jul. 1, 2010, respectively, which are hereby incorporated by reference herein in their entirety.

BACKGROUND OF THE INVENTION

1. Field of the Invention

The present invention relates to an image forming apparatus, and more particularly, to an image forming apparatus incorporating a fixing device that fixes a toner image in place on a recording medium with heat and pressure.

2. Description of the Background Art

In electrophotographic image forming apparatuses, such as photocopiers, facsimile machines, printers, plotters, or multifunctional machines incorporating several of those imaging functions, an image is formed by attracting toner particles to a photoconductive surface for subsequent transfer to a recording medium such as a sheet of paper. After transfer, the imaging process is followed by a fixing process using a fixing device, which permanently fixes the toner image in place on the recording medium by melting and settling the toner with heat and pressure.

Various types of fixing devices are known in the art, most of which employ a pair of generally cylindrical looped belts or rollers, one being heated for fusing toner ("fuser member") and the other being pressed against the heated one ("pressure member"), which together form a heated area of contact called a fixing nip through which a recording medium is passed to fix a toner image onto the medium under heat and pressure.

One such fixing device includes a roller-based fuser assembly that employs a fuser roller equipped with an internal heater to heat its circumference to a given process temperature. The fuser roller is paired with a pressure roller pressed against the outer circumference of the fuser roller to form a fixing nip therebetween, at which a toner image is fixed in place with heat from the fuser roller and pressure from the pressure roller.

Another type of fixing device includes a multi-roller, belt-based fuser assembly that employs an endless, flexible fuser belt entrained around multiple rollers, one of which is equipped with an internal heater to heat the length of the fuser belt through contact with the heated roller. The fuser belt is paired with a pressure roller pressed against the outer surface of the fuser belt to form a fixing nip therebetween, at which a toner image is fixed in place with heat from the fuser belt and pressure from the pressure roller.

One problem common to those types of fixing device is variations in a linear conveyance speed with which the recording medium is conveyed through the fixing nip along the circumference of the rotary fixing member. The problem arises where the fixing member is formed of thermally expansive material, such as a rubber-based fuser roller or the like, which contracts and expands as the fixing device operates under varying operating temperatures, resulting in variations in diameter, and hence circumference, of the rotating fixing member.

For example, in a belt-based fixing device employing a motor-driven fuser roller around which a fuser belt is entrained, the fuser roller has its diameter gradually increased as the rubber-based outer layer thermally expands due to heat from the fuser belt subjected to heating during operation. Where the fuser roller is driven with a constant rotational speed or frequency, variations in the roller diameter translate into variations in the conveyance speed with which a recording medium is conveyed along the circumference of the fuser roller. That is, an increase in the roller diameter yields a faster conveyance speed, whereas a decrease in the roller diameter yields a slower conveyance speed.

Although such problem is experienced by a roller-based fixing device as well, the difficulty is more pronounced in the belt-based design than in the roller-based design, since the former typically employs a thick rubber-covered fuser roller with no dedicated heater provided therein, which is susceptible to variations in temperature, and therefore is prone to thermally-induced variations in circumferential conveyance speed, particularly in applications for high-speed color printers.

In a media conveyance path, the fixing process is followed by a post-fixing process, such as an output unit for outputting a recording medium to a subsequent process, or a secondary fixing unit for processing a toner image subsequent to processing through the fixing nip. Such post-fixing mechanism typically has a regulated, substantially constant speed compared to that of a fixing device. This is particularly true of a secondary fixing device formed of a compact, thin rubber-covered roller assembly designed to impart gloss on a printed image after fixing, which is relatively immune to thermally-induced dimensional variations, and concomitant variations in circumferential conveyance speed.

Not surprisingly, where a post-fixing process conveys a recording medium with a constant conveyance speed, variations in conveyance speed in the fixing device result in a difference or inconsistency between the fixing and post-fixing media conveyance speeds. If not corrected, such speed differential (or variations therein) can affect imaging quality as well as media conveyance performance downstream from the fixing nip along the media conveyance path.

For example, where the fixing device processes a recording medium with a conveyance speed significantly slower than that of the post-fixing process, the recording medium, advanced faster at its downstream, leading edge than at its upstream, trailing edge, rubs or strikes against a paper stripper or a similar guide mechanism, thereby causing image defects during conveyance downstream from the fixing nip.

On the other hand, where the fixing device processes a recording medium with a conveyance speed significantly faster than that of the post-fixing process, the recording medium, advanced faster at its upstream, trailing edge than at its downstream, leading edge, slacks into a bow which then creates accordion-like folds to jam the media conveyance path downstream from the fixing nip.

To counteract the problem, various methods have been proposed to maintain the speed differential within a specified acceptable range, so as to convey a recording medium in an appropriately slack, unstrained state between the fixing and post-fixing processes along the media conveyance path.

For example, one such method proposes an image forming apparatus incorporating a belt-based fixing assembly, in which an endless fuser belt is entrained around a fuser roller and a heat roller internally heated with a lamp, while paired with a motor-driven pressure roller pressed against the fuser roller via the fuser belt to form a fixing nip therebetween.

According to this method, a speed controller is provided to control a rotational speed or frequency of a rotary motor driving the pressure roller. Such rotational speed control is performed according to readings of a thermistor detecting temperature of the fuser belt, so as to rotate the pressure roller at a constant circumferential speed irrespective of variations in operating temperature of the heat roller.

Another method proposes an image forming apparatus incorporating a fixing device disposed downstream from a transfer process that transfers a toner image onto a recording medium from another imaging surface.

According to this method, a slack detector is disposed between the transfer and fixing processes to detect slack of a recording medium being conveyed with its leading edge entering the fixing nip and its trailing edge still remaining in the transfer process. Readings of such slack detector are transmitted to a speed controller, which accordingly controls a rotational speed or frequency of a rotary motor driving a pressure roller, so as to control a media conveyance speed through the fixing nip depending on the amount of slack experienced by the incoming recording medium.

Further, the speed controller is equipped with a pair of first and second thermistors disposed at a circumference of the pressure roller, the former facing the fixing nip, the latter opposite the fixing nip. The speed controller adjusts the media conveyance speed according to readings of the first thermistor indicative of thermal expansion of an adjoining fixing member. Also, the speed controller determines an expected amount of expansion of the pressure roller according to readings of the second thermistor detecting temperature of the pressure roller.

SUMMARY OF THE INVENTION

Exemplary aspects of the present invention are put forward in view of the above-described circumstances, and provide a novel image forming apparatus.

In one exemplary embodiment, the novel image forming apparatus includes an imaging unit, a fixing unit, a first thermometer, and a controller. The imaging unit forms a toner image on a recording medium conveyed along a media conveyance path. The fixing device is disposed downstream from the imaging unit along the media conveyance path to fix the toner image in place on the recording medium. The fixing device includes a fuser roller, a heat roller, an endless, fuser belt, and a pressure roller. The fuser roller has a cylindrical core of metal, a circumference thereof formed of an elastic layer deposited on the cylindrical metal core. The heat roller is disposed parallel to the fuser roller, a circumference thereof subjected to heating. The fuser belt is looped for rotation around the fuser roller and the heat roller. The pressure roller is disposed opposite the fuser roller with the fuser belt interposed between the pressure roller and the fuser roller. The pressure roller presses against the fuser roller via the fuser belt to form a fixing nip therebetween, through which the recording medium is conveyed under heat and pressure as the fuser roller is driven to rotate with a given rotational speed. The first thermometer is disposed adjacent to the fuser roller to detect a first temperature at the cylindrical core of the fuser roller. The controller is operatively connected with the first thermometer to control conveyance of the recording medium through the fixing nip according to the first temperature detected upon entry of the recording medium in the media conveyance path.

Other exemplary aspects of the present invention are put forward in view of the above-described circumstances, and provide a novel fixing device.

In one exemplary embodiment, the novel image forming apparatus includes an imaging unit, a fixing unit, a first thermometer, a post-fixing unit, and adjustment means. The imaging unit forms a toner image on a recording medium conveyed along a media conveyance path. The fixing device is disposed downstream from the imaging unit along the media conveyance path to fix the toner image in place on the recording medium. The fixing device includes a fuser roller, a heat roller, an endless, fuser belt, and a pressure roller. The fuser roller has a cylindrical core of metal, a circumference thereof formed of an elastic layer deposited on the cylindrical metal core. The heat roller is disposed parallel to the fuser roller, a circumference thereof subjected to heating. The fuser belt is looped for rotation around the fuser roller and the heat roller. The pressure roller is disposed opposite the fuser roller with the fuser belt interposed between the pressure roller and the fuser roller. The pressure roller presses against the fuser roller via the fuser belt to form a fixing nip therebetween, through which the recording medium is conveyed with a first conveyance speed along the circumference of the fuser roller. The first thermometer is disposed adjacent to the fuser roller to detect a first temperature at the cylindrical core of the fuser roller. The post-fixing unit is disposed downstream from the fixing device along the media conveyance path to process the toner image after fixing on the recording medium. The post-fixing unit includes a pair of opposed conveyance rollers rotating together to convey the recording medium with a second conveyance speed therebetween. The adjustment means adjusts the first conveyance speed relative to the second conveyance speed according to the first temperature detected upon entry of the recording medium in the media conveyance path.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
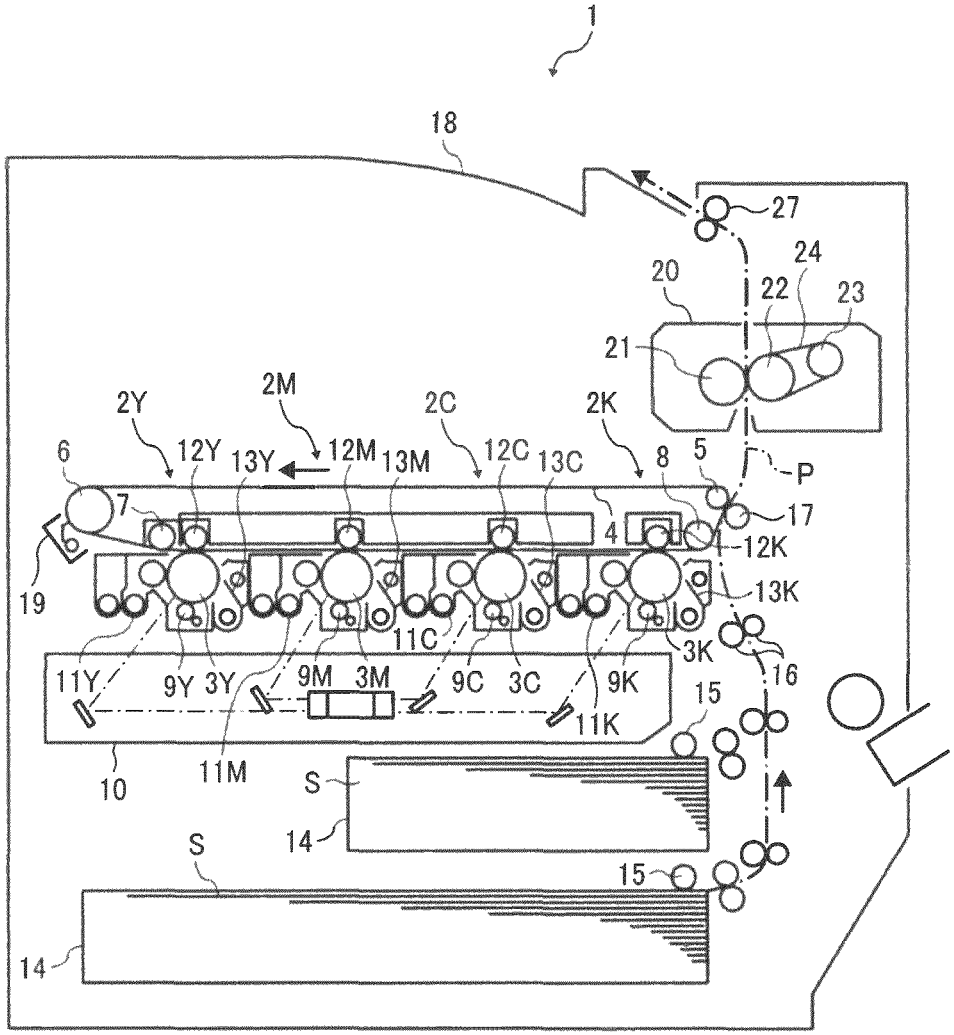
FIG. 1 schematically illustrates an image forming apparatus incorporating a fixing device according to this patent specification.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

FIG. 1 schematically illustrates an image forming apparatus 1 according to this patent specification As shown in FIG. 1, the image forming apparatus 1 includes an electrophotographic imaging unit 2 and a fixing device 20.

In the image forming apparatus 1, the imaging unit 2 consists of four imaging stations 2Y, 2M, 2C, and 2K arranged in series substantially laterally along the length of an intermediate transfer belt 4, each forming an image with toner particles of a particular primary color, as designated by the suffixes "Y" for yellow, "M" for magenta, "C" for cyan, and "K" for black.

Each imaging station 2 includes a drum-shaped photoconductor 3 rotatable counterclockwise in the drawing, surrounded by various pieces of imaging equipment, such as a charging roller 9, a writing device or laser scanner 10, a development device 11 accommodating toner of the associated primary color, an electrically biased, primary transfer roller 12, a cleaning device 13 for the photoconductive surface, etc., which work in cooperation to form a primary toner image on the photoconductor 3 for subsequent transfer to the intermediate transfer belt 4 at a primary transfer nip defined between the photoconductive drum 3 and the primary transfer roller 12.

The intermediate transfer belt 4 is trained around multiple support rollers 5, 6, 7, and 8 to rotate clockwise in the drawing, passing through the four primary transfer nips sequentially to carry thereon a multi-color toner image toward a secondary transfer nip defined between a secondary transfer roller 17 and the support roller 5, with a belt cleaner 19 cleaning the belt surface upstream of the primary transfer nips.

The fixing device 20 includes a fuser roller 22, a heat roller 23, an endless fuser belt 24 trained around the rollers 22 and 23, and a pressure roller 21 pressed against the fuser belt 24 to form a fixing nip therebetween. These fixing rollers 21, 22, and 23 are elongated rotatable members extending in a direction perpendicular to the sheet of paper on which the FIG. is drawn, each held on a frame of the apparatus body together with other pieces of fixing equipment, such as rotary driver and heat source. A detailed description of the fixing device 20 and its associated structure will be given later with reference to FIG. 2 and subsequent drawings.

Below and adjoining the electrophotographic imaging unit 2 and the fixing device 20 is a sheet conveyance mechanism including one or more input sheet trays 14 each accommodating a stock of recording media such as paper sheets S and equipped with a feed roller 15. The sheet conveyance mechanism also includes a pair of registration rollers 16, an output unit formed of a pair of output rollers 27, an output sheet tray 18, and other guide rollers or plates disposed between the input and output trays 14 and 18, which together define a sheet conveyance path P for conveying a recording sheet S from the input tray 14, between the registration rollers 16, then through the secondary transfer nip, then through the fixing device 20, and then between the output rollers 27 to the output tray 18.

During operation, the image forming apparatus 1 can perform printing in various print modes, including a monochrome print mode and a full-color print mode, as specified by a print job received from a user.

In full-color printing, each imaging station 2 rotates the photoconductor drum 3 clockwise in the drawing to forward its outer, photoconductive surface to a series of electrophotographic processes, including charging, exposure, development, transfer, and cleaning, in one rotation of the photoconductor drum 3.

First, the photoconductive surface is uniformly charged by the charging roller 9 and subsequently exposed to a modulated laser beam emitted from the writing unit 10. The laser exposure selectively dissipates the charge on the photoconductive surface to form an electrostatic latent image thereon according to image data representing a particular primary color. Then, the latent image enters the development device 11 which renders the incoming image visible using toner. The toner image thus obtained is forwarded to the primary transfer nip at which the incoming image is transferred to the intermediate transfer belt 4 with an electrical bias applied to the primary transfer roller 12.

As the multiple imaging stations 2 sequentially produce toner images of different colors at the four transfer nips along the belt travel path, the primary toner images are superimposed one atop another to form a single multicolor image on the moving surface of the intermediate transfer belt 4 for subsequent entry to the secondary transfer nip between the secondary transfer roller 17 and the belt support roller 5.

Meanwhile, the sheet conveyance mechanism picks up a recording sheet S from atop the sheet stack in the sheet tray 14 to introduce it between the pair of registration rollers 16 being rotated. Upon receiving the incoming sheet S, the registration rollers 16 stop rotation to hold the sheet S therebetween, and then advance it in sync with the movement of the intermediate transfer belt 4 to the secondary transfer nip at which the multicolor image is transferred from the belt 4 to the recording sheet S with an electrical bias applied to the secondary transfer roller.

After secondary transfer, the intermediate transfer belt 4 is cleaned of residual toner by the belt cleaner 14 whereas the recording sheet S is introduced into the fixing device 20 to fix the toner image in place under heat and pressure. Thereafter, the recording sheet S is output to the output tray 18 for stacking outside the apparatus body, as the output rollers 27 rotate to advance the recording sheet S downstream from the fixing device 20 along the sheet conveyance path.

Figure 2:
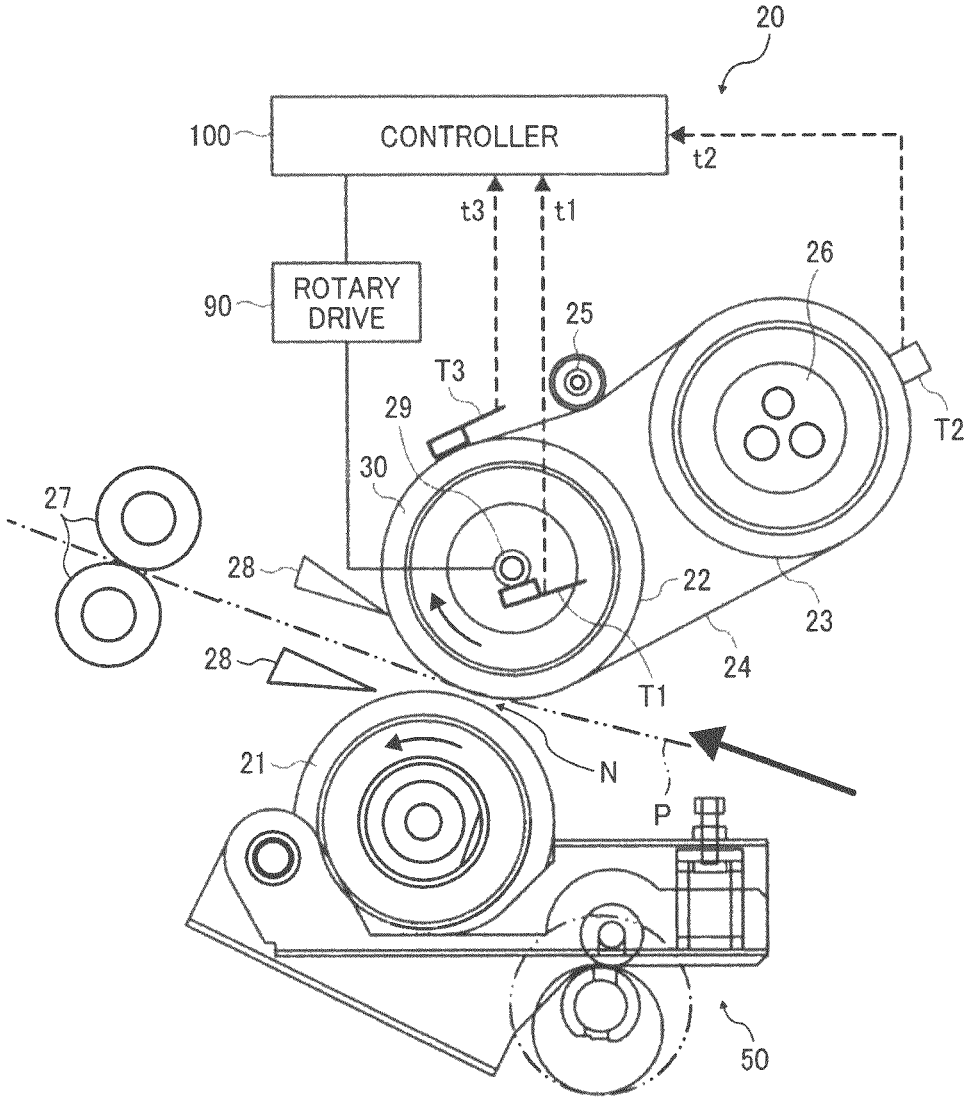
FIG. 2 is an end-on, axial cutaway view schematically illustrating the fixing device according to one or more embodiments of this patent specification.

FIG. 2 is an end-on, axial cutaway view schematically illustrating the fixing device 20 according to one or more embodiments of this patent specification.

As shown in FIG. 2, the fixing device 20 includes a fuser roller 22 having a rigid, cylindrical core 29 of metal, a circumference thereof formed of a thick elastic layer 30 deposited on the cylindrical metal core 29; a heat roller 23 disposed parallel to the fuser roller, a circumference thereof heated by an internal heater 26; an endless, fuser belt 24 looped for rotation around the fuser roller 22 and the heat roller 23; and a pressure roller 21 disposed opposite the fuser roller 22 with the fuser belt 24 interposed between the pressure roller 21 and the fuser roller 22.

Also included in the fixing device 20 are a tension roller 25 elastically biased against the fuser belt 24; a pair of sheet strippers 28 held against the opposed fixing rollers 21 and 22, respectively; and an adjustable biasing mechanism 50 pressing the pressure roller 21 against the fuser roller 22 via the fuser belt 24 to form a fixing nip N therebetween.

In the present embodiment, the fuser belt 24 comprises a rotatable endless belt formed of a substrate of heat-resistant material or film such as polyimide (PI), upon which may be provided an outer, protective coating of release agent such as tetra fluoro ethylene-perfluoro alkylvinyl ether copolymer or perfluoroalkoxy (PFA) to prevent offset or undesirable transfer of toner to the outer surface of the belt 24. For example, the fuser belt 24 may be an endless PI belt approximately 90 micrometers (μm) thick coated with a PFA protective layer deposited thereupon.

The fuser belt 24 is entrained around the fuser roller 22 and the heat roller 23, with the tension roller 25 tightening the belt 24 to hold it in close contact with the circumferential surfaces of the rollers 22 and 23.

The fuser roller 22 comprises a rubber-covered, motor-driven rotatable cylindrical body, having the cylindrical core 29 formed of rigid material, such as iron, aluminum, or other suitable metal, and the outer elastic layer 30 formed of silicone rubber or the like.

The heat roller 23 comprises a hollow cylindrical body accommodating the internal heater 26 in its hollow interior. The heater 26 may be a halogen heater, an infrared heater, or any suitable electrical resistance heater.

The pressure roller 21 comprises a rubber-covered, hollow cylindrical body, optionally provided with a dedicated internal heater accommodated in its hollow interior.

The tension roller 25 comprises an elastically coated cylindrical body, consisting of a hollow cylindrical core of rigid material such as aluminum or other suitable metal, coated with an outer layer of elastic material, such as heat-resistant felt or silicone rubber, deposited thereupon. The tension roller 25 is located substantially equidistant from the two belt supporting rollers 22 and 23, loaded against the fuser belt 24 with a spring or other suitable biasing mechanism. Although the present embodiment describes the tension roller 25 facing the outer circumference of the fuser belt 24, alternatively, instead, the tension roller 25 may be disposed on the inner circumference of the fuser belt 24.

With continued reference to FIG. 2, the fixing device 20 is shown including first through third thermometers or thermistors T1 through T3 disposed at different portions of the fuser assembly, as well as a controller 100 that includes a rotary motor drive 90 of the fuser roller 22 while operatively connected with each of the multiple thermistors T1 through T3.

Specifically, the controller 100 in the present embodiment is incorporated in a control system of the image forming apparatus 1, including a central processing unit (CPU) that controls overall operation of the apparatus 1, as well as its associated memory devices, such as a read-only memory (ROM) storing program codes for execution by the CPU and other types of fixed data, a random-access memory (RAM) for temporarily storing data, and a rewritable, non-volatile random-access memory (NVRAM) for storing data during power-off.

The rotary drive 90 comprises a motor connected to the fuser roller 22 via a reduction gear train. The rotary drive 90 drives the fuser roller 22 to rotate in coordination with other parts of the fixing assembly according to a control signal transmitted from the controller 100.

The first thermistor T1 is disposed adjacent to the fuser roller 22 to detect a first temperature t1 at the cylindrical core 29 of the fuser roller 22 for communication to the controller 100. The second thermistor T2 is disposed on the fuser belt 24 where it contacts the heat roller 23 to detect a second temperature t2 at the circumference of the heat roller 23 for communication to the controller 100. The third thermistor T3 is disposed on the fuser belt 24 where it contacts the fuser roller 22 to detect a third temperature t3 at the circumference of the fuser roller 22 for communication to the controller 100.

Of the three thermometers employed in the fixing device 20, the second thermistor T2 may be configured as a primary thermometer whose readings are used by the controller 100 to control a processing temperature with which the fixing device 20 processes a toner image through the fixing nip N.

During operation, the motor-driven fuser roller 22 rotates in a given rotational direction (i.e., clockwise in the drawing) as the rotary drive 90 imparts torque or rotational force to the roller core 29 with a given rotational speed or frequency F via the gear train, so as to rotate the fuser belt 24 with a linear, first conveyance speed V1 along its circumference, which in turn rotates the pressure roller 21 in a given rotational direction (i.e., counterclockwise in the drawing) with the same circumferential speed as that of the fuser roller 22.

The fuser belt 24 during rotation is kept in proper tension with the tension roller 15 pressing against the belt 24 from inside of the belt loop, while having its circumference heated with the heat roller 23 to a given processing temperature sufficient for fusing toner through the fixing nip N.

In this state, a recording sheet S bearing an unfixed, powder toner image T enters the fixing device 20 along a sheet guide defining the sheet conveyance path P. As the rotary fixing members rotate together, the recording sheet S is passed through the fixing nip N to fix the toner image in place, wherein heat from the fuser belt 24 causes toner particles to fuse and melt, while pressure from the pressure roller 21 causes the molten toner to settle onto the sheet surface.

At the exit of the fixing nip N, the recording sheet S has its leading edge stripped from the rotary members by the associated sheet strippers 28, which then proceeds to the output roller pair 27 forwarding the incoming sheet S with a linear, second conveyance speed V2, and finally enters the output tray 18 from the sheet conveyance path P.

In such a configuration, the conveyance speed V1 along the circumference of the fuser roller 22 is influenced by variations in operating temperature which cause the elastic material of the fuser roller 22 to thermally expand and contract, resulting in dimensional variations in the fixing nip N. On the other hand, the conveyance speed V2 along the circumference of the output roller pair 27, typically formed of thin rubber-covered roller pairs, is substantially immune to variations in operating temperature.

Where the second conveyance speed V2 along the output roller pair 27 remains substantially constant, variations in the conveyance speed V1 translate into variations in a difference V1−V2 between the first and second conveyance speeds V1 and V2. If not corrected, such variations in the speed differential V1−V2 can affect imaging quality as well as sheet conveyance performance downstream from the fixing nip N along the sheet conveyance path P.

Figure 3:
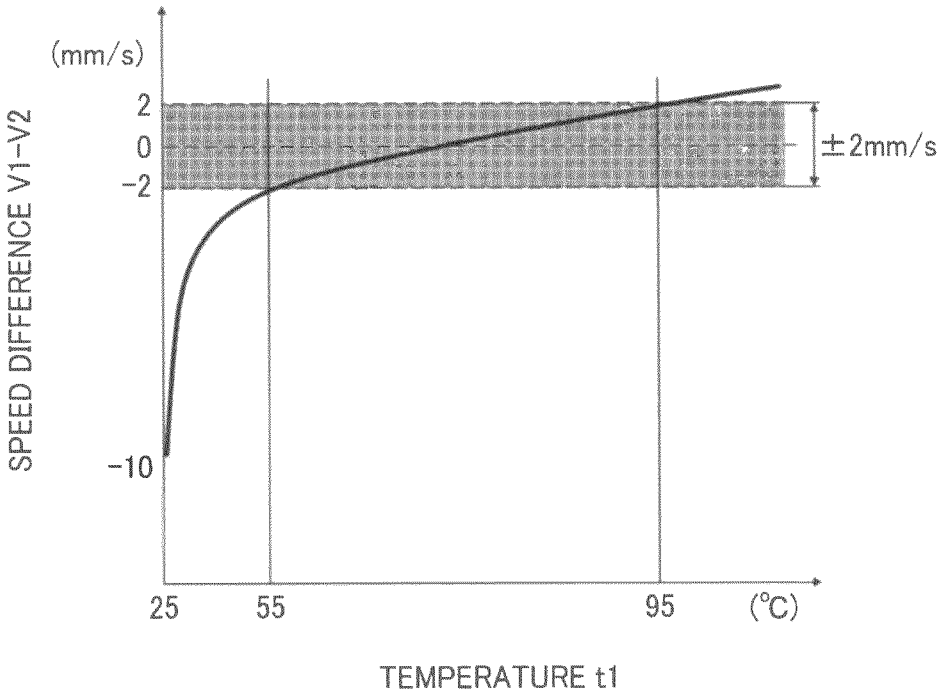
FIG. 3 is a graph showing a speed differential between fixing and output rollers plotted against a first temperature experimentally measured in the fixing device of FIG. 2.

FIG. 3 is a graph showing the speed differential V1−V2 in millimeters per second (mm/s) between the fixing and output rollers 22 and 27, plotted against the first temperature t1 in degrees Celsius (° C.) detected at the metal core 29 of the fuser roller 22 driven with a fixed rotational speed.

As shown in FIG. 3, where the roller temperature t1 remains low, the first conveyance speed V1 is significantly lower than the second conveyance speed V2 so that the speed differential V1−V2 is relatively large in absolute value, for example, reaching approximately −10 mm/s at a roller temperature t1 of approximately 25° C. As the roller temperature t1 increases, causing the fuser roller 22 to thermally expand, the speed differential V1−V2 reduces toward a desired point of 0 mm/s. The speed differential V1−V2 remains within an acceptable range from −2 mm/s to 2 mm/s (indicated by shading in the graph) as long as the roller temperature t1 equals or exceeds a lower limit of approximately 55° C. and falls below an upper limit of approximately 95° C.

In general, a failure to keep the speed differential within a specified acceptable range (e.g., ±2 mm/s in the present embodiment) can cause various adverse effects on imaging and sheet conveyance performance of the image forming apparatus.

For example, a negative speed differential V1−V2 of approximately −2 mm/s or below, indicating that the fixing roller pair processes a recording sheet with a conveyance speed significantly slower than that of the output roller pair, can adversely affect imaging quality, in which the recording sheet, advanced faster at its downstream, leading edge than at its upstream, trailing edge, rubs or strikes against a sheet stripper or a similar guide mechanism, thereby causing image defects during conveyance from the fixing nip N to the output unit.

On the other hand, a positive speed differential V1−V2 of approximately 2 mm/s or larger, indicating that the fixing roller pair processes a recording sheet with a conveyance speed significantly faster than that of the output roller pair, can adversely affect conveyance of a recording sheet, in which the recording sheet, advanced faster at its upstream, trailing edge than at its downstream, leading edge, slacks into a bow which then creates accordion-like folds to jam the sheet conveyance path from the fixing nip N to the output unit.

According to this patent specification, the image forming apparatus 1 controls conveyance of the recording sheet S through the fixing nip N by adjusting the rotational speed or frequency F (i.e., the number of revolutions per unit of time) of the fuser roller 22 depending on the operating temperature detected upon entry of a recording sheet S in the sheet conveyance path P (i.e., entering the fixing device 20 or reaching a predetermined point along the sheet conveyance path P), so as to maintain a difference V1−V2 between the first and second conveyance speeds V1 and V2 within a specified acceptable range, thereby preventing adverse effects caused by variations in the speed differential V1−V2 along the sheet conveyance path P.

Specifically, in a first embodiment, the controller 100 adjusts the rotational speed F of the fuser rotary drive 90 according to the first temperature t1 detected by the first thermistor T1 upon entry of a recording sheet S in the sheet conveyance path P, so as to correct and maintain the circumferential speed V1 of the fuser roller 22 at a substantially constant speed regardless of the diameter of the fuser roller 22 varying with temperature.

Such rotational speed adjustment may be performed, for example, by correcting an original, reference rotational speed Fref of the rotary drive 90 with a variable amount of correction α dependent on the first temperature t1 detected. The correction variable α for the rotational speed adjustment may be defined as a variable rate or percentage by which the rotational frequency F is calculated from the original value Fref, as follows:

$$F=F\text{ref}*(1+\alpha/100)$$

In the present embodiment, the controller 100 includes a predefined table or list of correction variables α for rotational speed adjustment, stored in an appropriate memory such as ROM or the like, which contains ranges of first temperature t1 each associated with a specific correction variable α. An example of such speed correction table is provided in TABLE 1 below.

TABLE 1

| TEMPERATURE DETECTED | CORRECTION VARIABLE α |
|---|---|
| t1 < 55° C. | 1% |
| t1 ≥ 55° C. | 0 |

According to the speed correction table, the rotational speed F is increased from the reference value Fref by a correction rate of 1% where the first temperature t1 detected falls below a reference temperature of 55° C., and is maintained at the original speed Fref where the first temperature t1 detected equals or exceeds the reference temperature.

Figure 4:
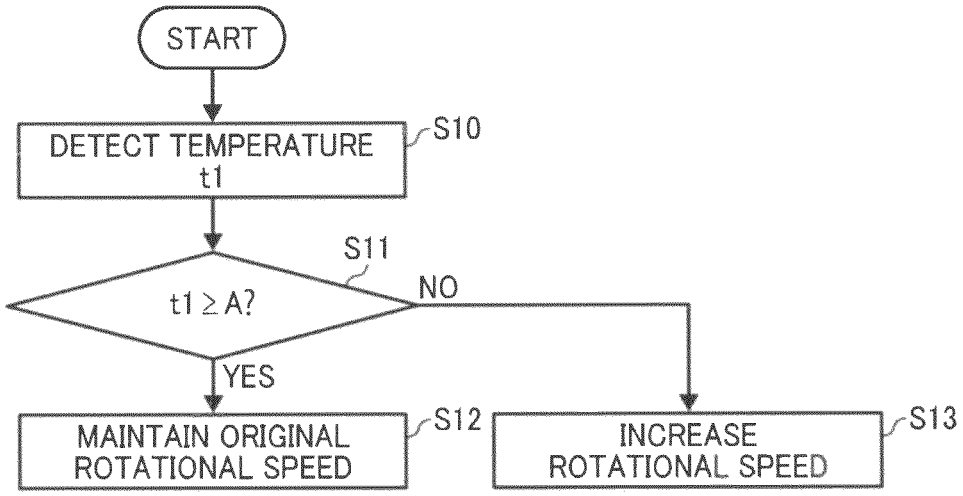
FIG. 4 is a flowchart illustrating an example of rotational speed adjustment performed by the image forming apparatus according to a first embodiment of this patent specification.

FIG. 4 is a flowchart illustrating an example of rotational speed adjustment performed by the image forming apparatus 1 based on the correction table represented in TABLE 1.

As shown in FIG. 4, initially, the first thermistor T1 detects a first temperature t1 at the metal core 29 of the fuser roller 22 upon entry of a recording sheet S in the sheet conveyance path P (step S10).

Then, the controller 100 determines whether the detected temperature t1 exceeds a reference temperature A of, for example, 55° C. (step S11).

Where the detected temperature t1 equals or exceeds the reference temperature A, indicating that the speed differential V1−V2 falls within the acceptable range ("YES" at step S11), the controller 100 sets the correction rate α to 0 so as to maintain the rotational speed F at the original, reference value Fref (step S12).

Where the detected temperature t1 falls below the reference temperature A, indicating that the speed differential V1−V2 exceeds the acceptable range ("NO" at step S11), the controller 100 sets the correction rate α to a given positive value, so as to increase the rotational speed F from the original, reference value Fref (step S13).

With the rotational speed F thus increased where the first temperature t1 falls below the reference temperature A, the resulting circumferential speed V1 of the fuser roller 22 remains substantially constant relative to the fixed circumferential speed V2 of the output roller pair 27, so that the speed differential V1−V2 remains within a desired, appropriate range.

Hence, the image forming apparatus 1 according to the first embodiment of this patent specification can maintain the differential speed V1−V2 along the sheet conveyance path P within a sufficiently narrow, acceptable range so as to ensure good imaging quality as well as proper sheet conveyance performance along the sheet conveyance path P, in which the controller 100 adjusts the rotational speed F of the fuser rotary drive 90 depending on the temperature t1 detected at the cylindrical core 29 of the fuser roller 22 (e.g., increases the rotational speed F upon detecting a relatively low first temperature t1 indicating that the fuser roller 22 contracts in diameter to yield a relatively slow circumferential speed), so that the fuser roller 22 can rotate with a substantially constant circumferential speed V1 regardless of variations in the operating temperature causing thermal expansion or contraction of the elastic material, even where the fuser roller is configured as a thick rubber-coated, metal-cored cylindrical body with no dedicated heater provided therein.

In further embodiment, the image forming apparatus 1 may perform rotational speed adjustment based not only on the first temperature t1 but also on the second and third temperatures t2 and t3, or on any combination of such detected temperatures. Compared to adjustment based only on the first temperature t1, which tends to change rapidly relative to the speed differential V1−V2, using a combination of multiple temperatures allows the controller 100 to more accurately determine the operating condition, so as to more properly correct the rotational speed of the rotary drive 90 according to thermal expansion or contraction experienced by the fuser roller 22. Several such embodiments are described below with reference to FIG. 5 and subsequent drawings.

Figure 5:
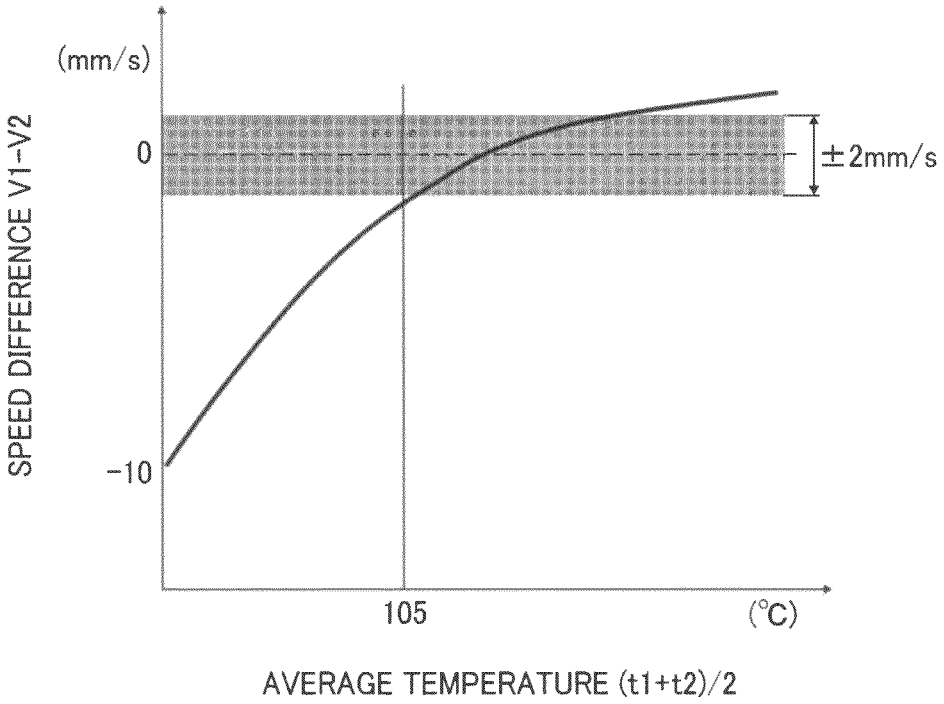
FIG. 5 is a graph showing the speed differential between fixing and output rollers plotted against an average of first and second temperatures experimentally measured in the fixing device of FIG. 2.

FIG. 5 is a graph showing a speed differential V1−V2 in millimeters per second (mm/s) between the fixing and output rollers 22 and 27, plotted against an average of the first and second temperatures t1 and t2 in degrees Celsius (° C.), the former detected at the metal core 29 of the fuser roller 22 driven with a fixed rotational speed, and the latter on the fuser belt 24 along the circumference of the heat roller 23.

As shown in FIG. 5, where the average temperature (t1+t2)/2 remains low, the first conveyance speed V1 is significantly lower than the second conveyance speed V2 so that the speed differential V1−V2 is relatively large in absolute value. As the average temperature (t1+t2)/2 increases, causing the fuser roller 22 to thermally expand, the speed differential V1−V2 reduces toward a desired point of 0 mm/s. The speed differential V1−V2 reaches an acceptable range from −2 mm/s to 2 mm/s (indicated by shading in the graph) where the average temperature (t1+t2)/2 equals or exceeds a lower limit of approximately 105° C.

In a second embodiment, the controller 100 adjusts the rotational speed F of the fuser rotary drive 90 according to the average of the first and second temperatures t1 and t2 detected by the first and second thermistors T1 and T2, respectively, upon entry of a recording sheet S in the sheet conveyance path P, so as to correct and maintain the circumferential speed V1 of the fuser roller 22 at a substantially constant speed regardless of the diameter of the fuser roller 22 varying with temperature.

As is the case with the first embodiment depicted earlier, such rotational speed adjustment may be performed, for example, by correcting an original, reference rotational speed Fref of the rotary drive 90 with a correction variable α dependent on the average of the first and second temperatures t1 and t2 detected.

In the present embodiment, the controller 100 includes a predefined table or list of correction variables α for rotational speed adjustment, stored in an appropriate memory such as ROM or the like, which contains ranges of average temperature (t1+t2)/2 each associated with a specific correction variable α. An example of such speed correction table is provided in TABLE 2 below.

TABLE 2

| TEMPERATURE DETECTED | CORRECTION VARIABLE α |
|---|---|
| (t1 + t2)/2 < 105° C. | 1% |
| (t1 + t2)/2 ≥ 105° C. | 0 |

According to the speed correction table, the rotational speed F is increased from the reference value Fref by a correction rate of 1% where the average temperature (t1+t2)/2 detected falls below a reference temperature of 105° C., and is maintained at the original speed Fref where the average temperature (t1+t2)/2 detected equals or exceeds the reference temperature.

Figure 6:
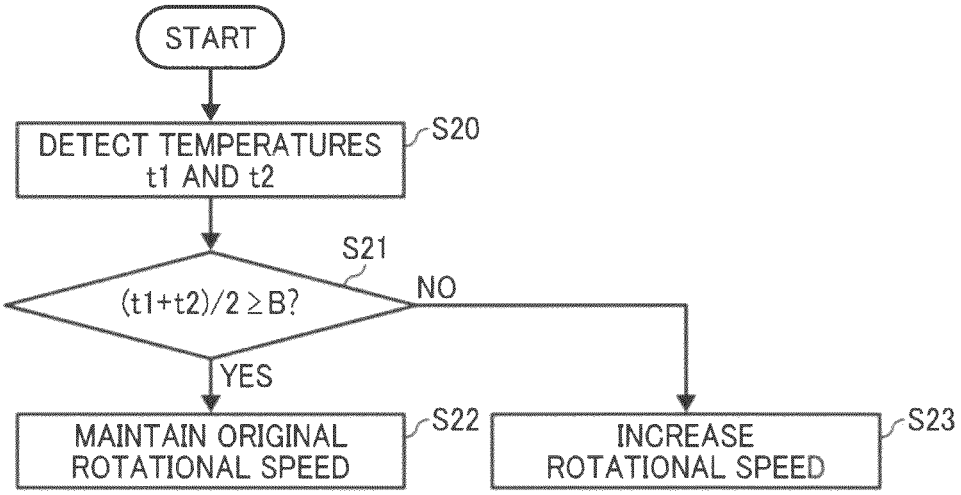
FIG. 6 is a flowchart illustrating an example of rotational speed adjustment performed by the image forming apparatus according to a second embodiment of this patent specification.

FIG. 6 is a flowchart illustrating an example of rotational speed adjustment performed by the image forming apparatus 1 based on the correction table represented in TABLE 2.

As shown in FIG. 6, initially, the first and second thermistors T1 and T2 detect first and second temperatures t1 and t2, respectively, the former at the metal core 29 of the fuser roller 22, and the latter on the fuser belt 24 along the circumference of the heat roller 23, upon entry of a recording sheet S in the sheet conveyance path P (step S20).

Then, the controller 100 determines whether the average of the detected temperatures (t1+t2)/2 exceeds a reference temperature B of, for example, 105° C. (step S21).

Where the detected average temperature (t1+t2)/2 equals or exceeds the reference temperature B, indicating that the speed differential V1−V2 falls within the acceptable range ("YES" at step S21), the controller 100 sets the correction rate α to 0 so as to maintain the rotational speed F at the original, reference value Fref (step S22).

Where the detected average temperature (t1+t2)/2 falls below the reference temperature B, indicating that the speed differential V1−V2 exceeds the acceptable range ("NO" at step S21), the controller 100 sets the correction rate α to a given positive value, so as to increase the rotational speed F from the original, reference value Fref (step S23).

With the rotational speed F thus increased where the average of the first and second temperatures t1 and t2 falls below the reference temperature B, the resulting circumferential speed V1 of the fuser roller 22 remains substantially constant relative to the fixed circumferential speed V2 of the output roller pair 27, so that the speed differential V1−V2 remains within a desired, appropriate range.

Hence, the image forming apparatus 1 according to the second embodiment of this patent specification can maintain the differential speed V1−V2 along the sheet conveyance path P within a sufficiently narrow, acceptable range so as to ensure good imaging quality as well as proper sheet conveyance performance along the sheet conveyance path P, in which the controller 100 adjusts the rotational speed F of the fuser rotary drive 90 depending on the temperature t1 detected at the cylindrical core 29 of the fuser roller 22 as well as the temperature t2 detected on the fuser belt 24 along the circumference of the heat roller 23, so that the fuser roller 22 can rotate with a substantially constant circumferential speed V1 regardless of variations in the operating temperature causing thermal expansion or contraction of the elastic material.

Compared to the first embodiment, such rotational speed adjustment can more accurately estimate variations in the conveyance speed due to dimensional variations of the thermally expansive, elastic roller 22, wherein the average of the first and second temperatures t1 and t2 more precisely indicates an operating temperature of the outer elastic layer than the first temperature t1 alone, since the temperature t2 detected at the circumference of the heat roller 23 is substantially consistent with that detected at the circumference of the fuser roller 22 during operation.

Figure 7:
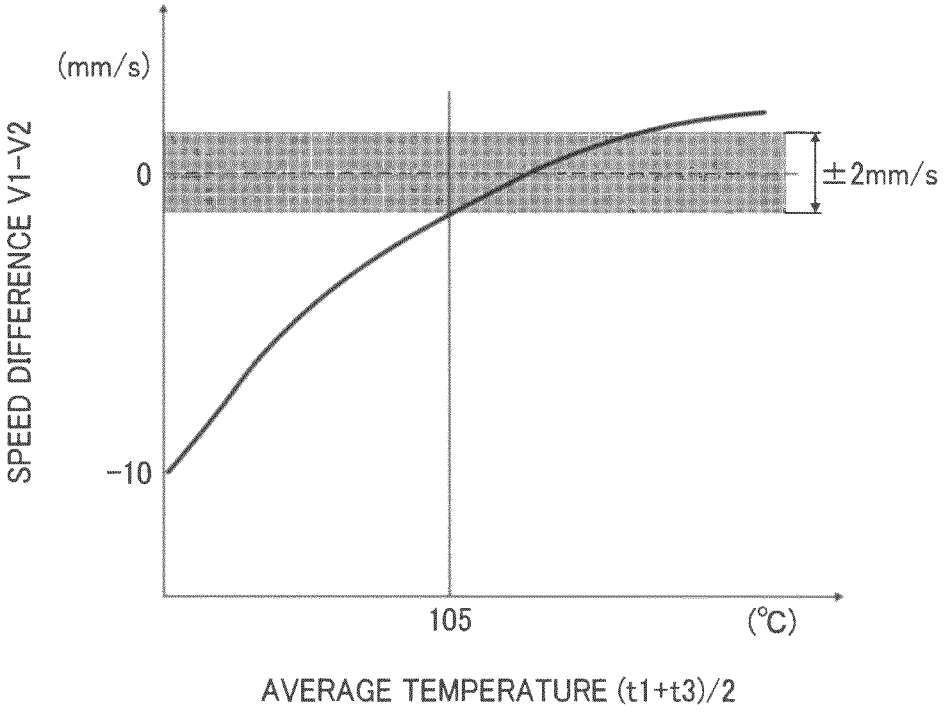
FIG. 7 is a graph showing a speed differential between fixing and output rollers plotted against an average of first and third temperatures experimentally measured in the fixing device of FIG. 2.

FIG. 7 is a graph showing the speed differential V1−V2 between the fixing and output rollers 22 and 27 in millimeters per second (mm/s), plotted against an average of the first and third temperatures t1 and t3 in degrees Celsius (° C.), the former detected at the metal core 29 of the fuser roller 22 driven with a fixed rotational speed, and the latter on the fuser belt 24 along the circumference of the fuser roller 22.

As shown in FIG. 7, where the average temperature (t1+t3)/2 remains low, the first conveyance speed V1 is significantly lower than the second conveyance speed V2 so that the speed differential V1−V2 is relatively large in absolute value. As the average temperature (t1+t3)/2 increases, causing the fuser roller 22 to thermally expand, the speed differential V1−V2 reduces toward a desired point of 0 mm/s. The speed differential V1−V2 reaches an acceptable range from −2 mm/s to 2 mm/s (indicated by shading in the graph) where the average temperature (t1+t3)/2 equals or exceeds a lower limit of approximately 105° C.

In a third embodiment, the controller 100 adjusts the rotational speed F of the fuser rotary drive 90 according to the average of the first and third temperatures t1 and t3 detected by the first and third thermistors T1 and T3, respectively, upon entry of a recording sheet S in the sheet conveyance path P, so as to correct and maintain the circumferential speed V1 of the fuser roller 22 at a substantially constant speed regardless of the diameter of the fuser roller 22 varying with temperature.

As is the case with the first embodiment depicted earlier, such rotational speed adjustment may be performed, for example, by correcting an original, reference rotational speed Fref of the rotary drive 90 with a correction variable α dependent on the average of the first and third temperatures t1 and t3 detected.

In the present embodiment, the controller 100 includes a predefined table or list of correction variables α for rotational speed adjustment, stored in an appropriate memory such as ROM or the like, which contains ranges of average temperature (t1+t3)/2 each associated with a specific correction variable α. An example of such speed correction table is provided in TABLE 3 below.

TABLE 3

| TEMPERATURE DETECTED | CORRECTION VARIABLE α |
|---|---|
| (t1 + t3)/2 < 105° C. | 1% |
| (t1 + t3)/2 ≥ 105° C. | 0 |

According to the speed correction table, the rotational speed F is increased from the reference value Fref by a correction rate of 1% where the average temperature (t1+t3)/2 detected falls below a reference temperature of 105° C., and is maintained at the original speed Fref where the average temperature (t1+t3)/2 detected equals or exceeds the reference temperature.

Figure 8:
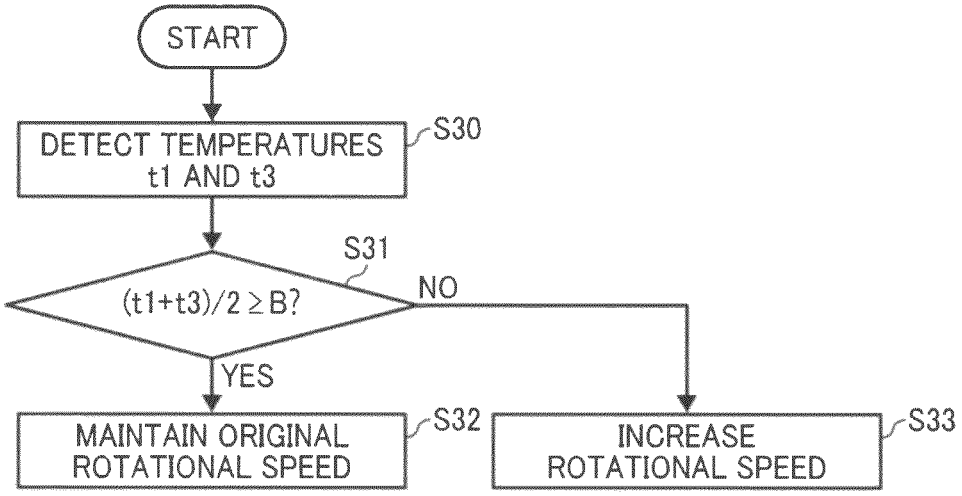
FIG. 8 is a flowchart illustrating an example of rotational speed adjustment performed by the image forming apparatus according to a third embodiment of this patent specification.

FIG. 8 is a flowchart illustrating an example of rotational speed adjustment performed by the image forming apparatus 1 based on the correction table represented in TABLE 3.

As shown in FIG. 8, initially, the first and third thermistors T1 and T3 detect first and second temperatures t1 and t3, respectively, the former at the metal core 29 of the fuser roller 22, and the latter on the fuser belt 24 along the circumference of the fuser roller 22, upon entry of a recording sheet S in the sheet conveyance path P (step S30).

Then, the controller 100 determines whether the average of the detected temperatures (t1+t3)/2 exceeds a reference temperature B of, for example, 105° C. (step S31).

Where the detected average temperature (t1+t3)/2 equals or exceeds the reference temperature B, indicating that the speed differential V1−V2 falls within the acceptable range ("YES" at step S31), the controller 100 sets the correction rate α to 0 so as to maintain the rotational speed F at the original, reference value Fref (step S32).

Where the detected average temperature (t1+t3)/2 falls below the reference temperature B, indicating that the speed differential V1−V2 exceeds the acceptable range ("NO" at step S31), the controller 100 sets the correction rate α to a given positive value, so as to increase the rotational speed F from the original, reference value Fref (step S33).

With the rotational speed F thus increased where the average of the first and third temperatures t1 and t3 falls below the reference temperature B, the resulting circumferential speed V1 of the fuser roller 22 remains substantially constant relative to the fixed circumferential speed V2 of the output roller pair 27, so that the speed differential V1−V2 remains within a desired, appropriate range.

Hence, the image forming apparatus 1 according to the third embodiment of this patent specification can maintain the differential speed V1−V2 along the sheet conveyance path P within a sufficiently narrow, acceptable range so as to ensure good imaging quality as well as proper sheet conveyance performance along the sheet conveyance path P, in which the controller 100 adjusts the rotational speed F of the fuser rotary drive 90 depending on the temperature t1 detected at the cylindrical core 29 of the fuser roller 22 as well as the temperature t3 detected on the fuser belt 24 along the circumference of the fuser roller 22, so that the fuser roller 22 can rotate with a substantially constant circumferential speed V1 regardless of variations in the operating temperature causing thermal expansion or contraction of the elastic material.

Compared to the first embodiment, such rotational speed adjustment can more accurately estimate variations in the conveyance speed due to dimensional variations of the thermally expansive, elastic roller 22, wherein the temperature t3 detected at the circumference of the fuser roller 22 more precisely indicates an operating temperature of the outer elastic layer than the temperature t1 detected at the metal core 29 of the fuser roller 22, particularly upon standby during which the heat roller 23 stops supply of heat, causing a sudden reduction in temperature at the circumference of the fuser roller 22.

Although in several embodiments depicted above the controller 100 controls sheet conveyance speed by increasing the rotational speed F from the original, reference value Fref where the detected temperature equals or exceeds a relatively low reference temperature indicative of a reduction in the first conveyance speed V1, such rotational speed adjustment may also be performed by decreasing the rotational speed F from the original, reference value Fref where the detected temperature equals or exceeds a relatively high reference temperature indicative of an increase in the first conveyance speed V1.

As mentioned above with reference to FIG. 3, the speed differential V1−V2 reaches the acceptable range of ±2 mm/s as the roller temperature t1 equals or exceeds a lower limit of approximately 55° C. As the roller temperature t1 rises, causing further thermal expansion of the fuser roller 22 and concomitant increase in the circumferential speed V1, the speed differential V1−V2 reaches the desired point of 0 mm/s, and again exceeds the acceptable range where the roller temperature t1 exceeds an upper limit of approximately 95° C.

In a fourth embodiment, the controller 100 adjusts the rotational speed F of the fuser rotary drive 90 from an original, reference rotational speed Fref with a variable amount of correction α dependent on the first temperature t1 as well as the third temperature t3. Unlike the foregoing embodiments, the controller 100 decreases, instead of increasing, the rotational speed F from the original rotational speed Fref where the detected temperature equals or exceeds a given reference temperature.

In the present embodiment, the controller 100 includes a predefined table or list of correction variables α for rotational speed adjustment, stored in an appropriate memory such as ROM or the like, which contains ranges of the first temperature t1 as well as the average of the first and third temperatures (t1+t3)/2 each associated with a specific correction variable α. An example of such speed correction table is provided in TABLE 4 below.

TABLE 4

| TEMPERATURE DETECTED | CORRECTION VARIABLE α |
|---|---|
| t1 < 95° C. | 0 |
| t1 ≥ 95° C. | −1% |
| (t1 + t3)/2 < 105° C. | 1% |
| (t1 + t3)/2 ≥ 105° C. | 0 |

According to the speed correction table, the rotational speed F is decreased from the reference value Fref by a correction rate of −1% where the first temperature t1 equals or exceeds a first reference temperature of 95° C., and is increased from the reference value Fref by a correction rate of 1% where the average temperature (t1+t3)/2 falls below a second reference temperature of 105° C. The rotational speed F is maintained at the original speed Fref where the first temperature t1 detected falls below the first reference temperature, or where the average temperature (t1+t3)/2 equals or exceeds the second reference temperature.

Figure 9:
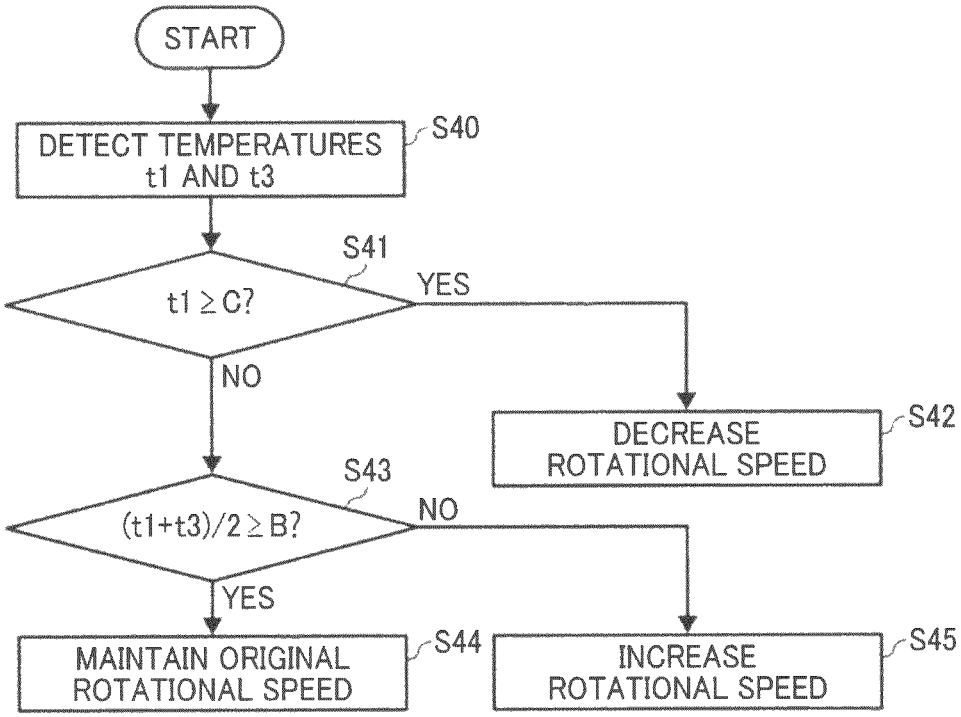
FIG. 9 is a flowchart illustrating an example of rotational speed adjustment performed by the image forming apparatus according to a fourth embodiment of this patent specification.

FIG. 9 is a flowchart illustrating an example of rotational speed adjustment performed by the image forming apparatus 1 based on the correction table represented in TABLE 4.

As shown in FIG. 9, initially, the first and third thermistors T1 and T3 detect first and second temperatures t1 and t3, respectively, the former at the metal core 29 of the fuser roller 22, and the latter on the fuser belt 24 along the circumference of the fuser roller 22, upon entry of a recording sheet S in the sheet conveyance path P (step S40).

Then, the controller 100 determines whether the detected temperature t1 exceeds a first reference temperature C of, for example, 95° C. (step S41).

Where the detected temperature t1 equals or exceeds the reference temperature C, indicating that the speed differential V1−V2 exceeds the acceptable range ("YES" at step S41), the controller 100 sets the correction rate α to a given negative value, so as to decrease the rotational speed F from the original, reference value Fref (step S42).

Where the detected temperature t1 falls below the reference temperature C ("NO" at step S41), the controller 100 then determines whether the average of the detected temperatures (t1+t3)/2 exceeds a second reference temperature B of, for example, 105° C. (step S43).

Where the detected average temperature (t1+t3)/2 equals or exceeds the reference temperature B, indicating that the speed differential V1−V2 falls within the acceptable range ("YES" at step S43), the controller 100 sets the correction rate α to 0 so as to maintain the rotational speed F at the original, reference value Fref (step S44).

Where the detected average temperature (t1+t3)/2 falls below the reference temperature B, indicating that the speed differential V1−V2 exceeds the acceptable range ("NO" at step S43), the controller 100 sets the correction rate α to a given positive value, so as to increase the rotational speed F from the original, reference value Fref (step S45).

With the rotational speed F thus decreased where the first temperature t1 exceeds the reference temperature C and increased where the average of the first and third temperatures t1 and t3 falls below the reference temperature B, the resulting circumferential speed V1 of the fuser roller 22 remains substantially constant relative to the fixed circumferential speed V2 of the output roller pair 27, so that the speed differential V1−V2 remains within a desired, appropriate range.

Although the embodiment depicted in FIG. 9 controls sheet conveyance speed based on the combination of first and third temperatures t1 and t3, alternatively, instead, it is possible to determine whether to maintain the original rotational speed based on the combination of first and second temperatures t1 and t2. Moreover, although the present embodiment uses the first temperature t1 to determine whether to decrease the rotational speed, alternatively, instead, it is possible base such determination upon either the average of the first and third temperatures (t1+t3)/2 or the average of the first and second temperatures (t1+t2)/2 with an appropriate reference temperature.

Hence, the image forming apparatus 1 according to the fourth embodiment of this patent specification can maintain the differential speed V1−V2 along the sheet conveyance path P within a sufficiently narrow, acceptable range so as to ensure good imaging quality as well as proper sheet conveyance performance along the sheet conveyance path P, in which the controller 100 adjusts the rotational speed F of the fuser rotary drive 90 depending on the temperature t1 detected at the cylindrical core 29 of the fuser roller 22 as well as the temperature t3 detected on the fuser belt 24 along the circumference of the fuser roller 22, so that the fuser roller 22 can rotate with a substantially constant circumferential speed V1 regardless of variations in the operating temperature causing thermal expansion or contraction of the elastic material.

Compared to the foregoing embodiments, such rotational speed adjustment can more reliably maintain the differential speed V1−V2 within an appropriate range, wherein the controller 100 not only increases the rotational speed F upon detecting a relatively low operating temperature indicating that the fuser roller 22 contracts in diameter to yield a relatively slow circumferential speed, but also decreases the rotational speed F upon detecting a relatively high operating temperature indicating that the fuser roller 22 expands in diameter to yield a relatively fast circumferential speed.

In the first through fourth embodiments depicted above, the image forming apparatus 1 may gradually reset or restore the corrected rotational speed F of the rotary drive 90 to the original, reference speed Fref, where the fixing device 20 successively processes an increased number of recording sheets S for an extended period of time, during which the fuser roller 22 gradually heats to a designed operating temperature, so that the differential speed V1−V2 falls within an appropriate, acceptable range.

Specifically, for example, the controller 100 may gradually restore the correction variable α to zero as the number of recording sheets S processed through the fixing nip N increases since activation of the fixing process. In such cases, rotational speed adjustment is based on a correction table that contains counts of recording sheet each associated with a specific correction variable α. An example of such speed correction table is provided in TABLE 5 below.

TABLE 5

| NUMBER OF SHEETS PROCESSED | CORRECTION VARIABLE α |
|---|---|
| 0-500 | 1.0% |
| 501-1000 | 0.5% |
| 1001- | 0 |

Alternatively, the controller 100 may gradually restore the correction variable α to zero as the elapsed time, instead of the number of recording sheets, increases since activation of the fixing process. In such cases, rotational speed adjustment is based on a correction table that contains ranges of elapsed time each associated with a specific correction variable α. An example of such speed correction table is provided in TABLE 6 below.

TABLE 6

| TIME ELAPSED (sec) | CORRECTION VARIABLE α |
|---|---|
| 0-300 | 1.0% |
| 301-600 | 0.5% |
| 601- | 0 |

Figure 10:
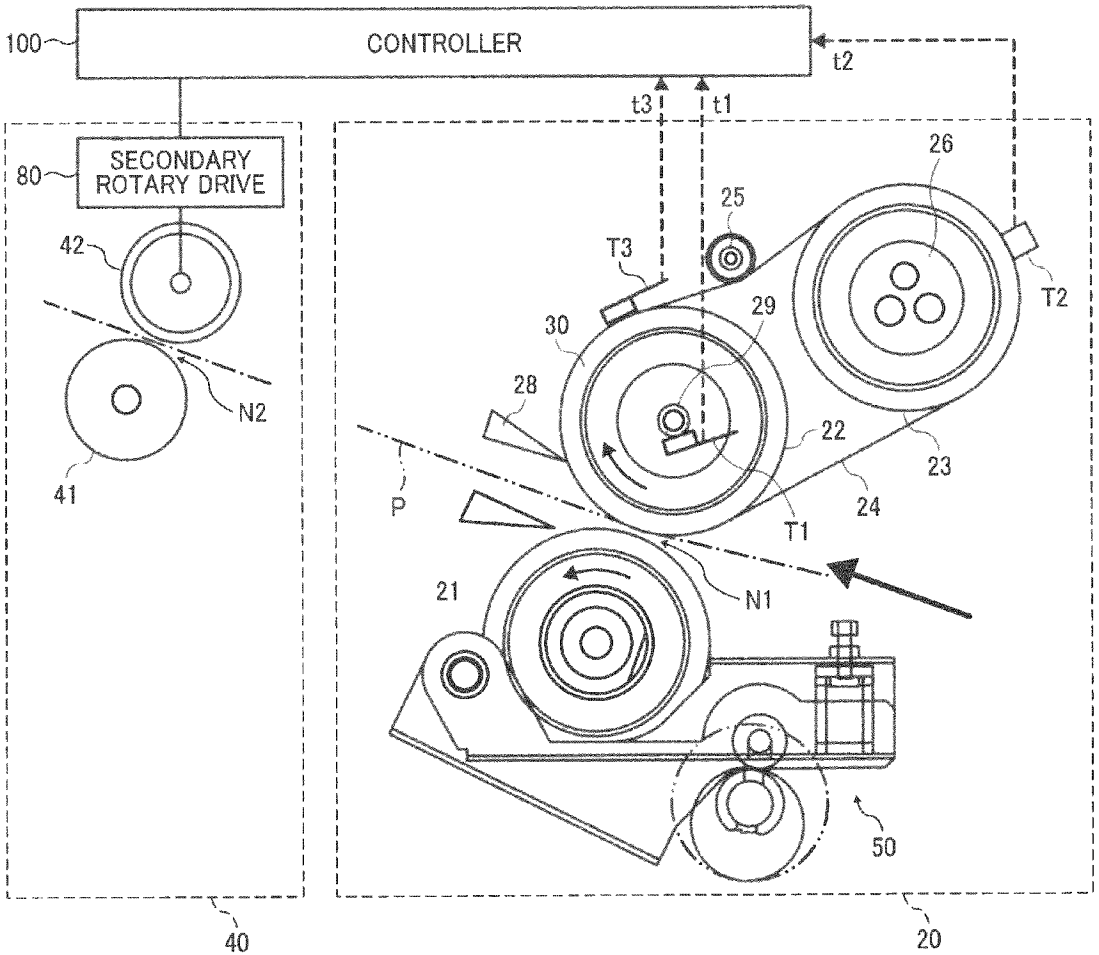
FIG. 10 is an end-on, axial cutaway view schematically illustrating the fixing device according to one or more further embodiments of this patent specification.

FIG. 10 is an end-on, axial cutaway view schematically illustrating the fixing device 20 according to one or more further embodiments of this patent specification.

As shown in FIG. 10, the overall configuration of the present embodiment is similar to that depicted primarily with reference to FIG. 2, except that the fixing device 20 is configured as a primary fixing unit forming a primary fixing nip N1, with a post-fixing, secondary fixing unit 40 disposed downstream from the fixing unit 20 along the sheet conveyance path P.

Specifically, the secondary fixing unit 40 is formed of an internally heated, secondary fuser roller 42 and a secondary pressure roller 41 pressed against the fuser roller 42 to form a secondary fixing nip N2 therebetween, through which a recording sheet S is passed for post-fixing processing, such as adjustment of gloss on the printed image or the like, subsequent to processing through the primary fixing nip N1.

In the present embodiment, the secondary fuser roller 42 comprises a motor-driven, hollow cylindrical body of aluminum or other thermally conductive material, approximately 40 mm in diameter, coated with an outer layer of PFA deposited thereupon. The secondary fuser roller 42 has a dedicated heater disposed in its hollow interior, operated according to readings of a thermometer or thermistor detecting temperature at a suitable portion of the secondary fixing assembly.

The secondary pressure roller 41 comprises a cylindrical body of sponged material, approximately 40 mm in diameter, covered by an outer layer of PFA formed into a tubular configuration.

With continued reference to FIG. 10, the secondary fixing unit 40 is shown with the controller 100 including, or operatively connected with a rotary drive 80 of the secondary fuser roller 42. The rotary drive 80 comprises a motor connected to the fuser roller 42 via a reduction gear train so as to drive the fuser roller 22 to rotate in coordination with other parts of the fixing assembly according to a control signal transmitted from the controller 100.

During operation, the primary fixing unit 20 operates in a manner similar to that depicted with reference to FIG. 2, wherein the motor-driven fuser roller 22 rotates in a given rotational direction (i.e., clockwise in the drawing), so as to rotate the fuser belt 24 with a linear, first conveyance speed V1 along its circumference, which in turn rotates the pressure roller 21 in a given rotational direction (i.e., counterclockwise in the drawing) with the same circumferential speed as that of the fuser roller 22.

In this state, a recording sheet S bearing an unfixed, powder toner image T enters the primary fixing unit 20 along a sheet guide defining the sheet conveyance path P. As the rotary fixing members rotate together, the recording sheet S is passed through the primary fixing nip N1 to fix the toner image in place, wherein heat from the fuser belt 24 causes toner particles to fuse and melt, while pressure from the pressure roller 21 causes the molten toner to settle onto the sheet surface.

At the exit of the primary fixing nip N1, the recording sheet S has its leading edge stripped from the rotary members by the associated sheet strippers 28, and then proceeds to the secondary fixing unit 40 while having its trailing edge still passing through the primary fixing unit 20.

In the secondary fixing unit 40, the motor-driven fuser roller 42 rotates in a given rotational direction (i.e., clockwise in the drawing) with a linear, first conveyance speed V2 along its circumference as the rotary drive 80 imparts torque or rotational force with a given rotational speed or frequency F via the gear train, which in turn rotates the pressure roller 41 in a given rotational direction (i.e., counterclockwise in the drawing) with the same circumferential speed as that of the fuser roller 42.

The secondary fixing rollers 41 and 42 thus rotating together forward the incoming sheet S with the second conveyance speed V2, while processing the printed image with heat and pressure, for example, for adjusting gloss. After exiting the secondary fixing unit 40, the recording sheet S reaches the output roller pair 27, and then finally enters the output tray 18 from the sheet conveyance path P.

In such a configuration, the conveyance speed V1 along the circumference of the primary fuser roller 22 is influenced by variations in processing temperature which cause the elastic material of the fuser roller 22 to thermally expand and contract, resulting in dimensional variations in the primary fixing nip N1. On the other hand, the conveyance speed V2 along the circumference of the secondary fuser roller 42 is substantially immune to variations in processing temperature.

Where the second conveyance speed V2 remains substantially constant, variations in the conveyance speed V1 translate into variations in a difference V1−V2 between the first and second conveyance speeds V1 and V2. If not corrected, such variations in the speed differential V1−V2 can affect imaging quality as well as sheet conveyance performance downstream from the primary fixing nip N1 along the sheet conveyance path P.

Figure 11:
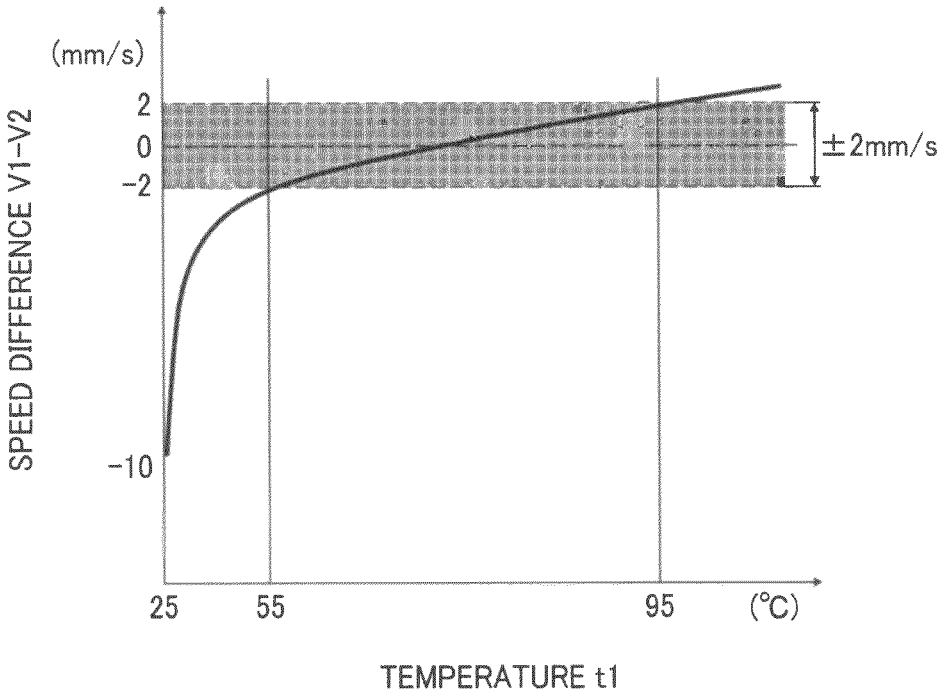
FIG. 11 is a graph showing a speed differential between primary and secondary fuser rollers plotted against a first temperature experimentally measured in the fixing device of FIG. 10.

FIG. 11 is a graph showing the speed differential V1−V2 in millimeters per second (mm/s) between the primary and secondary fuser rollers 22 and 42, plotted against the first temperature t1 in degrees Celsius (° C.) detected at the metal core 29 of the primary fuser roller 22 driven with a fixed rotational speed.

As shown in FIG. 11, where the roller temperature t1 remains low, the first conveyance speed V1 is significantly lower than the second conveyance speed V2 so that the speed differential V1−V2 is relatively large in absolute value, for example, reaching approximately −10 mm/s at a roller temperature t1 of approximately 25° C. As the roller temperature t1 increases, causing the fuser roller 22 to thermally expand, the speed differential V1−V2 reduces toward a desired point of 0 mm/s. The speed differential V1−V2 remains within an acceptable range from −2 mm/s to 2 mm/s (indicated by shading in the graph) as long as the roller temperature t1 equals or exceeds a lower limit of approximately 55° C. and falls below an upper limit of approximately 95° C.

In general, a failure to keep the speed differential within a specified acceptable range (e.g., ±2 mm/s in the present embodiment) can cause various adverse effects on imaging and sheet conveyance performance of the image forming apparatus.

For example, a negative speed differential V1−V2 of approximately −2 mm/s or below, indicating that the primary fixing unit processes a recording sheet with a conveyance speed significantly slower than that of the secondary fixing unit, can adversely affect imaging quality, in which the recording sheet, advanced faster at its downstream, leading edge than at its upstream, trailing edge, rubs or strikes against a sheet stripper or a similar guide mechanism, thereby causing image defects during conveyance from the primary fixing nip N1 to the secondary fixing nip N2.

On the other hand, a positive speed differential V1−V2 of approximately 2 mm/s or larger, indicating that the primary fixing unit processes a recording sheet with a conveyance speed significantly faster than that of the secondary fixing unit, can adversely affect conveyance of a recording sheet, in which the recording sheet, advanced faster at its upstream, trailing edge than at its downstream, leading edge, slacks into a bow which then creates accordion-like folds to jam the sheet conveyance path from the primary fixing nip N1 to the secondary fixing nip N2.

According to this patent specification, the image forming apparatus 1 controls conveyance of the recording sheet S through the fixing nip N1 by adjusting the rotational speed or frequency F of the secondary fuser roller 42 depending on the operating temperature detected upon entry of the recording sheet S in the sheet conveyance path P, so as to maintain a difference V1−V2 between the first and second conveyance speeds V1 and V2 within a specified acceptable range, thereby preventing adverse effects caused by variations in the speed differential V1−V2 along the sheet conveyance path P.

Specifically, in a fifth embodiment, the controller 100 adjusts the rotational speed F of the rotary drive 80 of the secondary fuser roller 42 according to the first temperature t1 detected by the first thermistor T1 upon entry of a recording sheet S in the sheet conveyance path P, so as to correct and maintain the circumferential speed V2 of the secondary fuser roller 42 substantially constant relative to the circumferential speed V1 of the primary fuser roller 22 regardless of the diameter of the fuser roller 22 varying with temperature.

Such rotational speed adjustment may be performed, for example, by correcting an original, reference rotational speed Fref of the secondary rotary drive 80 with a variable amount of correction β dependent on the first temperature t1 detected. The correction variable β for the rotational speed adjustment may be defined as a variable rate or percentage by which the rotational frequency F is calculated from the original value Fref, as follows:

$$F = Fref*(1+\beta/100)$$

In the present embodiment, the controller 100 includes a predefined table or list of correction variables β for rotational speed adjustment, stored in an appropriate memory such as ROM or the like, which contains ranges of first temperature t1 each associated with a specific correction variable β. An example of such speed correction table is provided in TABLE 7 below.

TABLE 7

| TEMPERATURE DETECTED | CORRECTION VARIABLE β |
|---|---|
| t1 < 55° C. | −1% |
| t1 ≥ 55° C. | 0 |

According to the speed correction table, the secondary rotational speed F is decreased from the reference value Fref by a correction rate of −1% where the first temperature t1 detected falls below a reference temperature of 55° C., and is maintained at the original speed Fref where the first temperature t1 detected equals or exceeds the reference temperature.

Figure 12:
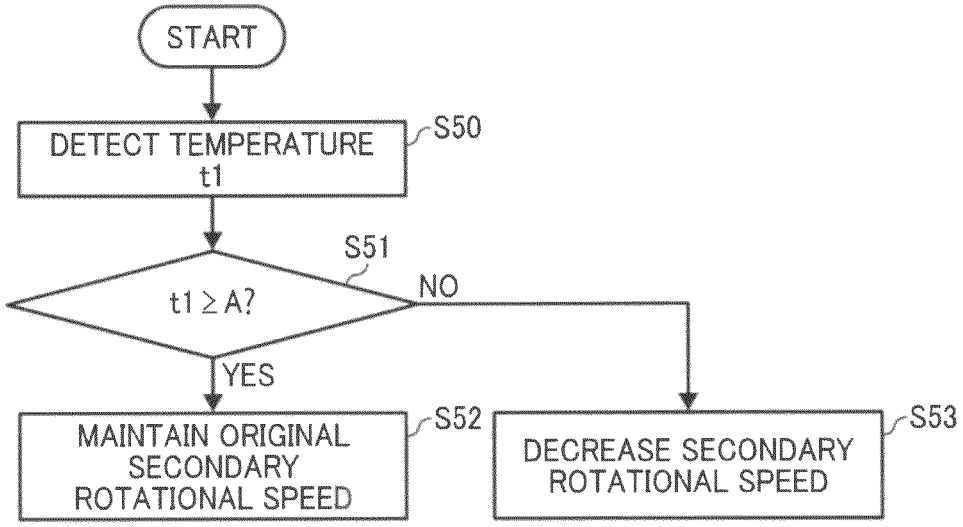
FIG. 12 is a flowchart illustrating an example of rotational speed adjustment performed by the image forming apparatus according to a fifth embodiment of this patent specification.

FIG. 12 is a flowchart illustrating an example of rotational speed adjustment performed by the image forming apparatus 1 based on the correction table represented in TABLE 7.

As shown in FIG. 12, initially, the first thermistor T1 detects a first temperature t1 at the metal core 29 of the fuser roller 22 upon entry of a recording sheet S in the sheet conveyance path P (step S50).

Then, the controller 100 determines whether the detected temperature t1 exceeds a reference temperature A of, for example, 55° C. (step S51).

Where the detected temperature t1 equals or exceeds the reference temperature A, indicating that the speed differential V1−V2 falls within the acceptable range ("YES" at step S51), the controller 100 sets the correction rate β to 0 so as to maintain the secondary rotational speed F at the original, reference value Fref (step S52).

Where the detected temperature t1 falls below the reference temperature A, indicating that the speed differential V1−V2 exceeds the acceptable range ("NO" at step S51), the controller 100 sets the correction rate β to a given negative value, so as to decrease the secondary rotational speed F from the original, reference value Fref (step S53).

With the rotational speed F thus decreased where the first temperature t1 falls below the reference temperature A, the resulting circumferential speed V2 of the secondary fuser roller 42 remains substantially constant relative to the circumferential speed V1 of the primary fuser roller 22, so that the speed differential V1−V2 remains within a desired, appropriate range.

Hence, the image forming apparatus 1 according to the fifth embodiment of this patent specification can maintain the differential speed V1−V2 along the sheet conveyance path P within a sufficiently narrow, acceptable range so as to ensure good imaging quality as well as proper sheet conveyance performance along the sheet conveyance path P, in which the controller 100 adjusts the rotational speed F of the secondary fuser rotary drive 80 depending on the temperature t1 detected at the cylindrical core 29 of the fuser roller 22, so that the secondary fuser roller 42 can rotate with a substantially constant circumferential speed V2 relative to the circumferential speed V1 of the primary fuser roller 22 regardless of variations in the operating temperature causing thermal expansion or contraction of the elastic material, even where the primary fuser roller is configured as a thick rubber-coated, metal-cored cylindrical body with no dedicated heater provided therein.

In further embodiment, the image forming apparatus 1 may perform rotational speed adjustment on the secondary fixing roller based not only on the first temperature t1 but also on the second and third temperatures t2 and t3, or on any combination of such detected temperatures. Compared to adjustment based only on the first temperature t1, which tends to change rapidly relative to the speed differential V1−V2, using a combination of multiple temperatures allows the controller 100 to more accurately determine the operating condition, so as to more properly correct the rotational speed of the secondary rotary drive 80 according to thermal expansion or contraction experienced by the primary fuser roller 22. Several such embodiments are described below with reference to FIG. 13 and subsequent drawings.

Figure 13:
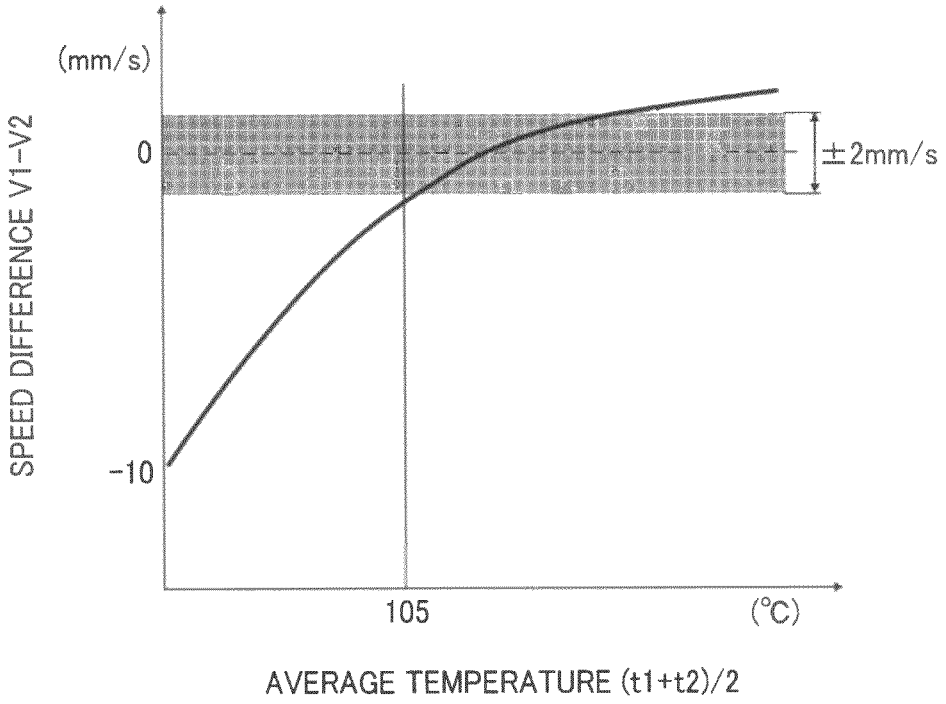
FIG. 13 is a graph showing a speed differential between primary and secondary fuser rollers plotted against an average of first and second temperatures experimentally measured in the fixing device of FIG. 10.

FIG. 13 is a graph showing the speed differential V1−V2 in millimeters per second (mm/s) between the primary and secondary fuser rollers 22 and 42, plotted against an average of the first and second temperatures t1 and t2 in degrees Celsius (° C.), the former detected at the metal core 29 of the fuser roller 22 driven with a fixed rotational speed, and the latter on the fuser belt 24 along the circumference of the heat roller 23.

As shown in FIG. 13, where the average temperature (t1+t2)/2 remains low, the first conveyance speed V1 is significantly lower than the second conveyance speed V2 so that the speed differential V1−V2 is relatively large in absolute value. As the average temperature (t1+t2)/2 increases, causing the primary fuser roller 22 to thermally expand, the speed differential V1−V2 reduces toward a desired point of 0 mm/s. The speed differential V1−V2 reaches an acceptable range from −2 mm/s to 2 mm/s (indicated by shading in the graph) where the average temperature (t1+t2)/2 equals or exceeds a lower limit of approximately 105° C.

In a sixth embodiment, the controller 100 adjusts the rotational speed F of the rotary drive 80 of the secondary fuser roller 42 according to the average of the first and second temperatures t1 and t2 detected by the first and second thermistors T1 and T2, respectively, upon entry of a recording sheet S in the sheet conveyance path P, so as to correct and maintain the circumferential speed V2 of the secondary fuser roller 42 substantially constant relative to the circumferential speed V1 of the primary fuser roller 22 regardless of the diameter of the fuser roller 22 varying with temperature.

As is the case with the fifth embodiment depicted earlier, such rotational speed adjustment may be performed, for example, by correcting an original, reference rotational speed Fref of the rotary drive 80 of the secondary fuser roller 42 with a correction variable β dependent on the average of the first and second temperatures t1 and t2 detected.

In the present embodiment, the controller 100 includes a predefined table or list of correction variables β for rotational speed adjustment, stored in an appropriate memory such as ROM or the like, which contains ranges of average temperature (t1+t2)/2 each associated with a specific correction variable β. An example of such speed correction table is provided in TABLE 8 below.

TABLE 8

| TEMPERATURE DETECTED | CORRECTION VARIABLE β |
|---|---|
| (t1 + t2)/2 < 105° C. | −1% |
| (t1 + t2)/2 ≥ 105° C. | 0 |

According to the speed correction table, the secondary rotational speed F is decreased from the reference value Fref by a correction rate of −1% where the average temperature (t1+t2)/2 detected falls below a reference temperature of 105° C., and is maintained at the original speed Fref where the average temperature (t1+t2)/2 detected equals or exceeds the reference temperature.

Figure 14:
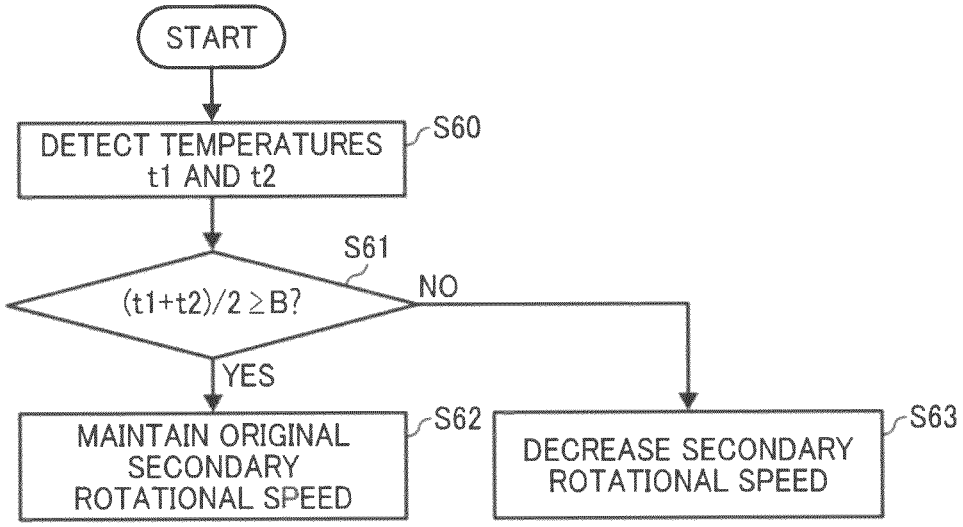
FIG. 14 is a flowchart illustrating an example of rotational speed adjustment performed by the image forming apparatus according to a sixth embodiment of this patent specification.

FIG. 14 is a flowchart illustrating an example of rotational speed adjustment performed by the image forming apparatus 1 based on the correction table represented in TABLE 8.

As shown in FIG. 14, initially, the first and second thermistors T1 and T2 detect first and second temperatures t1 and t2, respectively, the former at the metal core 29 of the fuser roller 22, and the latter on the fuser belt 24 along the circumference of the heat roller 23, upon entry of a recording sheet S in the sheet conveyance path P (step S60).

Then, the controller 100 determines whether the average of the detected temperatures (t1+t2)/2 exceeds a reference temperature B of, for example, 105° C. (step S61).

Where the detected average temperature (t1+t2)/2 equals or exceeds the reference temperature B, indicating that the speed differential V1−V2 falls within the acceptable range ("YES" at step S61), the controller 100 sets the correction rate β to 0 so as to maintain the secondary rotational speed F at the original, reference value Fref (step S62).

Where the detected average temperature (t1+t2)/2 falls below the reference temperature B, indicating that the speed differential V1−V2 exceeds the acceptable range ("NO" at step S61), the controller 100 sets the correction rate β to a given negative value, so as to decrease the secondary rotational speed F from the original, reference value Fref (step S63).

With the secondary rotational speed F thus decreased where the average of the first and second temperatures t1 and t2 falls below the reference temperature B, the resulting circumferential speed V2 of the secondary fuser roller 42 remains substantially constant relative to the circumferential speed V1 of the primary fuser roller 22, so that the speed differential V1−V2 remains within a desired, appropriate range.

Hence, the image forming apparatus 1 according to the sixth embodiment of this patent specification can maintain the differential speed V1−V2 along the sheet conveyance path P within a sufficiently narrow, acceptable range so as to ensure good imaging quality as well as proper sheet conveyance performance along the sheet conveyance path P, in which the controller 100 adjusts the rotational speed F of the secondary fuser rotary drive 80 depending on the temperature t1 detected at the cylindrical core 29 of the fuser roller 22 as well as the temperature t2 detected on the fuser belt 24 along the circumference of the heat roller 23, so that the secondary fuser roller 42 can rotate with a substantially constant circumferential speed V2 relative to the circumferential speed V1 of the primary fuser roller 22 regardless of variations in the operating temperature causing thermal expansion or contraction of the elastic material.

Compared to the fifth embodiment, such rotational speed adjustment can more accurately estimate variations in the conveyance speed due to dimensional variations of the thermally expansive, elastic roller 22, wherein the average of the first and second temperatures t1 and t2 more precisely indicates an operating temperature of the outer elastic layer than the first temperature t1 alone, since the temperature t2 detected at the circumference of the heat roller 23 is substantially consistent with that detected at the circumference of the fuser roller 22 during operation.

Figure 15:
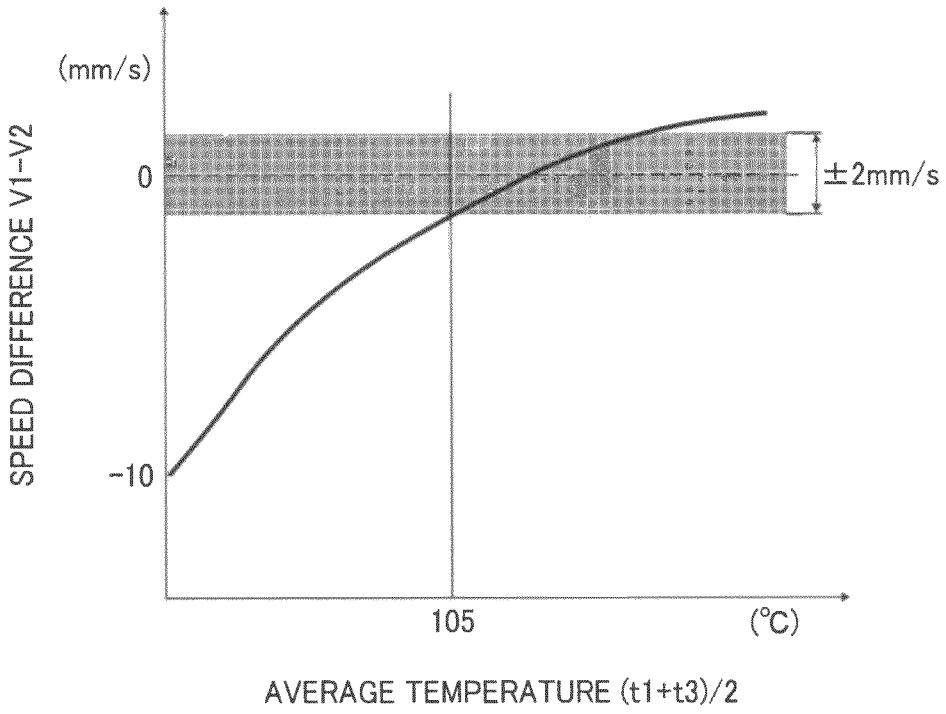
FIG. 15 is a graph showing a speed differential between primary and secondary fuser rollers plotted against an average of first and third temperatures experimentally measured in the fixing device of FIG. 10.

FIG. 15 is a graph showing the speed differential V1−V2 in millimeters per second (mm/s) between the primary and secondary fuser rollers 22 and 42, plotted against an average of the first and third temperatures t1 and t3 in degrees Celsius (° C.), the former detected at the metal core 29 of the fuser roller 22 driven with a fixed rotational speed, and the latter on the fuser belt 24 along the circumference of the fuser roller 22.

As shown in FIG. 15, where the average temperature (t1+t3)/2 remains low, the first conveyance speed V1 is significantly lower than the second conveyance speed V2 so that the speed differential V1−V2 is relatively large in absolute value. As the average temperature (t1+t3)/2 increases, causing the primary fuser roller 22 to thermally expand, the speed differential V1−V2 reduces toward a desired point of 0 mm/s. The speed differential V1−V2 reaches an acceptable range from −2 mm/s to 2 mm/s (indicated by shading in the graph) where the average temperature (t1+t3)/2 equals or exceeds a lower limit of approximately 105° C.

In a seventh embodiment, the controller 100 adjusts the rotational speed F of the rotary drive 80 of the secondary fuser roller 42 according to the average of the first and third temperatures t1 and t3 detected by the first and third thermistors T1 and T3, respectively, upon entry of a recording sheet S in the sheet conveyance path P, so as to correct and maintain the circumferential speed V2 of the secondary fuser roller 42 substantially constant relative to the circumferential speed V1 of the primary fuser roller 22 regardless of the diameter of the fuser roller 22 varying with temperature.

As is the case with the fifth embodiment depicted earlier, such rotational speed adjustment may be performed, for example, by correcting an original, reference rotational speed Fref of the secondary rotary drive 80 with a correction variable β dependent on the average of the first and third temperatures t1 and t3 detected.

In the present embodiment, the controller 100 includes a predefined table or list of correction variables β for rotational speed adjustment, stored in an appropriate memory such as ROM or the like, which contains ranges of average temperature (t1+t3)/2 each associated with a specific correction variable β. An example of such speed correction table is provided in TABLE 9 below.

TABLE 9

| TEMPERATURE DETECTED | CORRECTION VARIABLE β |
|---|---|
| (t1 + t3)/2 < 105° C. | −1% |
| (t1 + t3)/2 ≥ 105° C. | 0 |

According to the speed correction table, the secondary rotational speed F is decreased from the reference value Fref by a correction rate of −1% where the average temperature (t1+t3)/2 detected falls below a reference temperature of 105° C., and is maintained at the original speed Fref where the average temperature (t1+t3)/2 detected equals or exceeds the reference temperature.

Figure 16:
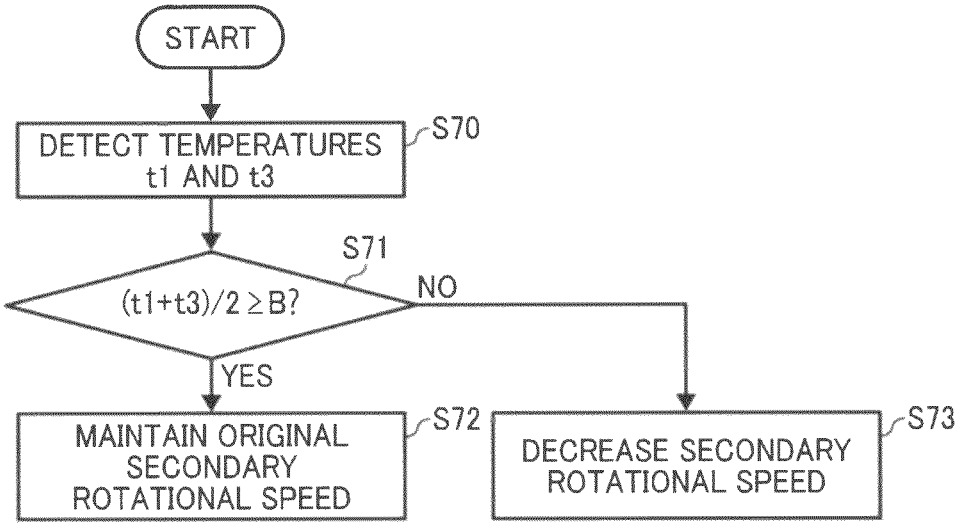
FIG. 16 is a flowchart illustrating an example of rotational speed adjustment performed by the image forming apparatus according to a seventh embodiment of this patent specification.

FIG. 16 is a flowchart illustrating an example of rotational speed adjustment performed by the image forming apparatus 1 based on the correction table represented in TABLE 9.

As shown in FIG. 16, initially, the first and third thermistors T1 and T3 detect first and second temperatures t1 and t3, respectively, the former at the metal core 29 of the fuser roller 22, and the latter on the fuser belt 24 along the circumference of the fuser roller 22, upon entry of a recording sheet S in the sheet conveyance path P (step S70).

Then, the controller 100 determines whether the average of the detected temperatures (t1+t3)/2 exceeds a reference temperature B of, for example, 105° C. (step S71).

Where the detected average temperature (t1+t3)/2 equals or exceeds the reference temperature B, indicating that the speed differential V1−V2 falls within the acceptable range ("YES" at step S71), the controller 100 sets the correction rate β to 0 so as to maintain the secondary rotational speed F at the original, reference value Fref (step S72).

Where the detected average temperature (t1+t3)/2 falls below the reference temperature B, indicating that the speed differential V1−V2 exceeds the acceptable range ("NO" at step S71), the controller 100 sets the correction rate β to a given negative value, so as to decrease the secondary rotational speed F from the original, reference value Fref (step S73).

With the secondary rotational speed F thus decreased where the average of the first and third temperatures t1 and t3 falls below the reference temperature B, the resulting circumferential speed V2 of the secondary fuser roller 42 remains substantially constant relative to the circumferential speed V1 of the primary fuser roller 22, so that the speed differential V1−V2 remains within a desired, appropriate range.

Hence, the image forming apparatus 1 according to the seventh embodiment of this patent specification can maintain the differential speed V1−V2 along the sheet conveyance path P within a sufficiently narrow, acceptable range so as to ensure good imaging quality as well as proper sheet conveyance performance along the sheet conveyance path P, in which the controller 100 adjusts the rotational speed F of the secondary fuser rotary drive 80 depending on the temperature t1 detected at the cylindrical core 29 of the fuser roller 22 as well as the temperature t3 detected on the fuser belt 24 along the circumference of the fuser roller 22, so that the secondary fuser roller 42 can rotate with a substantially constant circumferential speed V2 relative to the circumferential speed V1 of the primary fuser roller 22.

Compared to the fifth embodiment, such rotational speed adjustment can more accurately estimate variations in the conveyance speed due to dimensional variations of the thermally expansive, elastic roller 22, wherein the temperature t3 detected at the circumference of the fuser roller 22 more precisely indicates an operating temperature of the outer elastic layer than the temperature t1 detected at the metal core 29 of the fuser roller 22, particularly upon standby during which the heat roller 23 stops supply of heat, causing a sudden reduction in temperature at the circumference of the fuser roller 22.

Although in several embodiments depicted above the controller 100 controls sheet conveyance speed by decreasing the secondary rotational speed F from the original, reference value Fref where the detected temperature equals or exceeds a relatively low reference temperature indicative of a reduction in the first conveyance speed V1, such rotational speed adjustment may also be performed by increasing the secondary rotational speed F from the original, reference value Fref where the detected temperature equals or exceeds a relatively high reference temperature indicative of an increase in the first conveyance speed V1.

As mentioned above with reference to FIG. 11, the speed differential V1−V2 reaches the acceptable range of ±2 mm/s as the roller temperature t1 equals or exceeds a lower limit of approximately 55° C. As the roller temperature t1 rises, causing further thermal expansion of the primary fuser roller 22 and concomitant increase in the circumferential speed V1, the speed differential V1−V2 reaches the desired point of 0 mm/s, and again exceeds the acceptable range where the roller temperature t1 exceeds an upper limit of approximately 95° C.

In an eighth embodiment, the controller 100 adjusts the rotational speed F of the rotary drive 80 of the secondary fuser roller 42 from an original, reference rotational speed Fref with a variable amount of correction β dependent on the first temperature t1 as well as the third temperature t3. Unlike the foregoing embodiments, the controller 100 increases, instead of decreasing, the secondary rotational speed F from the original rotational speed Fref where the detected temperature equals or exceeds a given reference temperature.

In the present embodiment, the controller 100 includes a predefined table or list of correction variables β for rotational speed adjustment, stored in an appropriate memory such as ROM or the like, which contains ranges of the first temperature t1 as well as the average of the first and third temperatures (t1+t3)/2 each associated with a specific correction variable β. An example of such speed correction table is provided in TABLE 10 below.

TABLE 10

| TEMPERATURE DETECTED | CORRECTION VARIABLE β |
|---|---|
| t1 < 95° C. | 0 |
| t1 ≥ 95° C. | 1% |
| (t1 + t3)/2 < 105° C. | −1% |
| (t1 + t3)/2 ≥ 105° C. | 0 |

According to the speed correction table, the secondary rotational speed F is increased from the reference value Fref by a correction rate of 1% where the first temperature t1 equals or exceeds a first reference temperature of 95° C., and is decreased from the reference value Fref by a correction rate of −1% where the average temperature (t1+t3)/2 falls below a second reference temperature of 105° C. The secondary rotational speed F is maintained at the original speed Fref where the first temperature t1 detected falls below the first reference temperature, or where the average temperature (t1+t3)/2 equals or exceeds the second reference temperature.

Figure 17:
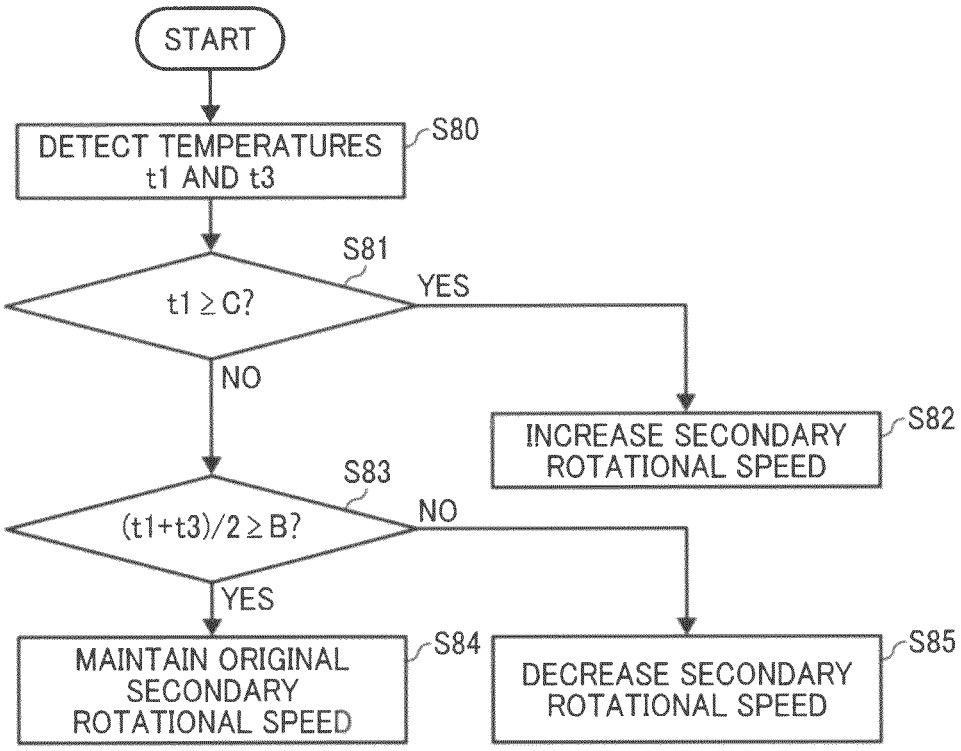
FIG. 17 is a flowchart illustrating an example of rotational speed adjustment performed by the image forming apparatus according to an eighth embodiment of this patent specification.

FIG. 17 is a flowchart illustrating an example of rotational speed adjustment performed by the image forming apparatus 1 based on the correction table represented in TABLE 10.

As shown in FIG. 17, initially, the first and third thermistors T1 and T3 detect first and second temperatures t1 and t3, respectively, the former at the metal core 29 of the fuser roller 22, and the latter on the fuser belt 24 along the circumference of the fuser roller 22, upon entry of a recording sheet S in the sheet conveyance path P (step S80).

Then, the controller 100 determines whether the detected temperature t1 exceeds a first reference temperature C of, for example, 95° C. (step S81).

Where the detected temperature t1 equals or exceeds the reference temperature C, indicating that the speed differential V1−V2 exceeds the acceptable range ("YES" at step S81), the controller 100 sets the correction rate β to a given positive value, so as to increase the secondary rotational speed F from the original, reference value Fref (step S82).

Where the detected temperature t1 falls below the reference temperature C ("NO" at step S81), the controller 100 then determines whether the average of the detected temperatures (t1+t3)/2 exceeds a second reference temperature B of, for example, 105° C. (step S83).

Where the detected average temperature (t1+t3)/2 equals or exceeds the reference temperature B, indicating that the speed differential V1−V2 falls within the acceptable range ("YES" at step S83), the controller 100 sets the correction rate β to 0 so as to maintain the secondary rotational speed F at the original, reference value Fref (step S84).

Where the detected average temperature (t1+t3)/2 falls below the reference temperature B, indicating that the speed differential V1−V2 exceeds the acceptable range ("NO" at step S83), the controller 100 sets the correction rate β to a given negative value, so as to decrease the secondary rotational speed F from the original, reference value Fref (step S85).

With the secondary rotational speed F thus increased where the first temperature t1 exceeds the reference temperature C and decreased where the average of the first and third temperatures t1 and t3 falls below the reference temperature B, the resulting circumferential speed V2 of the secondary fuser roller 42 remains substantially constant relative to the circumferential speed V1 of the primary fuser roller 22, so that the speed differential V1−V2 remains within a desired, appropriate range.

Although the embodiment depicted in FIG. 17 controls sheet conveyance speed based on the combination of first and third temperatures t1 and t3, alternatively, instead, it is possible to determine whether to maintain the original rotational speed based on the combination of first and second temperatures t1 and t2. Moreover, although the present embodiment uses the first temperature t1 to determine whether to decrease the rotational speed, alternatively, instead, it is possible to base such determination upon either the average of the first and third temperatures (t1+t3)/2 or the average of the first and second temperatures (t1+t2)/2 with an appropriate reference temperature.

Hence, the image forming apparatus 1 according to the eighth embodiment of this patent specification can maintain the differential speed V1−V2 along the sheet conveyance path P within a sufficiently narrow, acceptable range so as to ensure good imaging quality as well as proper sheet conveyance performance along the sheet conveyance path P, in which the controller 100 adjusts the rotational speed F of the secondary fuser rotary drive 80 depending on the temperature t1 detected at the cylindrical core 29 of the fuser roller 22 as well as the temperature t3 detected on the fuser belt 24 along the circumference of the fuser roller 22, so that the secondary fuser roller 42 can rotate with a substantially constant circumferential speed V2 relative to the circumferential speed V1 of the primary fuser roller 22.

Compared to the foregoing embodiments, such rotational speed adjustment can more reliably maintain the differential speed V1−V2 within an appropriate range, wherein the controller 100 not only decreases the secondary rotational speed F upon detecting a relatively low operating temperature indicating that the fuser roller 22 contracts in diameter to yield a relatively slow circumferential speed, but also increases the secondary rotational speed F upon detecting a relatively high operating temperature indicating that the fuser roller 22 expands in diameter to yield a relatively fast circumferential speed.

In the fifth through eighth embodiments depicted above, the image forming apparatus 1 may gradually reset or restore the corrected rotational speed F of the rotary drive 80 of the secondary fuser roller 42 to the original, reference speed Fref, where the fixing device 20 successively processes an increased number of recording sheets S for an extended period of time, during which the fuser roller 22 gradually heats to a designed operating temperature, so that the differential speed V1−V2 falls within an appropriate, acceptable range.

Specifically, for example, the controller 100 may gradually restore the correction variable β to zero as the number of recording sheets S processed through the fixing nip N increases since activation of the fixing process. In such cases, rotational speed adjustment on the secondary fixing roller is based on a correction table that contains counts of recording sheet each associated with a specific correction variable β. An example of such speed correction table is provided in TABLE 11 below.

TABLE 11

| NUMBER OF SHEETS PROCESSED | CORRECTION VARIABLE β |
|---|---|
| 0-500 | −1.0% |
| 501-1000 | −0.5% |
| 1001- | 0 |

Alternatively, the controller 100 may gradually restore the correction variable β to zero as the elapsed time, instead of the number of recording sheets, increases since activation of the fixing process. In such cases, rotational speed adjustment on the secondary fixing roller is based on a correction table that contains ranges of elapsed time each associated with a specific correction variable β. An example of such speed correction table is provided in TABLE 12 below.

TABLE 12

| TIME ELAPSED (sec) | CORRECTION VARIABLE β |
|---|---|
| 0-300 | −1.0% |
| 301-600 | −0.5% |
| 601- | 0 |

Figure 18:
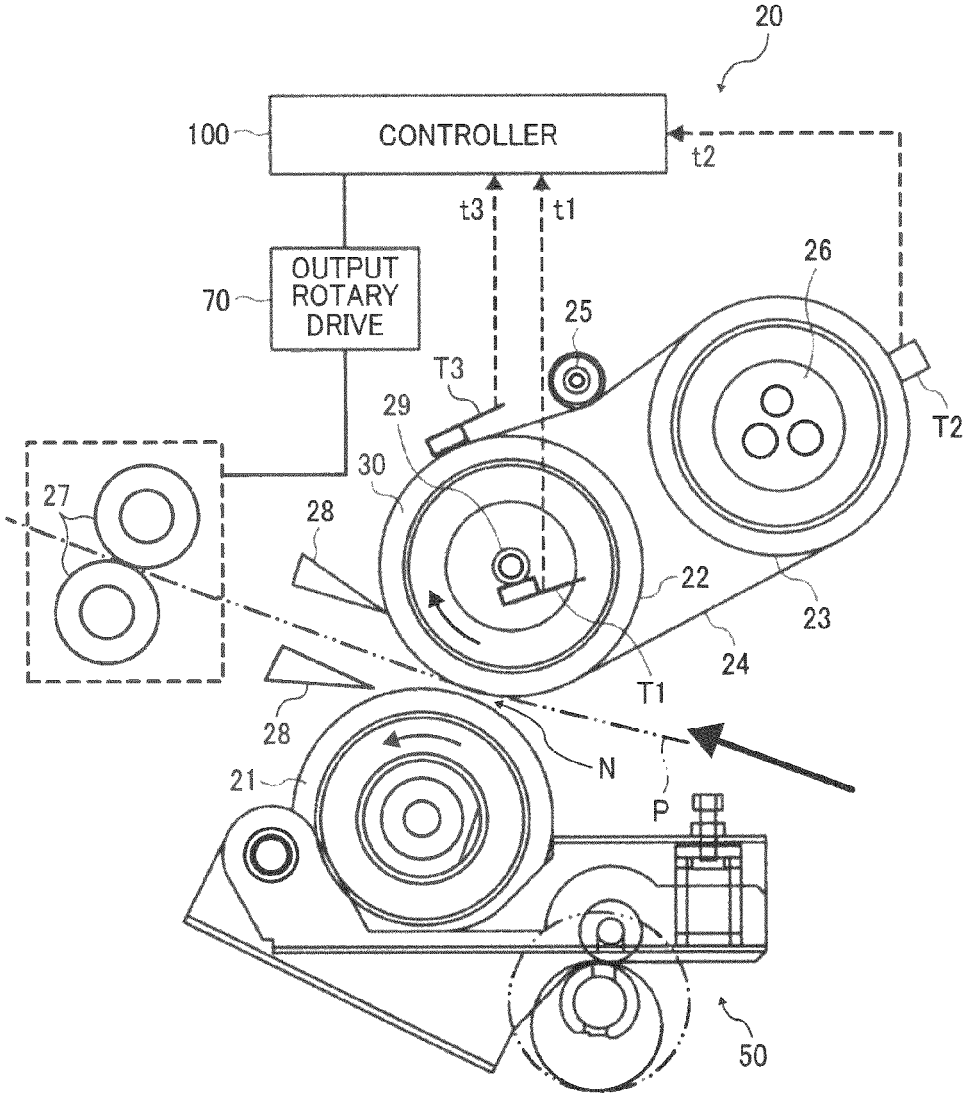
FIG. 18 is an end-on, axial cutaway view schematically illustrating the fixing device according to one or more further embodiments of this patent specification.

FIG. 18 is an end-on, axial cutaway view schematically illustrating the fixing device 20 according to one or more further embodiments of this patent specification.

As shown in FIG. 18, the fixing device 20 in the present embodiment is similar to that depicted primarily with reference to FIG. 2, except that to the controller 100 includes, or is operatively connected with a rotary drive 70 of the post-fixing, output unit 27 formed of a pair of opposed conveyance rollers, disposed downstream from the fixing device 20 along the sheet conveyance path P. The rotary drive 80 comprises a motor that drives the output roller pair 27 to rotate in coordination with other parts of the fixing assembly according to a control signal transmitted from the controller 100.

During operation, the fixing device 20 operates in a manner similar to that depicted with reference to FIG. 2, wherein the motor-driven fuser roller 22 rotates in a given rotational direction (i.e., clockwise in the drawing), so as to rotate the heated belt 24 with a linear, first conveyance speed V1 along its circumference, which in turn rotates the pressure roller 21 in a given rotational direction (i.e., counterclockwise in the drawing) with the same circumferential speed as that of the fuser roller 22.

In this state, a recording sheet S bearing an unfixed, powder toner image T enters the fixing device 20 along a sheet guide defining the sheet conveyance path P. As the rotary fixing members rotate together, the recording sheet S is passed through the fixing nip N to fix the toner image in place, wherein heat from the fuser belt 24 causes toner particles to fuse and melt, while pressure from the pressure roller 21 causes the molten toner to settle onto the sheet surface.

At the exit of the fixing nip N, the recording sheet S has its leading edge stripped from the rotary members by the associated sheet strippers 28, and then proceeds to the output unit 27 while having its trailing edge still passing through the fixing device 20.

In the output unit 27, the motor-driven output roller pair rotates in a given rotational direction (one clockwise and the other counterclockwise in the drawing) with a linear, first conveyance speed V2 along its circumference as the rotary drive 70 imparts torque or rotational force with a given rotational speed or frequency F via the gear train.

The output rollers 27 thus rotating together forwards the incoming sheet S with the second conveyance speed V2, so as to output it to the output tray 18 from the sheet conveyance path P.

In such a configuration, the conveyance speed V1 along the circumference of the fuser roller 22 is influenced by variations in processing temperature which cause the elastic material of the fuser roller 22 to thermally expand and contract, resulting in dimensional variations in the fixing nip N. On the other hand, the conveyance speed V2 along the circumference of the output roller pair 27 is substantially immune to variations in processing temperature.

Where the second conveyance speed V2 remains substantially constant, variations in the conveyance speed V1 translate into variations in a difference V1−V2 between the first and second conveyance speeds V1 and V2. If not corrected, such variations in the speed differential V1−V2 can affect imaging quality as well as sheet conveyance performance downstream from the fixing nip N along the sheet conveyance path P.

Figure 19:
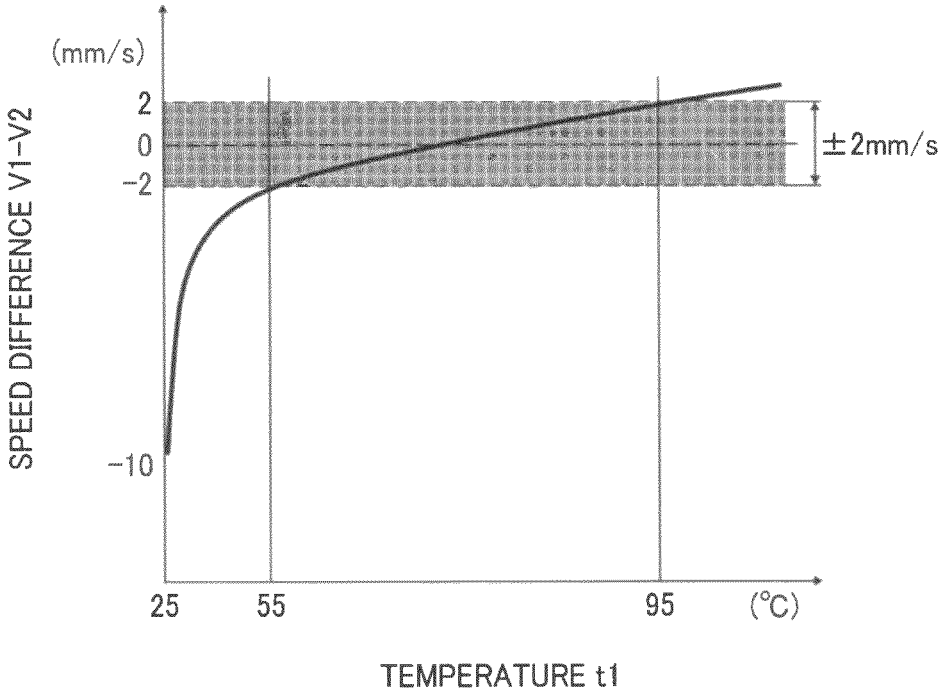
FIG. 19 is a graph showing a speed differential fuser and output rollers plotted against the first temperature experimentally measured in the fixing device of FIG. 18.

FIG. 19 is a graph showing the speed differential V1−V2 in millimeters per second (mm/s) between the fuser and output rollers 22 and 27, plotted against the first temperature t1 in degrees Celsius (° C.) detected at the metal core 29 of the fuser roller 22 driven with a fixed rotational speed.

As shown in FIG. 19, where the roller temperature t1 remains low, the first conveyance speed V1 is significantly lower than the second conveyance speed V2 so that the speed differential V1−V2 is relatively large in absolute value, for example, reaching approximately −10 mm/s at a roller temperature t1 of approximately 25° C. As the roller temperature t1 increases, causing the fuser roller 22 to thermally expand, the speed differential V1−V2 reduces toward a desired point of 0 mm/s. The speed differential V1−V2 remains within an acceptable range from −2 mm/s to 2 mm/s (indicated by shading in the graph) as long as the roller temperature t1 equals or exceeds a lower limit of approximately 55° C. and falls below an upper limit of approximately 95° C.

In general, a failure to keep the speed differential within a specified acceptable range (e.g., ±2 mm/s in the present embodiment) can cause various adverse effects on imaging and sheet conveyance performance of the image forming apparatus.

For example, a negative speed differential V1−V2 of approximately −2 mm/s or below, indicating that the fixing device processes a recording sheet with a conveyance speed significantly slower than that of the output roller pair, can adversely affect imaging quality, in which the recording sheet, advanced faster at its downstream, leading edge than at its upstream, trailing edge, rubs or strikes against a sheet stripper or a similar guide mechanism, thereby causing image defects during conveyance from the fixing nip N to the output roller pair.

On the other hand, a positive speed differential V1−V2 of approximately 2 mm/s or larger, indicating that the fixing device processes a recording sheet with a conveyance speed significantly faster than that of the output roller pair, can adversely affect conveyance of a recording sheet, in which the recording sheet, advanced faster at its upstream, trailing edge than at its downstream, leading edge, slacks into a bow which then creates accordion-like folds to jam the sheet conveyance path from the fixing nip N to the output roller pair.

According to this patent specification, the image forming apparatus 1 controls conveyance of the recording sheet S through the fixing nip N1 by adjusting the rotational speed or frequency F of the output roller pair 27 depending on the operating temperature detected upon entry of the recording sheet S in the sheet conveyance path P, so as to maintain a difference V1−V2 between the first and second conveyance speeds V1 and V2 within a specified acceptable range, thereby preventing adverse effects caused by variations in the speed differential V1−V2 along the sheet conveyance path P.

Specifically, in a ninth embodiment, the controller 100 adjusts the rotational speed F of the rotary drive 70 of the output unit 27 according to the first temperature t1 detected by the first thermistor T1 upon entry of a recording sheet S in the sheet conveyance path P, so as to correct and maintain the circumferential speed V2 of the output roller pair 27 substantially constant relative to the circumferential speed V1 of the fuser roller 22 regardless of the diameter of the fuser roller 22 varying with temperature.

Such rotational speed adjustment may be performed, for example, by correcting an original, reference rotational speed Fref of the output rotary drive 70 with a variable amount of correction γ dependent on the first temperature t1 detected. The correction variable γ for the rotational speed adjustment may be defined as a variable rate or percentage by which the rotational frequency F is calculated from the original value Fref, as follows:

$$F = Fref*(1+\gamma/100)$$

In the present embodiment, the controller 100 includes a predefined table or list of correction variables γ for rotational speed adjustment, stored in an appropriate memory such as ROM or the like, which contains ranges of first temperature t1 each associated with a specific correction variable γ. An example of such speed correction table is provided in TABLE 13 below.

TABLE 13

| TEMPERATURE DETECTED | CORRECTION VARIABLE γ |
|---|---|
| t1 < 55° C. | −1% |
| t1 ≥ 55° C. | 0 |

According to the speed correction table, the output rotational speed F is decreased from the reference value Fref by a correction rate of −1% where the first temperature t1 detected falls below a reference temperature of 55° C., and is maintained at the original speed Fref where the first temperature t1 detected equals or exceeds the reference temperature.

Figure 20:
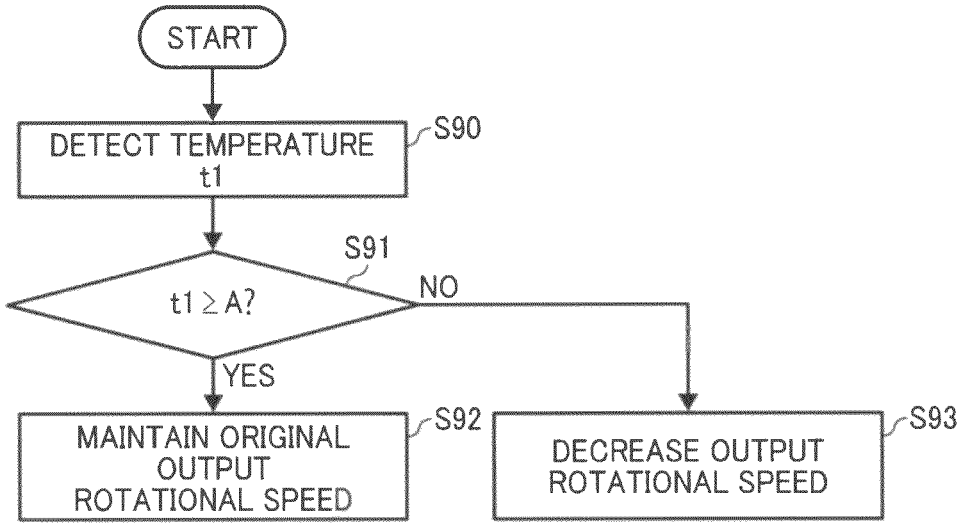
FIG. 20 is a flowchart illustrating an example of rotational speed adjustment performed by the image forming apparatus according to a ninth embodiment of this patent specification.

FIG. 20 is a flowchart illustrating an example of rotational speed adjustment performed by the image forming apparatus 1 based on the correction table represented in TABLE 13.

As shown in FIG. 20, initially, the first thermistor T1 detects a first temperature t1 at the metal core 29 of the fuser roller 22 upon entry of a recording sheet S in the sheet conveyance path P (step S90).

Then, the controller 100 determines whether the detected temperature t1 exceeds a reference temperature A of, for example, 55° C. (step S91).

Where the detected temperature t1 equals or exceeds the reference temperature A, indicating that the speed differential V1−V2 falls within the acceptable range ("YES" at step S91), the controller 100 sets the correction rate γ to 0 so as to maintain the output rotational speed F at the original, reference value Fref (step S92).

Where the detected temperature t1 falls below the reference temperature A, indicating that the speed differential V1−V2 exceeds the acceptable range ("NO" at step S91), the controller 100 sets the correction rate γ to a given negative value, so as to decrease the output rotational speed F from the original, reference value Fref (step S93).

With the rotational speed F thus decreased where the first temperature t1 falls below the reference temperature A, the resulting circumferential speed V2 of the output roller pair 27 remains substantially constant relative to the circumferential speed V1 of the fuser roller 22, so that the speed differential V1−V2 remains within a desired, appropriate range.

Hence, the image forming apparatus 1 according to the ninth embodiment of this patent specification can maintain the differential speed V1−V2 along the sheet conveyance path P within a sufficiently narrow, acceptable range so as to ensure good imaging quality as well as proper sheet conveyance performance along the sheet conveyance path P, in which the controller 100 adjusts the rotational speed F of the output rotary drive 70 depending on the temperature t1 detected at the cylindrical core 29 of the fuser roller 22 (e.g., decreases the output rotational speed F upon detecting a relatively low first temperature t1 indicating that the fuser roller 22 contracts in diameter to yield a relatively slow circumferential speed), so that the output roller pair 27 can rotate with a substantially constant circumferential speed V2 relative to the circumferential speed V1 of the fuser roller 22 regardless of variations in the operating temperature causing thermal expansion or contraction of the elastic material, even where the fuser roller is configured as a thick rubber-coated, metal-cored cylindrical body with no dedicated heater provided therein.

In further embodiment, the image forming apparatus 1 may perform rotational speed adjustment on the output roller based not only on the first temperature t1 but also on the second and third temperatures t2 and t3, or on any combination of such detected temperatures. Compared to adjustment based only on the first temperature t1, which tends to change rapidly relative to the speed differential V1−V2, using a combination of multiple temperatures allows the controller 100 to more accurately determine the operating condition, so as to more properly correct the rotational speed of the output rotary drive 70 according to thermal expansion or contraction experienced by the fuser roller 22. Several such embodiments are described below with reference to FIG. 21 and subsequent drawings.

Figure 21:
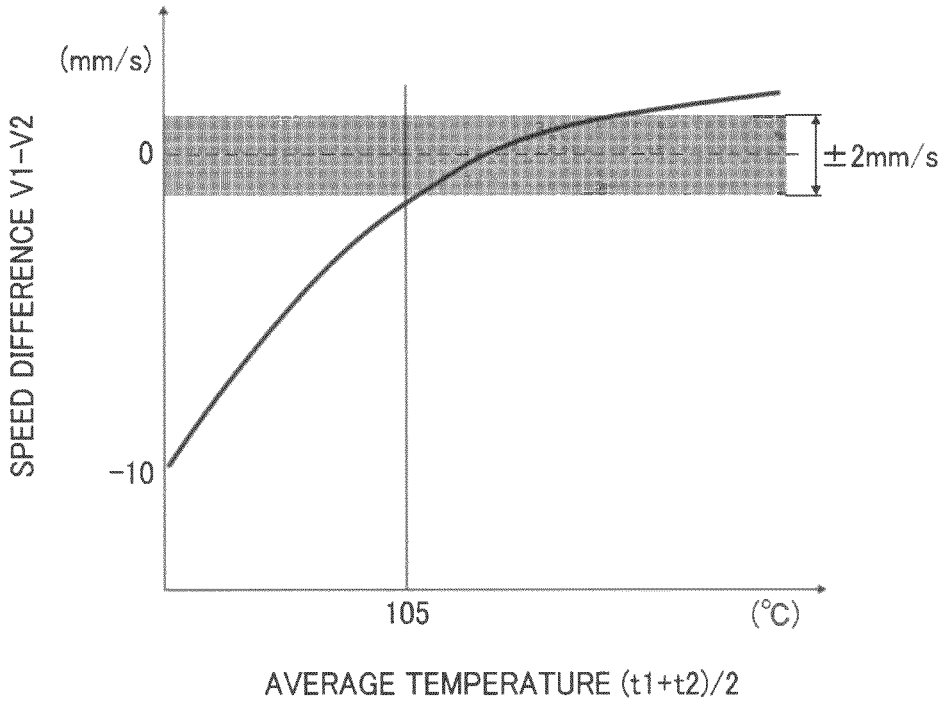
FIG. 21 is a graph showing a speed differential between fixing and output rollers plotted against an average of first and second temperatures experimentally measured in the fixing device of FIG. 18.

FIG. 21 is a graph showing the speed differential V1−V2 in millimeters per second (mm/s) between the fixing and output rollers 22 and 27, plotted against an average of the first and second temperatures t1 and t2 in degrees Celsius (° C.), the former detected at the metal core 29 of the fuser roller 22 driven with a fixed rotational speed, and the latter on the fuser belt 24 along the circumference of the heat roller 23.

As shown in FIG. 13, where the average temperature (t1+t2)/2 remains low, the first conveyance speed V1 is significantly lower than the second conveyance speed V2 so that the speed differential V1−V2 is relatively large in absolute value. As the average temperature (t1+t2)/2 increases, causing the fuser roller 22 to thermally expand, the speed differential V1−V2 reduces toward a desired point of 0 mm/s. The speed differential V1−V2 reaches an acceptable range from −2 mm/s to 2 mm/s (indicated by shading in the graph) where the average temperature (t1+t2)/2 equals or exceeds a lower limit of approximately 105° C.

In a tenth embodiment, the controller 100 adjusts the rotational speed F of the rotary drive 70 of the output unit 27 according to the average of the first and second temperatures t1 and t2 detected by the first and second thermistors T1 and T2, respectively, upon entry of a recording sheet S in the sheet conveyance path P, so as to correct and maintain the circumferential speed V2 of the output roller pair 27 substantially constant relative to the circumferential speed V1 of the fuser roller 22 regardless of the diameter of the fuser roller 22 varying with temperature.

As is the case with the ninth embodiment depicted earlier, such rotational speed adjustment may be performed, for example, by correcting an original, reference rotational speed Fref of the rotary drive 70 of the output unit 27 with a correction variable γ dependent on the average of the first and second temperatures t1 and t2 detected.

In the present embodiment, the controller 100 includes a predefined table or list of correction variables γ for rotational speed adjustment, stored in an appropriate memory such as ROM or the like, which contains ranges of average temperature (t1+t2)/2 each associated with a specific correction variable γ. An example of such speed correction table is provided in TABLE 14 below.

TABLE 14

| TEMPERATURE DETECTED | CORRECTION VARIABLE γ |
|---|---|
| (t1 + t2)/2 < 105° C. | −1% |
| (t1 + t2)/2 ≥ 105° C. | 0 |

According to the speed correction table, the output rotational speed F is decreased from the reference value Fref by a correction rate of −1% where the average temperature (t1+t2)/2 detected falls below a reference temperature of 105° C., and is maintained at the original speed Fref where the average temperature (t1+t2)/2 detected equals or exceeds the reference temperature.

Figure 22:
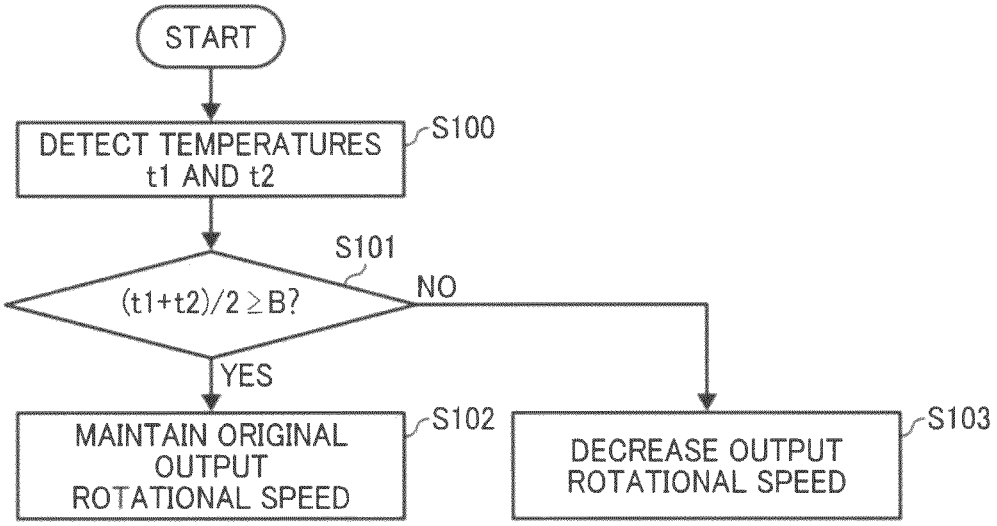
FIG. 22 is a flowchart illustrating an example of rotational speed adjustment performed by the image forming apparatus according to a tenth embodiment of this patent specification.

FIG. 22 is a flowchart illustrating an example of rotational speed adjustment performed by the image forming apparatus 1 based on the correction table represented in TABLE 14.

As shown in FIG. 22, initially, the first and second thermistors T1 and T2 detect first and second temperatures t1 and t2, respectively, the former at the metal core 29 of the fuser roller 22, and the latter on the fuser belt 24 along the circumference of the heat roller 23, upon entry of a recording sheet S in the sheet conveyance path P (step S100).

Then, the controller 100 determines whether the average of the detected temperatures (t1+t2)/2 exceeds a reference temperature B of, for example, 105° C. (step S101).

Where the detected average temperature (t1+t2)/2 equals or exceeds the reference temperature B, indicating that the speed differential V1−V2 falls within the acceptable range ("YES" at step S101), the controller 100 sets the correction rate γ to 0 so as to maintain the output rotational speed F at the original, reference value Fref (step S102).

Where the detected average temperature (t1+t2)/2 falls below the reference temperature B, indicating that the speed differential V1−V2 exceeds the acceptable range ("NO" at step S101), the controller 100 sets the correction rate γ to a given negative value, so as to decrease the output rotational speed F from the original, reference value Fref (step S103).

With the output rotational speed F thus decreased where the average of the first and second temperatures t1 and t2 falls below the reference temperature B, the resulting circumferential speed V2 of the output roller pair 27 remains substantially constant relative to the circumferential speed V1 of the fuser roller 22, so that the speed differential V1−V2 remains within a desired, appropriate range.

Hence, the image forming apparatus 1 according to the tenth embodiment of this patent specification can maintain the differential speed V1−V2 along the sheet conveyance path P within a sufficiently narrow, acceptable range so as to ensure good imaging quality as well as proper sheet conveyance performance along the sheet conveyance path P, in which the controller 100 adjusts the rotational speed F of the output rotary drive 70 depending on the temperature t1 detected at the cylindrical core 29 of the fuser roller 22 as well as the temperature t2 detected on the fuser belt 24 along the circumference of the heat roller 23, so that the output roller pair 27 can rotate with a substantially constant circumferential speed V2 relative to the circumferential speed V1 of the fuser roller 22 regardless of variations in the operating temperature causing thermal expansion or contraction of the elastic material.

Compared to the ninth embodiment, such rotational speed adjustment can more accurately estimate variations in the conveyance speed due to dimensional variations of the thermally expansive, elastic roller 22, wherein the average of the first and second temperatures t1 and t2 more precisely indicates an operating temperature of the outer elastic layer than the first temperature t1 alone.

Figure 23:
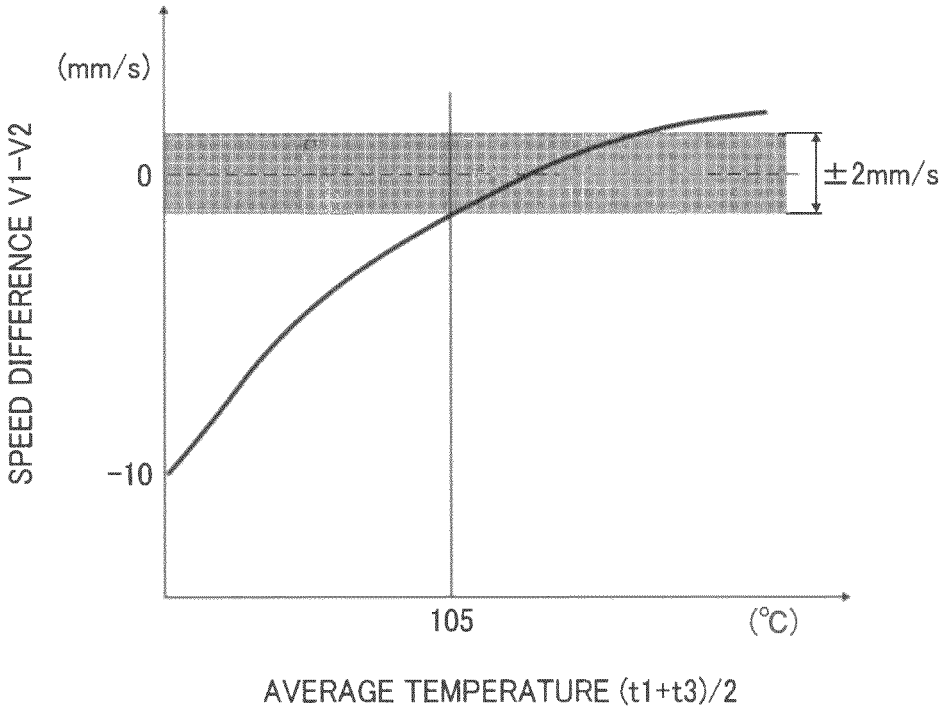
FIG. 23 is a graph showing a speed differential between fixing and output rollers plotted against an average of first and third temperatures experimentally measured in the fixing device of FIG. 18.

FIG. 23 is a graph showing the speed differential V1−V2 in millimeters per second (mm/s) between the fixing and output rollers 22 and 27, plotted against an average of the first and third temperatures t1 and t3 in degrees Celsius (° C.), the former detected at the metal core 29 of the fuser roller 22 driven with a fixed rotational speed, and the latter on the fuser belt 24 along the circumference of the fuser roller 22.

As shown in FIG. 23, where the average temperature (t1+t3)/2 remains low, the first conveyance speed V1 is significantly lower than the second conveyance speed V2 so that the speed differential V1−V2 is relatively large in absolute value. As the average temperature (t1+t3)/2 increases, causing the fuser roller 22 to thermally expand, the speed differential V1−V2 reduces toward a desired point of 0 mm/s. The speed differential V1−V2 reaches an acceptable range from −2 mm/s to 2 mm/s (indicated by shading in the graph) where the average temperature (t1+t3)/2 equals or exceeds a lower limit of approximately 105° C.

In an eleventh embodiment, the controller 100 adjusts the rotational speed F of the rotary drive 70 of the output unit 27 according to the average of the first and third temperatures t1 and t3 detected by the first and third thermistors T1 and T3, respectively, upon entry of a recording sheet S in the sheet conveyance path P, so as to correct and maintain the circumferential speed V2 of the output roller pair 27 substantially constant relative to the circumferential speed V1 of the fuser roller 22 regardless of the diameter of the fuser roller 22 varying with temperature.

As is the case with the ninth embodiment depicted earlier, such rotational speed adjustment may be performed, for example, by correcting an original, reference rotational speed Fref of the output rotary drive 70 with a correction variable γ dependent on the average of the first and third temperatures t1 and t3 detected.

In the present embodiment, the controller 100 includes a predefined table or list of correction variables γ for rotational speed adjustment, stored in an appropriate memory such as ROM or the like, which contains ranges of average temperature (t1+t3)/2 each associated with a specific correction variable γ. An example of such speed correction table is provided in TABLE 15 below.

TABLE 15

| TEMPERATURE DETECTED | CORRECTION VARIABLE γ |
|---|---|
| (t1 + t3)/2 < 105° C. | −1% |
| (t1 + t3)/2 ≥ 105° C. | 0 |

According to the speed correction table, the output rotational speed F is decreased from the reference value Fref by a correction rate of −1% where the average temperature (t1+t3)/2 detected falls below a reference temperature of 105° C., and is maintained at the original speed Fref where the average temperature (t1+t3)/2 detected equals or exceeds the reference temperature.

Figure 24:
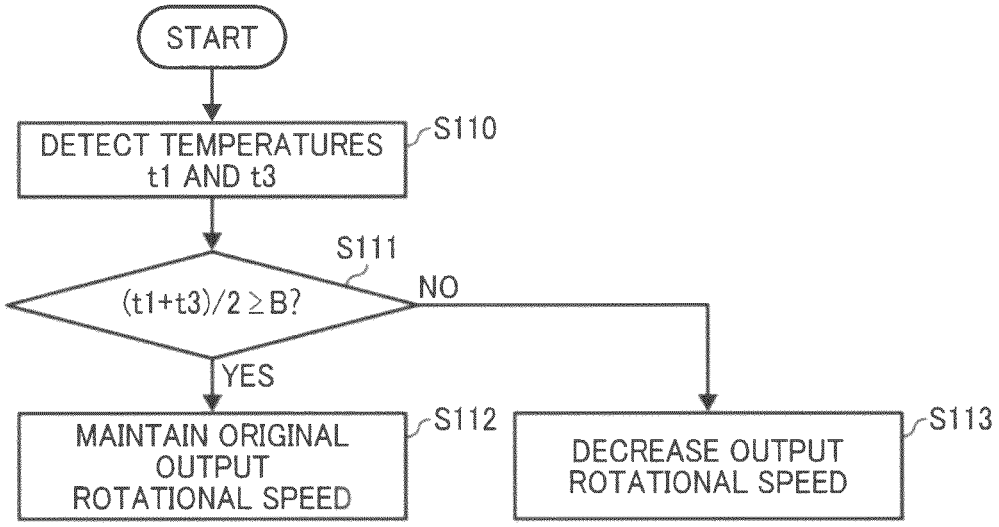
FIG. 24 is a flowchart illustrating an example of rotational speed adjustment performed by the image forming apparatus according to an eleventh embodiment of this patent specification.

FIG. 24 is a flowchart illustrating an example of rotational speed adjustment performed by the image forming apparatus 1 based on the correction table represented in TABLE 15.

As shown in FIG. 24, initially, the first and third thermistors T1 and T3 detect first and second temperatures t1 and t3, respectively, the former at the metal core 29 of the fuser roller 22, and the latter on the fuser belt 24 along the circumference of the fuser roller 22, upon entry of a recording sheet S in the sheet conveyance path P (step S110).

Then, the controller 100 determines whether the average of the detected temperatures (t1+t3)/2 exceeds a reference temperature B of, for example, 105° C. (step S111).

Where the detected average temperature (t1+t3)/2 equals or exceeds the reference temperature B, indicating that the speed differential V1−V2 falls within the acceptable range ("YES" at step S111), the controller 100 sets the correction rate γ to 0 so as to maintain the output rotational speed F at the original, reference value Fref (step S112).

Where the detected average temperature (t1+t3)/2 falls below the reference temperature B, indicating that the speed differential V1−V2 exceeds the acceptable range ("NO" at step S111), the controller 100 sets the correction rate γ to a given negative value, so as to decrease the output rotational speed F from the original, reference value Fref (step S113).

With the output rotational speed F thus decreased where the average of the first and third temperatures t1 and t3 falls below the reference temperature B, the resulting circumferential speed V2 of the output roller pair 27 remains substantially constant relative to the circumferential speed V1 of the fuser roller 22, so that the speed differential V1−V2 remains within a desired, appropriate range.

Hence, the image forming apparatus 1 according to the seventh embodiment of this patent specification can maintain the differential speed V1−V2 along the sheet conveyance path P within a sufficiently narrow, acceptable range so as to ensure good imaging quality as well as proper sheet conveyance performance along the sheet conveyance path P, in which the controller 100 adjusts the rotational speed F of the output rotary drive 70 depending on the temperature t1 detected at the cylindrical core 29 of the fuser roller 22 as well as the temperature t3 detected on the fuser belt 24 along the circumference of the fuser roller 22, so that the output roller pair 27 can rotate with a substantially constant circumferential speed V2 relative to the circumferential speed V1 of the fuser roller 22.

Compared to the ninth embodiment, such rotational speed adjustment can more accurately estimate variations in the conveyance speed due to dimensional variations of the thermally expansive, elastic roller 22, wherein the temperature t3 detected at the circumference of the fuser roller 22 more precisely indicates an operating temperature of the outer elastic layer than the temperature t1 detected at the metal core 29 of the fuser roller 22.

Although in several embodiments depicted above the controller 100 controls sheet conveyance speed by decreasing the output rotational speed F from the original, reference value Fref where the detected temperature equals or exceeds a relatively low reference temperature indicative of a reduction in the first conveyance speed V1, such rotational speed adjustment may also be performed by increasing the output rotational speed F from the original, reference value Fref where the detected temperature equals or exceeds a relatively high reference temperature indicative of an increase in the first conveyance speed V1.

As mentioned above with reference to FIG. 19, the speed differential V1−V2 reaches the acceptable range of ±2 mm/s as the roller temperature t1 equals or exceeds a lower limit of approximately 55° C. As the roller temperature t1 rises, causing further thermal expansion of the fuser roller 22 and concomitant increase in the circumferential speed V1, the speed differential V1−V2 reaches the desired point of 0 mm/s, and again exceeds the acceptable range where the roller temperature t1 exceeds an upper limit of approximately 95° C.

In a twelfth embodiment, the controller 100 adjusts the rotational speed F of the rotary drive 70 of the output unit 27 from an original, reference rotational speed Fref with a variable amount of correction γ dependent on the first temperature t1 as well as the third temperature t3. Unlike the foregoing embodiments, the controller 100 increases, instead of decreasing, the output rotational speed F from the original rotational speed Fref where the detected temperature equals or exceeds a given reference temperature.

In the present embodiment, the controller 100 includes a predefined table or list of correction variables γ for rotational speed adjustment, stored in an appropriate memory such as ROM or the like, which contains ranges of the first temperature t1 as well as the average of the first and third temperatures (t1+t3)/2 each associated with a specific correction variable γ. An example of such speed correction table is provided in TABLE 16 below.

TABLE 16

| TEMPERATURE DETECTED | CORRECTION VARIABLE γ |
|---|---|
| t1 < 95° C. | 0 |
| t1 ≥ 95° C. | 1% |
| (t1 + t3)/2 < 105° C. | −1% |
| (t1 + t3)/2 ≥ 105° C. | 0 |

According to the speed correction table, the output rotational speed F is increased from the reference value Fref by a correction rate of 1% where the first temperature t1 equals or exceeds a first reference temperature of 95° C., and is decreased from the reference value Fref by a correction rate of −1% where the average temperature (t1+t3)/2 falls below a second reference temperature of 105° C. The output rotational speed F is maintained at the original speed Fref where the first temperature t1 detected falls below the first reference temperature, or where the average temperature (t1+t3)/2 equals or exceeds the second reference temperature.

Figure 25:
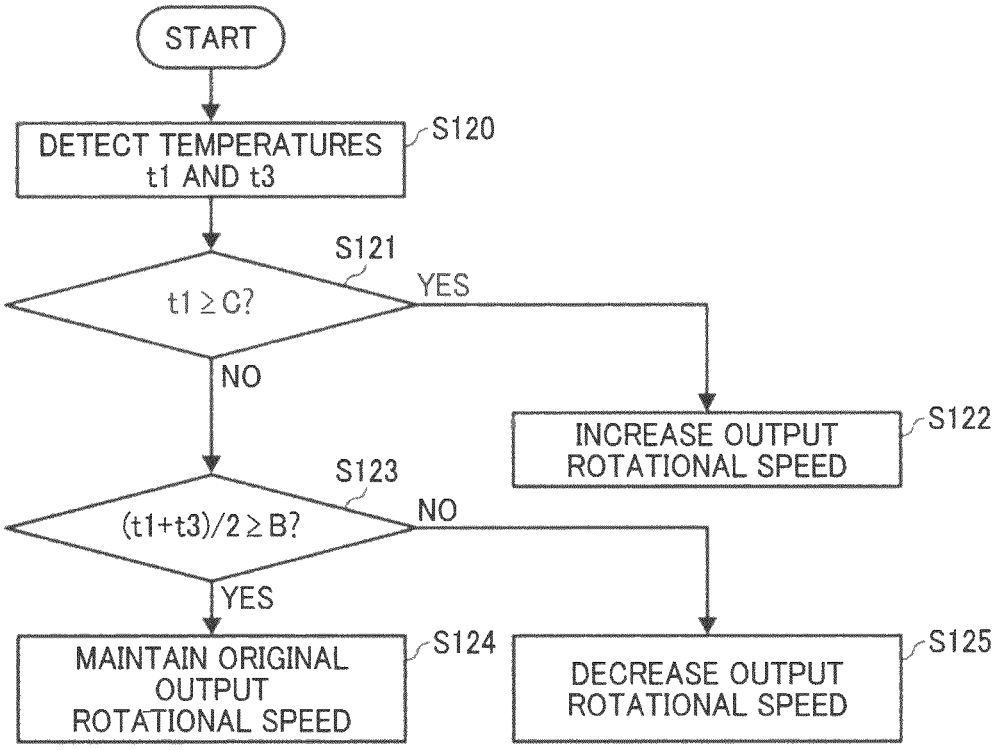
FIG. 25 is a flowchart illustrating an example of rotational speed adjustment performed by the image forming apparatus according to a twelfth embodiment of this patent specification.

FIG. 25 is a flowchart illustrating an example of rotational speed adjustment performed by the image forming apparatus 1 based on the correction table represented in TABLE 16.

As shown in FIG. 25, initially, the first and third thermistors T1 and T3 detect first and second temperatures t1 and t3, respectively, the former at the metal core 29 of the fuser roller 22, and the latter on the fuser belt 24 along the circumference of the fuser roller 22, upon entry of a recording sheet S in the sheet conveyance path P (step S120).

Then, the controller 100 determines whether the detected temperature t1 exceeds a first reference temperature C of, for example, 95° C. (step S121).

Where the detected temperature t1 equals or exceeds the reference temperature C, indicating that the speed differential V1−V2 exceeds the acceptable range ("YES" at step S121), the controller 100 sets the correction rate γ to a given positive value, so as to increase the output rotational speed F from the original, reference value Fref (step S122).

Where the detected temperature t1 falls below the reference temperature C ("NO" at step S121), the controller 100 then determines whether the average of the detected temperatures (t1+t3)/2 exceeds a second reference temperature B of, for example, 105° C. (step S123).

Where the detected average temperature (t1+t3)/2 equals or exceeds the reference temperature B, indicating that the speed differential V1−V2 falls within the acceptable range ("YES" at step S123), the controller 100 sets the correction rate γ to 0 so as to maintain the output rotational speed F at the original, reference value Fref (step S124).

Where the detected average temperature (t1+t3)/2 falls below the reference temperature B, indicating that the speed differential V1−V2 exceeds the acceptable range ("NO" at step S123), the controller 100 sets the correction rate γ to a given negative value, so as to decrease the output rotational speed F from the original, reference value Fref (step S125).

With the output rotational speed F thus increased where the first temperature t1 exceeds the reference temperature C and decreased where the average of the first and third temperatures t1 and t3 falls below the reference temperature B, the resulting circumferential speed V2 of the output roller pair 27 remains substantially constant relative to the circumferential speed V1 of the fuser roller 22, so that the speed differential V1−V2 remains within a desired, appropriate range.

Although the embodiment depicted in FIG. 25 controls sheet conveyance speed based on the combination of first and third temperatures t1 and t3, alternatively, instead, it is possible to determine whether to maintain the original rotational speed based on the combination of first and second temperatures t1 and t2. Moreover, although the present embodiment uses the first temperature t1 to determine whether to decrease the rotational speed, alternatively, instead, it is possible to base such determination upon either the average of the first and third temperatures (t1+t3)/2 or the average of the first and second temperatures (t1+t2)/2 with an appropriate reference temperature.

Hence, the image forming apparatus 1 according to the twelfth embodiment of this patent specification can maintain the differential speed V1−V2 along the sheet conveyance path P within a sufficiently narrow, acceptable range so as to ensure good imaging quality as well as proper sheet conveyance performance along the sheet conveyance path P, in which the controller 100 adjusts the rotational speed F of the output rotary drive 70 depending on the temperature t1 detected at the cylindrical core 29 of the fuser roller 22 as well as the temperature t3 detected on the fuser belt 24 along the circumference of the fuser roller 22, so that the output roller pair 27 can rotate with a substantially constant circumferential speed V2 relative to the circumferential speed V1 of the fuser roller 22.

Compared to the foregoing embodiments, such rotational speed adjustment can more reliably maintain the differential speed V1−V2 within an appropriate range, wherein the controller 100 not only decreases the output rotational speed F upon detecting a relatively low operating temperature indicating that the fuser roller 22 contracts in diameter to yield a relatively slow circumferential speed, but also increases the output rotational speed F upon detecting a relatively high operating temperature indicating that the fuser roller 22 expands in diameter to yield a relatively fast circumferential speed.

In the ninth through twelfth embodiments depicted above, the image forming apparatus 1 may gradually reset or restore the corrected rotational speed F of the rotary drive 70 of the output unit 27 to the original, reference speed Fref, where the fixing device 20 successively processes an increased number of recording sheets S for an extended period of time, during which the fuser roller 22 gradually heats to a designed operating temperature, so that the differential speed V1−V2 falls within an appropriate, acceptable range.

Specifically, for example, the controller 100 may gradually restore the correction variable γ to zero as the number of recording sheets S processed through the fixing nip N increases since activation of the fixing process. In such cases, rotational speed adjustment on the output roller is based on a correction table that contains counts of recording sheet each associated with a specific correction variable γ. An example of such speed correction table is provided in TABLE 17 below.

TABLE 17

| NUMBER OF SHEETS PROCESSED | CORRECTION VARIABLE γ |
|---|---|
| 0-500 | −1.0% |
| 501-1000 | −0.5% |
| 1001- | 0 |

Alternatively, the controller 100 may gradually restore the correction variable γ to zero as the elapsed time, instead of the number of recording sheets, increases since activation of the fixing process. In such cases, rotational speed adjustment on the output roller is based on a correction table that contains ranges of elapsed time each associated with a specific correction variable γ. An example of such speed correction table is provided in TABLE 18 below.

TABLE 18

| TIME ELAPSED (sec) | CORRECTION VARIABLE γ |
|---|---|
| 0-300 | −1.0% |
| 301-600 | −0.5% |
| 601- | 0 |

Figure 26:
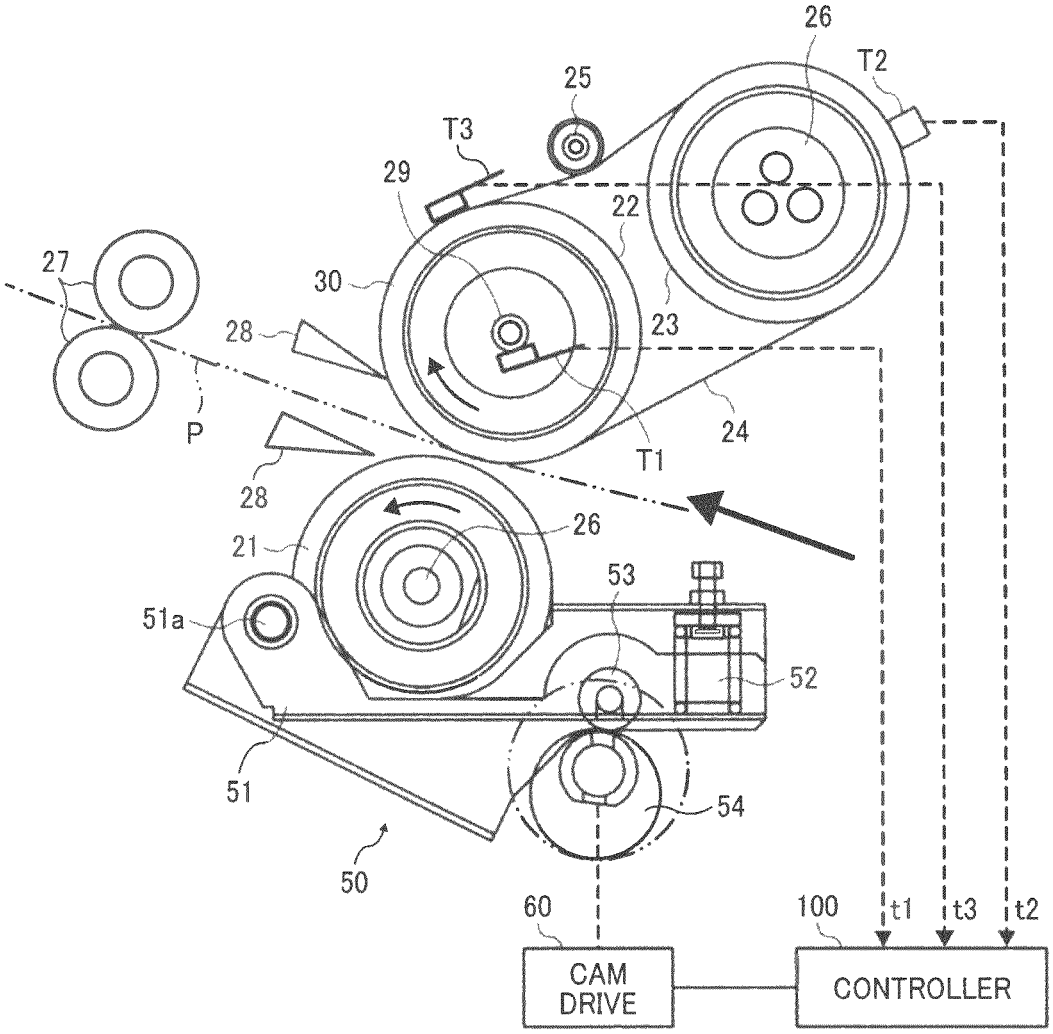
FIG. 26 is an end-on, axial cutaway view schematically illustrating the fixing device according to one or more further embodiments of this patent specification.

FIG. 26 is an end-on, axial cutaway view schematically illustrating the fixing device 20 according to one or more further embodiments of this patent specification.

As shown in FIG. 26, the fixing device 20 in the present embodiment is similar to that depicted primarily with reference to FIG. 2, except that the controller 100 includes, or is operatively connected with a rotary cam drive 60 to control the adjustable biasing mechanism 50 pressing the pressure roller 21 against the fuser roller 22.

Specifically, the adjustable biasing mechanism 50 includes a pressure lever 51 engaging a rotational shaft of the pressure roller 21, having one end hinged at a rotational axis 51*a*, and another, free end loaded with a spring 52 forcing the lever 51 in a direction so as to retract the pressure roller 21 away from the fuser belt 24. Interposed between the two ends of the pressure lever 51 is a cam 54 engaging the lever 51 via an intermediate skid 53, which can rotate around a rotational axis thereof when driven by the rotary drive 60. The cam drive 60 comprises a DC motor connected to the cam axis via a reduction gear train.

During operation, the fixing device 20 operates in a manner similar to that depicted with reference to FIG. 2, wherein the motor-driven fuser roller 22 rotates in a given rotational direction (i.e., clockwise in the drawing), so as to rotate the heated belt 24 with a linear, first conveyance speed V1 along its circumference, which in turn rotates the pressure roller 21 in a given rotational direction (i.e., counterclockwise in the drawing) with the same circumferential speed as that of the fuser roller 22.

In this state, a recording sheet S bearing an unfixed, powder toner image T enters the fixing device 20 along a sheet guide defining the sheet conveyance path P. As the rotary fixing members rotate together, the recording sheet S is passed through the fixing nip N to fix the toner image in place, wherein heat from the fuser belt 24 causes toner particles to fuse and melt, while pressure from the pressure roller 21 causes the molten toner to settle onto the sheet surface.

At the exit of the fixing nip N, the recording sheet S has its leading edge stripped from the rotary members by the associated sheet strippers 28, which then proceeds to the output roller pair 27 forwarding the incoming sheet S with a linear, second conveyance speed V2, and finally enters the output tray 18 from the sheet conveyance path P.

The adjustable biasing mechanism 50 presses the pressure roller 21 against the fuser roller 22 to establish the fixing nip N with a variable length and strength, wherein the rotary cam drive 60 rotates the cam 54 to a variable rotational position, which causes the lever 51 to swivel around the hinge 51*a* to in turn move the pressure roller 21 relative to the cylindrical axis of fuser roller 22, resulting in a variable nip pressure with which the pressure roller 21 is pressed against the fuser roller 22.

In such a configuration, the conveyance speed V1 along the circumference of the fuser roller 22 is influenced by variations in processing temperature which cause the elastic material of the fuser roller 22 to thermally expand and contract, resulting in dimensional variations in the fixing nip N. On the other hand, the conveyance speed V2 along the circumference of the output roller pair 27, typically formed of thin rubber-covered roller pairs, is substantially immune to variations in processing temperature.

Where the second conveyance speed V2 along the output roller pair 27 remains substantially constant, variations in the conveyance speed V1 translate into variations in a difference V1−V2 between the first and second conveyance speeds V1 and V2. If not corrected, such variations in the speed differential V1−V2 can affect imaging quality as well as sheet conveyance performance downstream from the fixing nip N along the sheet conveyance path P.

Figure 27:
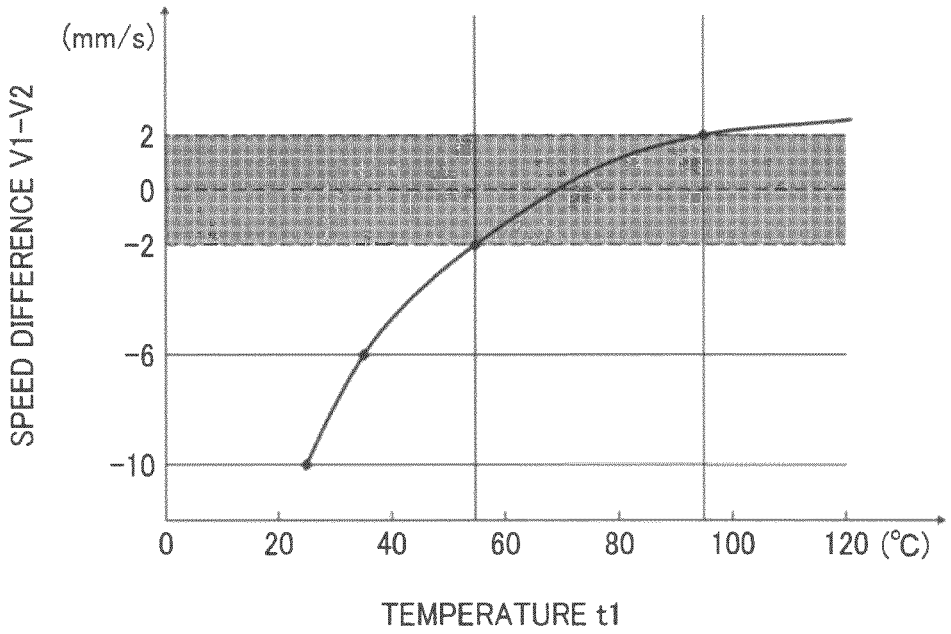
FIG. 27 is a graph showing a speed differential between fixing and output rollers plotted against a first temperature experimentally measured in the fixing device of FIG. 26.

FIG. 27 is a graph showing the speed differential V1−V2 in millimeters per second (mm/s) between the fixing and output rollers 22 and 27, plotted against the first temperature t1 in degrees Celsius (° C.) detected at the metal core 29 of the fuser roller 22 driven with a fixed rotational speed.

As shown in FIG. 27, where the roller temperature t1 remains low, the first conveyance speed V1 is significantly lower than the second conveyance speed V2 so that the speed differential V1−V2 is relatively large in absolute value, for example, reaching approximately −10 mm/s at a roller temperature t1 of approximately 25° C. As the roller temperature t1 increases, causing the fuser roller 22 to thermally expand, the speed differential V1−V2 reduces toward a desired point of 0 mm/s. The speed differential V1−V2 remains within an acceptable range from −2 mm/s to 2 mm/s (indicated by shading in the graph) as long as the roller temperature t1 equals or exceeds a lower limit of approximately 55° C. and falls below an upper limit of approximately 95° C.

In general, a failure to keep the speed differential within a specified acceptable range (e.g., ±2 mm/s in the present embodiment) can cause various adverse effects on imaging and sheet conveyance performance of the image forming apparatus.

For example, a negative speed differential V1−V2 of approximately −2 mm/s or below, indicating that the fixing roller pair processes a recording sheet with a conveyance speed significantly slower than that of the output roller pair, can adversely affect imaging quality, in which the recording sheet, advanced faster at its downstream, leading edge than at its upstream, trailing edge, rubs or strikes against a sheet stripper or a similar guide mechanism, thereby causing image defects during conveyance from the fixing nip N to the output unit.

On the other hand, a positive speed differential V1−V2 of approximately 2 mm/s or larger, indicating that the fixing roller pair processes a recording sheet with a conveyance speed significantly faster than that of the output roller pair, can adversely affect conveyance of a recording sheet, in which the recording sheet, advanced faster at its upstream, trailing edge than at its downstream, leading edge, slacks into a bow which then creates accordion-like folds to jam the sheet conveyance path from the fixing nip N to the output unit.

According to this patent specification, the image forming apparatus 1 controls conveyance of the recording sheet S through the fixing nip N1 by adjusting nip pressure depending on the operating temperature detected upon entry of the recording sheet S in the sheet conveyance path P, so as to maintain a difference V1−V2 between the first and second conveyance speeds V1 and V2 within a specified acceptable range, thereby preventing adverse effects caused by variations in the speed differential V1−V2 along the sheet conveyance path P.

Specifically, in a thirteenth embodiment, the controller 100 adjusts nip pressure according to the first temperature t1 detected by the first thermistor T1 upon entry of a recording sheet S in the sheet conveyance path P, so as to correct and maintain the circumferential speed V1 of the fuser roller 22 at a substantially constant speed regardless of the diameter of the fuser roller 22 varying with temperature.

More specifically, the controller 100 controls the biasing mechanism 50 of the pressure roller 21 by the cam drive 60 to adjust or optimize pressure at the fixing nip N depending on the first temperature t1 being detected. Such adjustment on the nip pressure is based on the fact that varying nip pressure varies an amount of deformation experienced by the fuser roller 22 at the fixing nip N (i.e., the degree to which the fuser roller 22 under nip pressure deforms from its original, true cylindrical shape, causing an apparent increase in its cylindrical diameter), so that the circumferential speed of the fuser roller 22 changes from a nominal conveyance speed that may be obtained under condition of "true rolling".

Thus, the controller 100 may accelerate the conveyance speed along the circumference of the fuser roller 22 by increasing the nip pressure so that the roller 22 experiences an increased amount of deformation and hence apparently enlarges in diameter. Contrarily, the controller 100 may decelerate the conveyance speed along the circumference of the fuser roller 22 by decreasing the nip pressure so that the roller 22 experiences a decreased amount of deformation and hence apparently reduces in diameter.

Such nip pressure adjustment may be performed, for example, by switching the nip pressure between multiple switchable levels, including a first level po being a rated original pressure, a second level p+ higher than the original pressure, and a third level p− lower than the original pressure, depending on the first temperature t1 detected. For more precise control, it is possible to switch the nip pressure to more than three switchable levels, or alternatively, to gradually or continuously change the nip pressure according to the operating temperature being detected.

Figure 28:
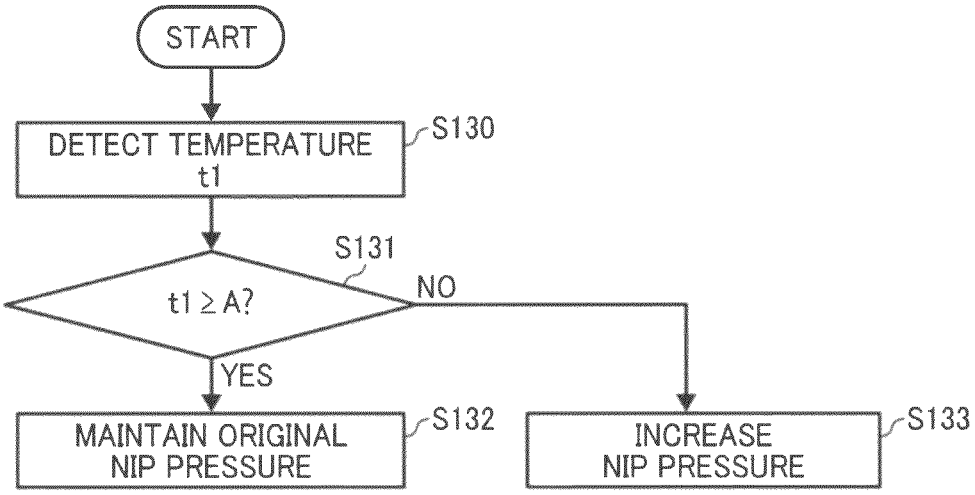
FIG. 28 is a flowchart illustrating an example of nip pressure adjustment performed by the image forming apparatus according to thirteenth embodiment of this patent specification.

FIG. 28 is a flowchart illustrating an example of nip pressure adjustment performed by the image forming apparatus 1.

As shown in FIG. 28, initially, the first thermistor T1 detects a first temperature t1 at the metal core 29 of the fuser roller 22 upon entry of a recording sheet S in the sheet conveyance path P (step S130).

Then, the controller 100 determines whether the detected temperature t1 exceeds a reference temperature A of, for example, 55° C. (step S131).

Where the detected temperature t1 equals or exceeds the reference temperature A, indicating that the speed differential V1−V2 falls within the acceptable range ("YES" at step S131), the controller 100 sets the nip pressure to the original, first level po, so as to process the incoming sheet S through the fixing nip N without changing the first conveyance speed V1 (step S132).

Where the detected temperature t1 falls below the reference temperature A, indicating that the speed differential V1−V2 exceeds the acceptable range ("NO" at step S131), the controller 100 sets the nip pressure to the relatively high, second level p+, so as to increase the first conveyance speed V1 for processing the incoming sheet S through the fixing nip N (step S133).

With the nip pressure thus increased where the first temperature t1 falls below the reference temperature A, the resulting circumferential speed V1 of the fuser roller 22 remains substantially constant relative to the fixed circumferential speed V2 of the output roller pair 27, so that the speed differential V1−V2 remains within a desired, appropriate range.

Hence, the image forming apparatus 1 according to the thirteenth embodiment of this patent specification can maintain the differential speed V1−V2 along the sheet conveyance path P within a sufficiently narrow, acceptable range so as to ensure good imaging quality as well as proper sheet conveyance performance along the sheet conveyance path P, in which the controller 100 adjusts or optimizes nip pressure depending on the temperature t1 detected at the cylindrical core 29 of the fuser roller 22 (e.g., increases nip pressure upon detecting a relatively low first temperature t1 indicating that the fuser roller 22 contracts in diameter to yield a relatively slow circumferential speed), so that the fuser roller 22 can rotate with a substantially constant circumferential speed V1 regardless of variations in the operating temperature causing thermal expansion or contraction of the elastic material, even where the fuser roller is configured as a thick rubber-coated, metal-cored cylindrical body with no dedicated heater provided therein.

In further embodiment, the image forming apparatus 1 may perform nip pressure adjustment based not only on the first temperature t1 but also on the second and third temperatures t2 and t3, or on any combination of such detected temperatures. Compared to adjustment based only on the first temperature t1, which tends to change rapidly relative to the speed differential V1−V2, using a combination of multiple temperatures allows the controller 100 to more accurately determine the operating condition, so as to more properly optimize nip pressure according to thermal expansion or contraction experienced by the fuser roller 22. Several such embodiments are described below with reference to FIG. 29 and subsequent drawings.

Figure 29:
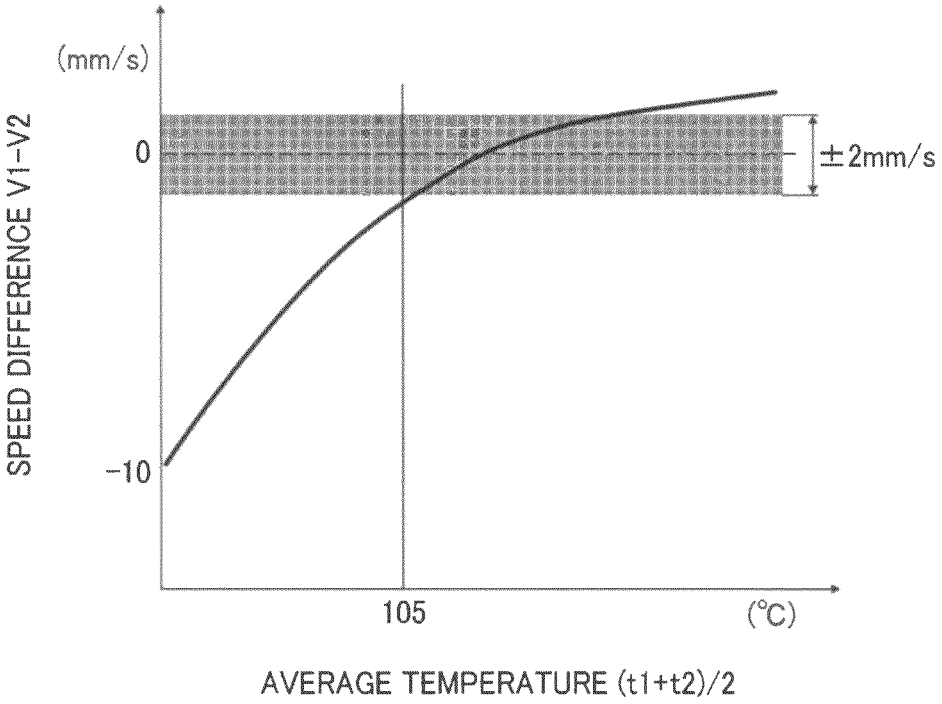
FIG. 29 is a graph showing a speed differential between fixing and output rollers plotted against an average of first and second temperatures experimentally measured in the fixing device of FIG. 26.

FIG. 29 is a graph showing the speed differential V1−V2 in millimeters per second (mm/s) between the fixing and output rollers 22 and 27, plotted against an average of the first and second temperatures t1 and t2 in degrees Celsius (° C.), the former detected at the metal core 29 of the fuser roller 22 driven with a fixed rotational speed, and the latter on the fuser belt 24 along the circumference of the heat roller 23.

As shown in FIG. 29, where the average temperature (t1+t2)/2 remains low, the first conveyance speed V1 is significantly lower than the second conveyance speed V2 so that the speed differential V1−V2 is relatively large in absolute value. As the average temperature (t1+t2)/2 increases, causing the fuser roller 22 to thermally expand, the speed differential V1−V2 reduces toward a desired point of 0 mm/s. The speed differential V1−V2 reaches an acceptable range from −2 mm/s to 2 mm/s (indicated by shading in the graph) where the average temperature (t1+t2)/2 equals or exceeds a lower limit of approximately 105° C.

In a fourteenth embodiment, the controller 100 adjusts nip pressure according to the average of the first and second temperatures t1 and t2 detected by the first and second thermistors T1 and T2, respectively, upon entry of a recording sheet S in the sheet conveyance path P, so as to correct and maintain the circumferential speed V1 of the fuser roller 22 at a substantially constant speed regardless of the diameter of the fuser roller 22 varying with temperature.

As is the case with the thirteenth embodiment depicted earlier, such nip pressure adjustment may be performed, for example, by switching the nip pressure between multiple switchable levels po, p+, and p−, depending on the average of the first and second temperatures t1 and t2 detected.

Figure 30:
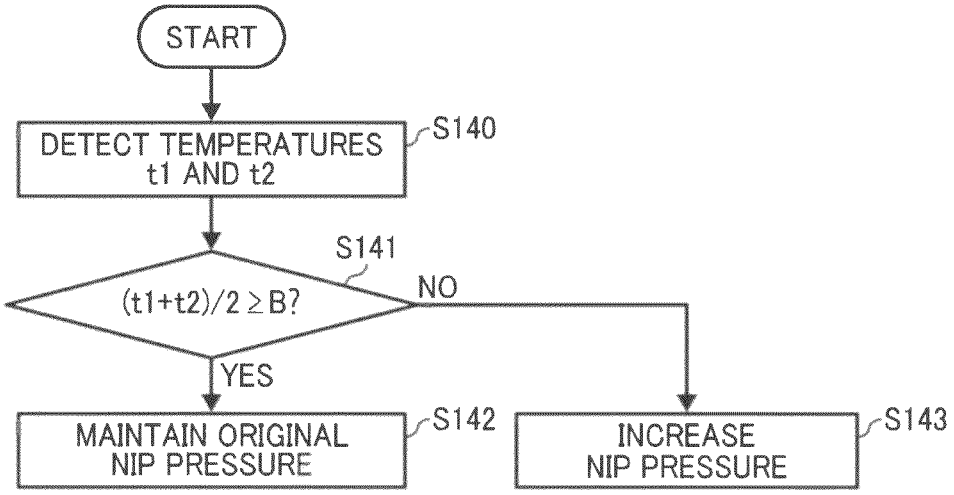
FIG. 30 is a flowchart illustrating an example of nip pressure adjustment performed by the image forming apparatus according to a fourteenth embodiment of this patent specification.

FIG. 30 is a flowchart illustrating an example of nip pressure adjustment performed by the image forming apparatus 1.

As shown in FIG. 30, initially, the first and second thermistors T1 and T2 detect first and second temperatures t1 and t2, respectively, the former at the metal core 29 of the fuser roller 22, and the latter on the fuser belt 24 along the circumference of the heat roller 23, upon entry of a recording sheet S in the sheet conveyance path P (step S140).

Then, the controller 100 determines whether the average of the detected temperatures (t1+t2)/2 exceeds a reference temperature B of, for example, 105° C. (step S141).

Where the detected average temperature (t1+t2)/2 equals or exceeds the reference temperature B, indicating that the speed differential V1−V2 falls within the acceptable range ("YES" at step S141), the controller 100 sets the nip pressure to the original, first level po, so as to process the incoming sheet S through the fixing nip N without changing the first conveyance speed V1 (step S142).

Where the detected average temperature (t1+t2)/2 falls below the reference temperature B, indicating that the speed differential V1−V2 exceeds the acceptable range ("NO" at step S141), the controller 100 sets the nip pressure to the relatively high, second level p+, so as to increase the first conveyance speed V1 for processing the incoming sheet S through the fixing nip N (step S143).

With the nip pressure thus increased where the average of the first and second temperatures t1 and t2 falls below the reference temperature B, the resulting circumferential speed V1 of the fuser roller 22 remains substantially constant relative to the fixed circumferential speed V2 of the output roller pair 27, so that the speed differential V1−V2 remains within a desired, appropriate range.

Hence, the image forming apparatus 1 according to the fourteenth embodiment of this patent specification can maintain the differential speed V1−V2 along the sheet conveyance path P within a sufficiently narrow, acceptable range so as to ensure good imaging quality as well as proper sheet conveyance performance along the sheet conveyance path P, in which the controller 100 adjusts or optimizes nip pressure depending on the temperature t1 detected at the cylindrical core 29 of the fuser roller 22 as well as the temperature t2 detected on the fuser belt 24 along the circumference of the heat roller 23, so that the fuser roller 22 can rotate with a substantially constant circumferential speed V1 regardless of variations in the operating temperature causing thermal expansion or contraction of the elastic material.

Compared to the thirteenth embodiment, such nip pressure adjustment can more accurately estimate variations in the conveyance speed due to dimensional variations of the thermally expansive, elastic roller 22, wherein the average of the first and second temperatures t1 and t2 more precisely indicates an operating temperature of the outer elastic layer than the first temperature t1 alone, particularly upon a sudden change in operating temperature.

Figure 31:
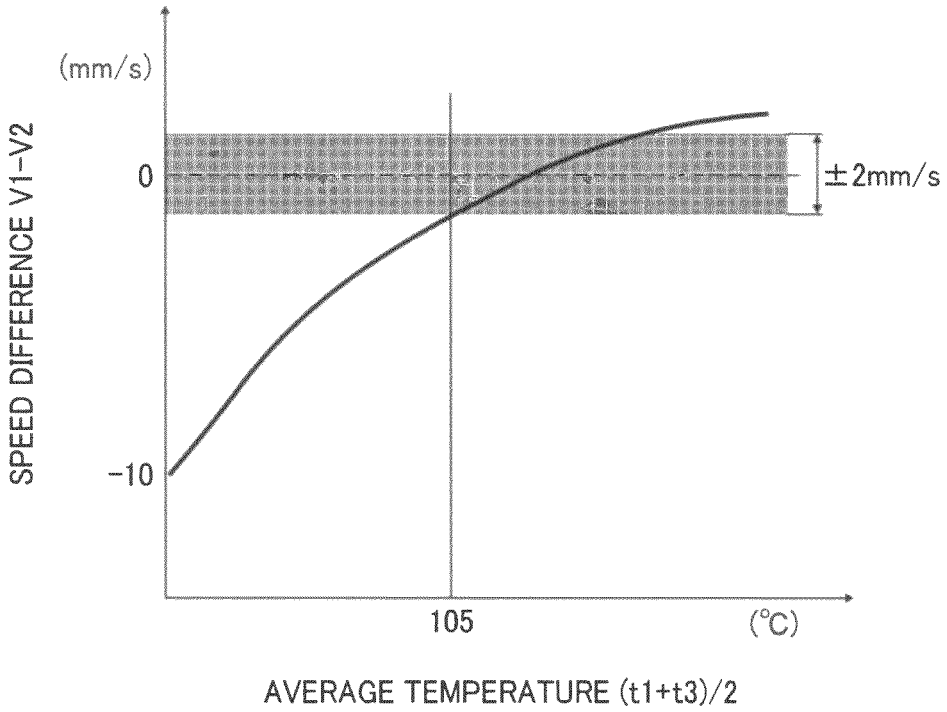
FIG. 31 is a graph showing a speed differential between fixing and output rollers plotted against an average of first and third temperatures experimentally measured in the fixing device of FIG. 26.

FIG. 31 is a graph showing the speed differential V1−V2 in millimeters per second (mm/s) between the fixing and output rollers 22 and 27, plotted against an average of the first and third temperatures t1 and t3 in degrees Celsius (° C.), the former detected at the metal core 29 of the fuser roller 22 driven with a fixed rotational speed, and the latter on the fuser belt 24 along the circumference of the fuser roller 22.

As shown in FIG. 31, where the average temperature (t1+t3)/2 remains low, the first conveyance speed V1 is significantly lower than the second conveyance speed V2 so that the speed differential V1−V2 is relatively large in absolute value. As the average temperature (t1+t3)/2 increases, causing the fuser roller 22 to thermally expand, the speed differential V1−V2 reduces toward a desired point of 0 mm/s. The speed differential V1−V2 reaches an acceptable range from −2 mm/s to 2 mm/s (indicated by shading in the graph) where the average temperature (t1+t3)/2 equals or exceeds a lower limit of approximately 105° C.

In a fifteenth embodiment, the controller 100 adjusts nip pressure according to the average of the first and third temperatures t1 and t3 detected by the first and third thermistors T1 and T3, respectively, upon entry of a recording sheet S in the sheet conveyance path P, so as to correct and maintain the circumferential speed V1 of the fuser roller 22 at a substantially constant speed regardless of the diameter of the fuser roller 22 varying with temperature.

As is the case with the thirteenth embodiment depicted earlier, such nip pressure adjustment may be performed, for example, by switching the nip pressure between multiple switchable levels po, p+, and p−, depending on the average of the first and third temperatures t1 and t3 detected.

Figure 32:
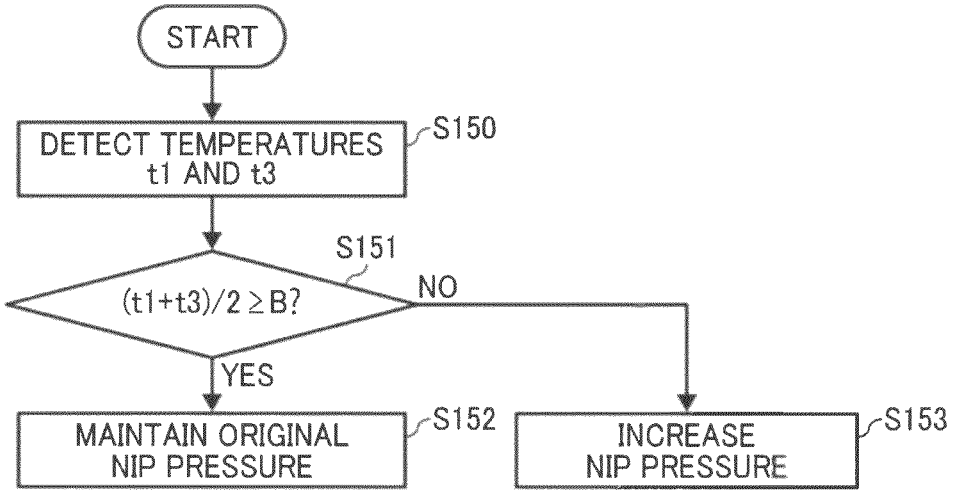
FIG. 32 is a flowchart illustrating an example of nip pressure adjustment performed by the image forming apparatus according to a fifteenth embodiment of this patent specification.

FIG. 32 is a flowchart illustrating an example of nip pressure adjustment performed by the image forming apparatus 1.

As shown in FIG. 32, initially, the first and third thermistors T1 and T3 detect first and second temperatures t1 and t3, respectively, the former at the metal core 29 of the fuser roller 22, and the latter on the fuser belt 24 along the circumference of the fuser roller 22, upon entry of a recording sheet S in the sheet conveyance path P (step S150).

Then, the controller 100 determines whether the average of the detected temperatures (t1+t3)/2 exceeds a reference temperature B of, for example, 105° C. (step S151).

Where the detected average temperature (t1+t3)/2 equals or exceeds the reference temperature B, indicating that the speed differential V1−V2 falls within the acceptable range ("YES" at step S151), the controller 100 sets the nip pressure to the original, first level po, so as to process the incoming sheet S through the fixing nip N without changing the first conveyance speed V1 (step S152).

Where the detected average temperature (t1+t3)/2 falls below the reference temperature B, indicating that the speed differential V1−V2 exceeds the acceptable range ("NO" at step S151), the controller 100 sets the nip pressure to the relatively high, second level p+, so as to increase the first conveyance speed V1 for processing the incoming sheet S through the fixing nip N (step S153).

With the nip pressure thus increased where the average of the first and third temperatures t1 and t3 falls below the reference temperature B, the resulting circumferential speed V1 of the fuser roller 22 remains substantially constant relative to the fixed circumferential speed V2 of the output roller pair 27, so that the speed differential V1−V2 remains within a desired, appropriate range.

Hence, the image forming apparatus 1 according to the fifteenth embodiment of this patent specification can maintain the differential speed V1−V2 along the sheet conveyance path P within a sufficiently narrow, acceptable range so as to ensure good imaging quality as well as proper sheet conveyance performance along the sheet conveyance path P, in which the controller 100 adjusts or optimizes nip pressure depending on the temperature t1 detected at the cylindrical core 29 of the fuser roller 22 as well as the temperature t3 detected on the fuser belt 24 along the circumference of the fuser roller 22, so that the fuser roller 22 can rotate with a substantially constant circumferential speed V1 regardless of variations in the operating temperature causing thermal expansion or contraction of the elastic material.

Compared to the thirteenth embodiment, such nip pressure adjustment can more accurately estimate variations in the conveyance speed due to dimensional variations of the thermally expansive, elastic roller 22, wherein the temperature t3 detected at the circumference of the fuser roller 22 more precisely indicates an operating temperature of the outer elastic layer than the temperature t1 detected at the metal core 29 of the fuser roller 22, particularly upon a sudden change in operating temperature.

Although in several embodiments depicted above the controller 100 controls sheet conveyance speed by increasing nip pressure where the detected temperature equals or exceeds a relatively low reference temperature indicative of a reduction in the first conveyance speed V1, such nip pressure adjustment may also be performed by decreasing nip pressure where the detected temperature equals or exceeds a relatively high reference temperature indicative of an increase in the first conveyance speed V1.

As mentioned above with reference to FIG. 27, the speed differential V1−V2 reaches the acceptable range of ±2 mm/s as the roller temperature t1 equals or exceeds a lower limit of approximately 55° C. As the roller temperature t1 rises, causing further thermal expansion of the fuser roller 22 and concomitant increase in the circumferential speed V1, the speed differential V1−V2 reaches the desired point of 0 mm/s, and again exceeds the acceptable range where the roller temperature t1 exceeds an upper limit of approximately 95° C.

In a sixteenth embodiment, the controller 100 adjusts nip pressure depending on the first temperature t1 as well as the third temperature t3. Unlike the foregoing embodiments, the controller 100 decreases, instead of increasing, nip pressure from a rated, original pressure where the detected temperature equals or exceeds a given reference temperature.

Figure 33:
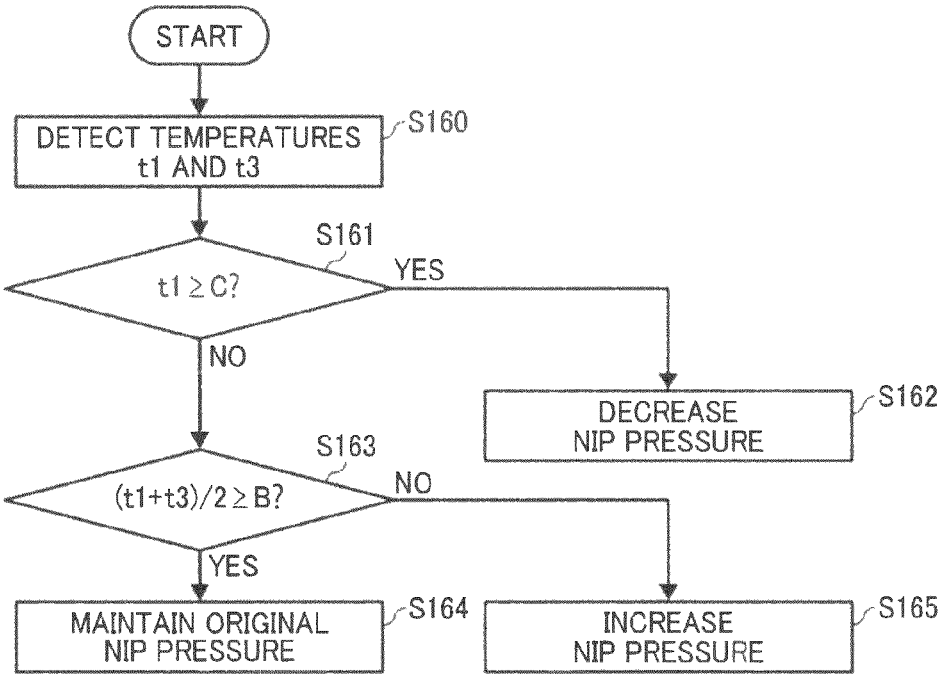
FIG. 33 is a flowchart illustrating an example of nip pressure adjustment performed by the image forming apparatus according to a sixteenth embodiment of this patent specification.

FIG. 33 is a flowchart illustrating an example of nip pressure adjustment performed by the image forming apparatus 1.

As shown in FIG. 33, initially, the first and third thermistors T1 and T3 detect first and second temperatures t1 and t3, respectively, the former at the metal core 29 of the fuser roller 22, and the latter on the fuser belt 24 along the circumference of the fuser roller 22, upon entry of a recording sheet S in the sheet conveyance path P (step S160).

Then, the controller 100 determines whether the detected temperature t1 exceeds a first reference temperature C of, for example, 95° C. (step S161).

Where the detected temperature t1 equals or exceeds the reference temperature C, indicating that the speed differential V1−V2 exceeds the acceptable range ("YES" at step S161), the controller 100 sets the nip pressure to the relatively low, third level p−, so as to decrease the first conveyance speed V1 for processing the incoming sheet S through the fixing nip N (step S162).

Where the detected temperature t1 falls below the reference temperature C ("NO" at step S161), the controller 100 then determines whether the average of the detected temperatures (t1+t3)/2 exceeds a second reference temperature B of, for example, 105° C. (step S163).

Where the detected average temperature (t1+t3)/2 equals or exceeds the reference temperature B, indicating that the speed differential V1−V2 falls within the acceptable range ("YES" at step S163), the controller 100 sets the nip pressure to the original, first level po, so as to process the incoming sheet S through the fixing nip N without changing the first conveyance speed V1 (step S164).

Where the detected average temperature (t1+t3)/2 falls below the reference temperature B, indicating that the speed differential V1−V2 exceeds the acceptable range ("NO" at step S163), the controller 100 sets the nip pressure to the relatively high, second level p+, so as to increase the first conveyance speed V1 for processing the incoming sheet S through the fixing nip N (step S165).

With the nip pressure thus decreased where the first temperature t1 exceeds the reference temperature C and increased where the average of the first and third temperatures t1 and t3 falls below the reference temperature B, the resulting circumferential speed V1 of the fuser roller 22 remains substantially constant relative to the fixed circumferential speed V2 of the output roller pair 27, so that the speed differential V1−V2 remains within a desired, appropriate range.

Although the embodiment depicted in FIG. 33 controls sheet conveyance speed based on the combination of first and third temperatures t1 and t3, alternatively, instead, it is possible to determine whether to maintain the original nip pressure based on the combination of first and second temperatures t1 and t2. Moreover, although the present embodiment uses the first temperature t1 to determine whether to decrease the nip pressure, alternatively, instead, it is possible to base such determination upon either the average of the first and third temperatures (t1+t3)/2 or the average of the first and second temperatures (t1+t2)/2 with an appropriate reference temperature.

Hence, the image forming apparatus 1 according to the sixteenth embodiment of this patent specification can maintain the differential speed V1−V2 along the sheet conveyance path P within a sufficiently narrow, acceptable range so as to ensure good imaging quality as well as proper sheet conveyance performance along the sheet conveyance path P, in which the controller 100 adjusts or optimizes nip pressure depending on the temperature t1 detected at the cylindrical core 29 of the fuser roller 22 as well as the temperature t3 detected on the fuser belt 24 along the circumference of the fuser roller 22, so that the fuser roller 22 can rotate with a substantially constant circumferential speed V1 regardless of variations in the operating temperature causing thermal expansion or contraction of the elastic material.

Compared to the foregoing embodiments, such nip pressure adjustment can more reliably maintain the differential speed V1−V2 within an appropriate range, wherein the controller 100 not only increases nip pressure upon detecting a relatively low operating temperature indicating that the fuser roller 22 contracts in diameter to yield a relatively slow circumferential speed, but also decreases nip pressure upon detecting a relatively high operating temperature indicating that the fuser roller 22 expands in diameter to yield a relatively fast circumferential speed.

In the thirteenth through sixteenth embodiments depicted above, the image forming apparatus 1 may gradually reset or restore the corrected nip pressure to the rated original level, where the fixing device 20 successively processes an increased number of recording sheets S for an extended period of time, during which the fuser roller 22 gradually heats to a designed operating temperature, so that the differential speed V1–V2 falls within an appropriate, acceptable range.

Specifically, for example, the controller 100 may gradually restore nip pressure to the first level po as the number of recording sheets S processed through the fixing nip N increases since activation of the fixing process. In such cases, nip pressure is switched from one level to another toward the original level upon counting a given number of recording sheets (e.g., 25 sheets) successively processed through the fixing nip N.

Alternatively, the controller 100 may gradually restore nip pressure to the first level po as the elapsed time, instead of the number of recording sheets, increases since activation of the fixing process. In such cases, nip pressure is switched from one level to another toward the original level upon lapse of a given period of time (e.g., 1 minute) during which the fuser roller 22 remains active to process recording sheets through the fixing nip N.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image forming apparatus comprising:

an imaging unit to form a toner image on a recording medium conveyed along a media conveyance path;

a fixing device disposed downstream from the imaging unit along the media conveyance path to fix the toner image in place on the recording medium, the fixing device including:

a fuser roller having a cylindrical core of metal, a circumference thereof formed of an elastic layer deposited on the cylindrical metal core;

a heat roller disposed parallel to the fuser roller, a circumference thereof subjected to heating;

an endless, fuser belt looped for rotation around the fuser roller and the heat roller; and a pressure roller disposed opposite the fuser roller with the fuser belt interposed between the pressure roller and the fuser roller, the pressure roller pressing against the fuser roller via the fuser belt to form a fixing nip therebetween, through which the recording medium is conveyed under heat and pressure as the fuser roller is driven to rotate with a given rotational speed;

a first thermometer disposed adjacent to the cylindrical core of the fuser roller to detect a first temperature directly at the cylindrical core of the fuser roller; and a controller operatively connected with the first thermometer to control conveyance of the recording medium through the fixing nip according to the first temperature detected upon entry of the recording medium in the media conveyance path.

2. The image forming apparatus according to claim 1, further comprising:

a second thermometer disposed adjacent to the heat roller to detect a second temperature at the circumference of the heat roller, wherein the controller is operatively connected with the first and second thermometers to control media conveyance according to a combination of the first and second temperatures detected upon entry of the recording medium in the media conveyance path.

3. The image forming apparatus according to claim 1, further comprising:

a third thermometer disposed adjacent to the fuser roller to detect a third temperature at the circumference of the fuser roller, wherein the controller is operatively connected with the first and third thermometers to control media conveyance according to a combination of the first and third temperatures detected upon entry of the recording medium in the media conveyance path.

4. The image forming apparatus according to claim 1, wherein the controller includes a rotary drive of the fuser roller to control media conveyance by adjusting the rotational speed of the fuser roller depending on the temperature detected upon entry of the recording medium in the media conveyance path.

5. The image forming apparatus according to claim 4, wherein the controller increases the rotational speed of the fuser roller where the first temperature detected falls below a first reference temperature.

6. The image forming apparatus according to claim 5, wherein the controller decreases the rotational speed of the fuser roller where the first temperature detected exceeds a second reference temperature higher than the first reference temperature.

7. An image forming apparatus comprising:

an imaging unit to form a toner image on a recording medium conveyed along a media conveyance path;

a fixing device disposed downstream from the imaging unit along the media conveyance path to fix the toner image in place on the recording medium, the fixing device including:

a fuser roller having a cylindrical core of metal, a circumference thereof formed of an elastic layer deposited on the cylindrical metal core;

a heat roller disposed parallel to the fuser roller, a circumference thereof subjected to heating;

an endless, fuser belt looped for rotation around the fuser roller and the heat roller; and a pressure roller disposed opposite the fuser roller with the fuser belt interposed between the pressure roller and the fuser roller, the pressure roller pressing against the fuser roller via the fuser belt to form a fixing nip therebetween, through which the recording medium is conveyed under heat and pressure as the fuser roller is driven to rotate with a given rotational speed;

a first thermometer disposed adjacent to the fuser roller to detect a first temperature at the cylindrical core of the fuser roller;

a second thermometer disposed adjacent to the heat roller to detect a second temperature at the circumference of the heat roller; and a controller operatively connected with the first thermometer to control conveyance of the recording medium through the fixing nip according to the first temperature detected upon entry of the recording medium in the media conveyance path, wherein the controller includes a rotary drive of the fuser roller to control media conveyance by adjusting the rotational speed of the fuser roller depending on the temperature detected upon entry of the recording medium in the media conveyance path, and wherein the controller is operatively connected with the first and second thermometers to increase the rotational speed of the fuser roller where an average of the first and second temperatures detected falls below a reference temperature.

8. An image forming apparatus comprising:

an imaging unit to form a toner image on a recording medium conveyed along a media conveyance path;

a fixing device disposed downstream from the imaging unit along the media conveyance path to fix the toner image in place on the recording medium, the fixing device including:

a fuser roller having a cylindrical core of metal, a circumference thereof formed of an elastic layer deposited on the cylindrical metal core;

a heat roller disposed parallel to the fuser roller, a circumference thereof subjected to heating;

an endless, fuser belt looped for rotation around the fuser roller and the heat roller; and a pressure roller disposed opposite the fuser roller with the fuser belt interposed between the pressure roller and the fuser roller, the pressure roller pressing against the fuser roller via the fuser belt to form a fixing nip therebetween, through which the recording medium is conveyed under heat and pressure as the fuser roller is driven to rotate with a given rotational speed;

a first thermometer disposed adjacent to the fuser roller to detect a first temperature at the cylindrical core of the fuser roller;

a third thermometer disposed adjacent to the fuser roller to detect a third temperature at the circumference of the fuser roller; and a controller operatively connected with the first thermometer to control conveyance of the recording medium through the fixing nip according to the first temperature detected upon entry of the recording medium in the media conveyance path, wherein the controller includes a rotary drive of the fuser roller to control media conveyance by adjusting the rotational speed of the fuser roller depending on the temperature detected upon entry of the recording medium in the media conveyance path, and wherein the controller is operatively connected with the first and third thermometers to increase the rotational speed of the fuser roller where an average of the first and second temperatures detected falls below a reference temperature.

9. The image forming apparatus according to claim 4, wherein the controller resets the adjusted rotational speed of the fuser roller according to an increased number of recording media successively passed through the fixing nip.

10. The image forming apparatus according to claim 4, wherein the controller resets the adjusted rotational speed of the fuser roller according to time elapsed since activation of the fuser roller.

11. The image forming apparatus according to claim 1, further comprising:

a secondary fixing device disposed downstream from the fixing device along the media conveyance path to process the toner image after fixing on the recording medium, the secondary fixing device including:

a secondary fuser roller; and a secondary pressure roller disposed opposite the secondary fuser roller, the secondary pressure roller pressing against the secondary fuser roller to form a secondary fixing nip therebetween, through which the recording medium is conveyed as the secondary fuser roller is driven to rotate with a secondary rotational speed;

wherein the controller includes a rotary drive of the secondary fuser roller to control media conveyance by adjusting the secondary rotational speed depending on the temperature detected upon entry of the recording medium in the media conveyance path.

12. The image forming apparatus according to claim 11, further comprising:

a second thermometer disposed adjacent to the heat roller to detect a second temperature at the circumference of the heat roller, wherein the controller is operatively connected with the first and second thermometers to adjust the rotational speed of the secondary fuser roller depending on a combination of the first and second temperatures being detected.

13. The image forming apparatus according to claim 11, further comprising:

a third thermometer disposed adjacent to the fuser roller to detect a third temperature at the circumference of the fuser roller, wherein the controller is operatively connected with the first and third thermometers to adjust the rotational speed of the secondary fuser roller depending on a combination of the first and third temperatures being detected.

14. The image forming apparatus according to claim 1, further comprising:

an output unit disposed downstream from the fixing device along the media conveyance path to output the recording medium to a subsequent process, the output unit including a pair of opposed conveyance rollers, at least one of which is driven to rotate with an output rotational speed to convey the recording medium through the output unit;

wherein the controller includes a rotary drive of the output roller to control media conveyance by adjusting the rotational speed of the output roller depending on the temperature detected upon entry of the recording medium in the media conveyance path.

15. The image forming apparatus according to claim 14, further comprising:

a second thermometer disposed adjacent to the heat roller to detect a second temperature at the circumference of the heat roller, wherein the controller is operatively connected with the first and second thermometers to adjust the rotational speed of the output roller depending on a combination of the first and second temperatures being detected.

16. The image forming apparatus according to claim 14, further comprising:

a third thermometer disposed adjacent to the fuser roller to detect a third temperature at the circumference of the fuser roller, wherein the controller is operatively connected with the first and third thermometers to adjust the rotational speed of the output roller depending on a combination of the first and third temperatures being detected.

17. The image forming apparatus according to claim 1, further comprising:

an adjustable biasing mechanism to adjust a nip pressure with which the pressure roller presses against the fuser roller at the fixing nip;

wherein the controller is operatively connected with the biasing mechanism to control media conveyance by adjusting the nip pressure depending on the temperature detected upon entry of the recording medium in the media conveyance path.

18. The image forming apparatus according to claim 17, further comprising:

a second thermometer disposed adjacent to the heat roller to detect a second temperature at the circumference of the heat roller, wherein the controller is operatively connected with the first and second thermometers to adjust the nip pressure depending on a combination of the first and second temperatures being detected.

19. The image forming apparatus according to claim 17, further comprising:

a third thermometer disposed adjacent to the fuser roller to detect a third temperature at the circumference of the fuser roller, wherein the controller is operatively connected with the first and third thermometers to adjust the nip pressure depending on a combination of the first and third temperatures being detected.

20. An image forming apparatus comprising:

an imaging unit to form a toner image on a recording medium conveyed along a media conveyance path;

a fixing device disposed downstream from the imaging unit along the media conveyance path to fix the toner image in place on the recording medium, the fixing device including:

a fuser roller having a cylindrical core of metal, a circumference thereof formed of an elastic layer deposited on the cylindrical metal core;

a heat roller disposed parallel to the fuser roller, a circumference thereof subjected to heating;

an endless, fuser belt looped for rotation around the fuser roller and the heat roller; and a pressure roller disposed opposite the fuser roller with the fuser belt interposed between the pressure roller and the fuser roller, the pressure roller pressing against the fuser roller via the fuser belt to form a fixing nip therebetween, through which the recording medium is conveyed with a first conveyance speed along the circumference of the fuser roller;

a first thermometer disposed adjacent to the cylindrical core of the fuser roller to detect a first temperature directly at the cylindrical core of the fuser roller;

a post-fixing unit disposed downstream from the fixing device along the media conveyance path to process the toner image after fixing on the recording medium, the post-fixing unit including a pair of opposed conveyance rollers rotating together to convey the recording medium with a second conveyance speed therebetween; and means for adjusting the first conveyance speed relative to the second conveyance speed according to the first temperature detected upon entry of the recording medium in the media conveyance path.

* * * * *